US009186904B2

(12) United States Patent
Tsuchiya et al.

(10) Patent No.: US 9,186,904 B2
(45) Date of Patent: Nov. 17, 2015

(54) PRINTER

(71) Applicant: FUJITSU COMPONENT LIMITED, Tokyo (JP)

(72) Inventors: Masahiro Tsuchiya, Tokyo (JP); Yukihiro Mori, Tokyo (JP); Sumio Watanabe, Tokyo (JP); Masaru Kihara, Tokyo (JP); Yoshinari Takabatake, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/243,969

(22) Filed: Apr. 3, 2014

(65) Prior Publication Data

US 2014/0232806 A1 Aug. 21, 2014

Related U.S. Application Data

(63) Continuation of application No. PCT/JP2012/075720, filed on Oct. 3, 2012.

(30) Foreign Application Priority Data

| | | |
|---|---|---|
| Oct. 7, 2011 | (JP) | 2011-223033 |
| Oct. 7, 2011 | (JP) | 2011-223034 |
| Oct. 7, 2011 | (JP) | 2011-223035 |
| Oct. 13, 2011 | (JP) | 2011-226262 |
| Dec. 26, 2011 | (JP) | 2011-284427 |

(51) Int. Cl.
*B41J 25/304* (2006.01)
*B41J 2/335* (2006.01)
(Continued)

(52) U.S. Cl.
CPC ..... *B41J 2/33505* (2013.01); *B41J 2/32* (2013.01); *B41J 11/04* (2013.01); *B41J 11/14* (2013.01); *B41J 25/312* (2013.01); *B41J 25/304* (2013.01); *B41J 2202/31* (2013.01)

(58) Field of Classification Search
USPC ..... 347/197, 198; 400/120.16, 120.17
See application file for complete search history.

(56) References Cited

U.S. PATENT DOCUMENTS 5,579,043 A * 11/1996 Patry ..... 347/222
5,599,113 A * 2/1997 Suzuki et al. ..... 400/120.16
(Continued)

FOREIGN PATENT DOCUMENTS

EP 1323535 4/2005
JP H11-245458 9/1999
(Continued)

OTHER PUBLICATIONS

Computer-generated translation of JP 2008-179087, published on Aug. 2008.*
(Continued)

*Primary Examiner* — Huan Tran
(74) *Attorney, Agent, or Firm* — IPUSA, PLLC

(57) ABSTRACT

A printer includes a frame that includes a frame back part, an arm that includes a rotation shaft and is supported by the frame to rotate around the rotation shaft relative to the frame, a platen roller that is rotatably supported by the frame or the arm, a print head that is disposed between the frame back part and the platen roller and performs printing on a recording sheet placed between the platen roller and the print head, and a first bias spring that is disposed between the frame back part and the print head and biases the print head toward the platen roller relative to the frame back part.

17 Claims, 67 Drawing Sheets

(51) Int. Cl.

| | |
|---|---|
| ***B41J 2/32*** | (2006.01) |
| ***B41J 25/312*** | (2006.01) |
| ***B41J 11/04*** | (2006.01) |
| ***B41J 11/14*** | (2006.01) |

(56) References Cited

U.S. PATENT DOCUMENTS

| | | | | |
|---|---|---|---|---|
| 5,959,653 | A * | 9/1999 | Sekiya | 347/222 |
| 6,249,302 | B1 * | 6/2001 | Sekiya | 347/220 |
| 6,336,760 | B2 | 1/2002 | Mori et al. | |
| 6,682,239 | B2 * | 1/2004 | Mori et al. | 400/649 |
| 7,561,173 | B2 | 7/2009 | Hirai | |
| 7,852,360 | B2 * | 12/2010 | Takahashi | 347/198 |
| 8,449,207 | B2 * | 5/2013 | Takabatake et al. | 400/56 |
| 2002/0021927 | A1 | 2/2002 | Mori et al. | |
| 2002/0135659 | A1 | 9/2002 | Sato | |
| 2006/0291933 | A1 | 12/2006 | Watanabe et al. | |
| 2008/0180468 | A1 | 7/2008 | Takahashi | |
| 2009/0086006 | A1 * | 4/2009 | Koyabu et al. | 347/197 |
| 2009/0153640 | A1 | 6/2009 | Hirai et al. | |
| 2011/0074903 | A1 * | 3/2011 | Takahashi | 347/198 |
| 2012/0242772 | A1 * | 9/2012 | Jimbo | 347/197 |

FOREIGN PATENT DOCUMENTS

| | | |
|---|---|---|
| JP | 2000-094767 | 4/2000 |
| JP | 2002-120389 | 4/2002 |
| JP | 2002-248820 | 9/2002 |
| JP | 2002-283631 | 10/2002 |
| JP | 3599595 | 12/2004 |
| JP | 3734753 | 1/2006 |
| JP | 2008-068551 | 3/2008 |
| JP | 2008-179087 | 8/2008 |
| JP | 2009-143133 | 7/2009 |
| JP | 2011-056956 | 3/2011 |

OTHER PUBLICATIONS

International Search Report mailed on Jan. 8, 2013.

* cited by examiner

100D

100E

PRINTER

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2012/075720, filed on Oct. 3, 2012, which is based on and claims the benefit of priority of Japanese Patent Application No. 2011-223033 filed on Oct. 7, 2011, Japanese Patent Application No. 2011-223034 filed on Oct. 7, 2011, Japanese Patent Application No. 2011-223035 filed on Oct. 7, 2011, Japanese Patent Application No. 2011-226262 filed on Oct. 13, 2011, and Japanese Patent Application No. 2011-284427 filed on Dec. 26, 2011, the entire contents of which are incorporated herein by reference.

BACKGROUND OF THE INVENTION

1. Field of the Invention

An aspect of this disclosure relates to a printer.

2. Description of the Related Art

Printers for printing receipts are widely used, for example, for cash registers in shops and stores, and for automated teller machines (ATM) and cash dispensers (CD) in banks. Generally, in such a printer for printing receipts, thermal paper used as recording paper is conveyed into a space between a thermal head and a platen roller, and information is printed by the thermal head at a predetermined position on the recording paper.

This type of printer is configured such that the platen roller is detachable to easily place recording paper between the thermal head and the platen roller.

In a typical printer for printing information on recording paper with a thermal head, the thermal head is pressed toward a platen roller to improve the contact between the thermal head and the platen roller during printing.

Japanese Patent No. 3734753 discloses a configuration of a thermal printer including a biasing part that is provided on a lock arm and applies a biasing force to a platen roller to press the circumferential surface of the platen roller against a line thermal head, an operation part formed on the lock arm, a pressing part that engages the operation part and presses down the operation part in opposition to the biasing force of the biasing part, and a platen roller detaching part that disengages a rotational shaft of the platen roller from a rotational shaft support part of the lock arm.

Japanese Laid-Open Patent Publication No. 2000-318260 discloses a configuration where a frame includes a slit having a shape for guiding a bearing of a platen roller, and the bearing of the platen roller is pressed against the slit by a lock arm to support the platen roller. The lock arm uses a biasing force of a pressure spring for pressing a thermal head against the platen roller. The pressure spring biases a head support for supporting the thermal head in a direction to move away from the lock arm.

Japanese Laid-Open Patent Publication No. 2008-068551 discloses a thermal printer including a first spring that is disposed between a lock arm and a thermal head and biases a platen roller toward the thermal head, and a second spring that is disposed between the thermal head and a body frame and biases the thermal head in a direction to bring the thermal head into close contact with the platen roller.

Japanese Laid-Open Patent Publication No. 2000-094767 discloses a thermal printer where a thermal head and a platen are provided as a unit. The platen is movable away from the thermal head. When the platen is moved away from the thermal head, a paper passage is formed between the thermal head and the platen. When paper is set in the thermal printer, the paper is put through the paper passage.

With the related-art technologies, however, a biasing part such as a coil spring is provided on a back support plate of a lock arm to press a thermal head toward a platen roller relative to the back support plate of the lock arm. This configuration poses some problems.

SUMMARY OF THE INVENTION

According to an aspect of this disclosure, there is provided a printer including a frame that includes a frame back part, an arm that includes a rotation shaft and is supported by the frame to rotate around the rotation shaft relative to the frame, a platen roller that is rotatably supported by the frame or the arm, a print head that is disposed between the frame back part and the platen roller and performs printing on a recording sheet placed between the platen roller and the print head, and a first bias spring that is disposed between the frame back part and the print head and biases the print head toward the platen roller relative to the frame back part.

DESCRIPTION OF EMBODIMENTS

Embodiments of the present invention are described below with reference to the accompanying drawings.

The same reference number is assigned to the same component throughout the accompanying drawings, and repeated descriptions of the same component are omitted.

First Embodiment

A printer including a biasing part provided on a back support plate of an arm (lock arm) is described.

Figure 1:
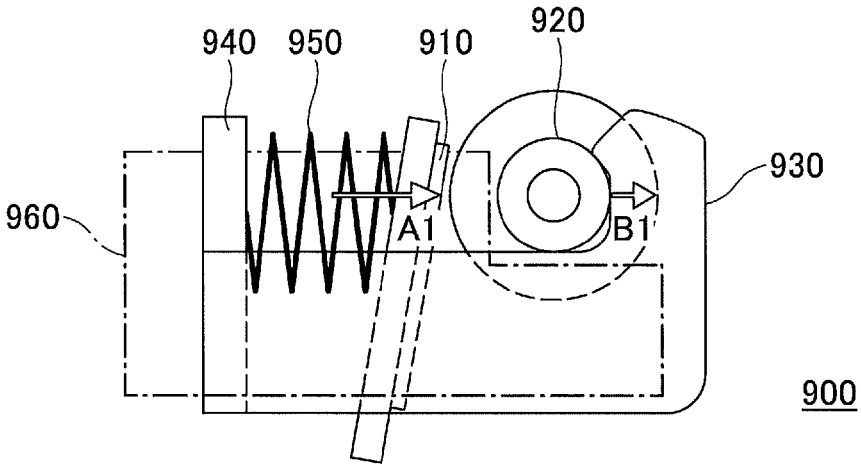
FIG. 1 is a drawing illustrating a configuration of a related-art printer.
Figure 2:
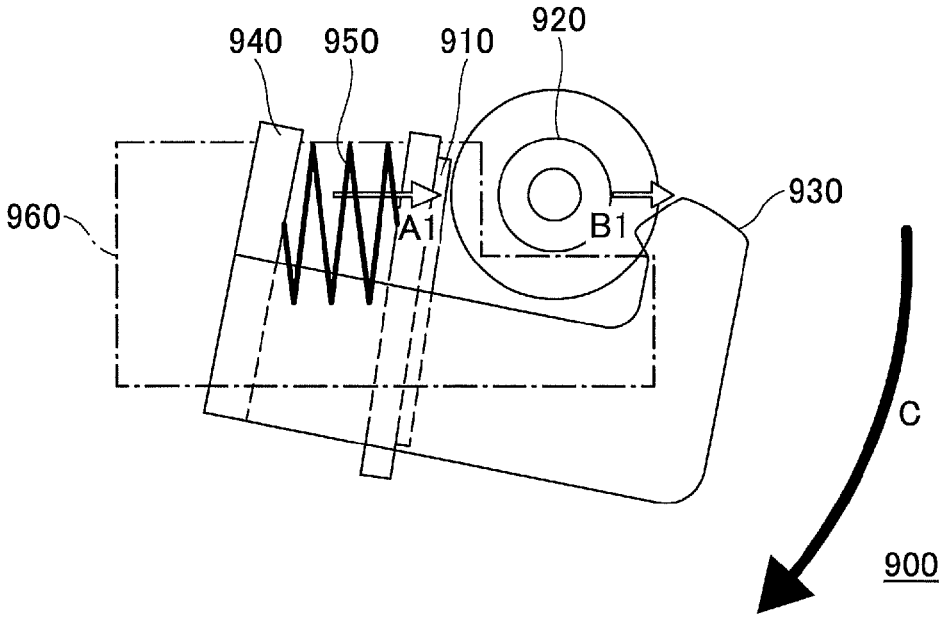
FIG. 2 is a drawing illustrating a configuration of a related-art printer.

FIGS. 1 and 2 are side views illustrating a configuration of a printer including a biasing part provided on a back support plate of an arm.

A printer 900 of FIG. 1 includes a thermal head 910 including a heat sink, a platen roller 920, an arm 930, a coil spring 950, and a frame 960. The thermal head 910, the platen roller 920, the arm 930, and the coil spring 950 are disposed in the frame 960.

The platen roller 920 is supported by the arm 930. A back support plate 940 is attached to the arm 930, and the coil spring 950 is disposed between the back support plate 940 and the thermal head 910. In the printer 900, the restoring force of the coil spring 950 is applied via the thermal head 910 to the platen roller 920 as indicated by an arrow A1. Accordingly, a force is applied by the coil spring 950 to the thermal head 910 in a direction toward the platen roller 920.

The restoring force of the coil spring 950 is also applied via the platen roller 920 to the arm 930 as indicated by an arrow B1. Thus, with the restoring force of the coil spring 950, the platen roller 920 is supported by the arm 930.

When information is printed on recording paper (not shown) with the printer 900, the recording paper is set between the thermal head 910 and the platen roller 920. As illustrated by FIG. 2, the platen roller 920 can be detached by rotating the arm 930 in a direction indicated by an arrow C to set recording paper in the printer 900.

Because the back support plate 940 is attached to the arm 930, the back support plate 940 also moves toward the thermal head 910. Accordingly, when the platen roller 920 is attached or detached, the coil spring 950 disposed between the back support plate 940 and the thermal head 910 contracts. As a result, a strong restoring force of the coil spring 950 is generated, and the strong restoring force is applied as stress via the heat sink to the back of the thermal head 910.

In FIGS. 1 and 2, the outline of the frame 960 is indicated by a dashed-dotted line.

<Printer>

Next, a printer according to a first embodiment is described.

FIGS. 3 through 15 illustrate a configuration of a printer 100 of the present embodiment.

As illustrated by FIGS. 3 through 12, the printer 100 of the present embodiment includes a thermal head 110 used as a print head, a platen roller 120, an open-close arm 130, first bias springs 140, a second bias spring 150 (see, for example, FIG. 7), a frame 160, a motor 170, and a gear unit 180. The thermal head 110, the platen roller 120, the open-close arm 130, the first bias springs 140, and the second bias spring 150 are disposed in the frame 160.

Figure 3:
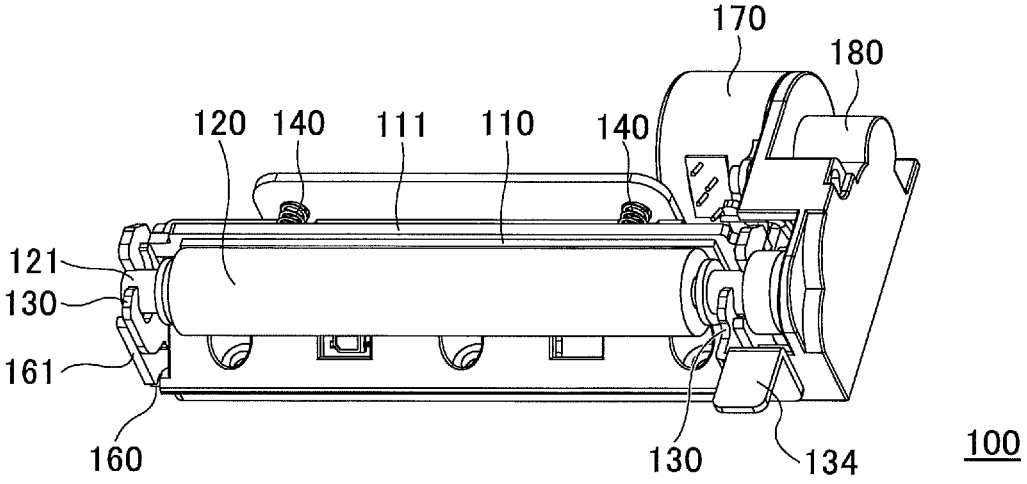
FIG. 3 is a drawing illustrating a printer of an embodiment.
Figure 4:
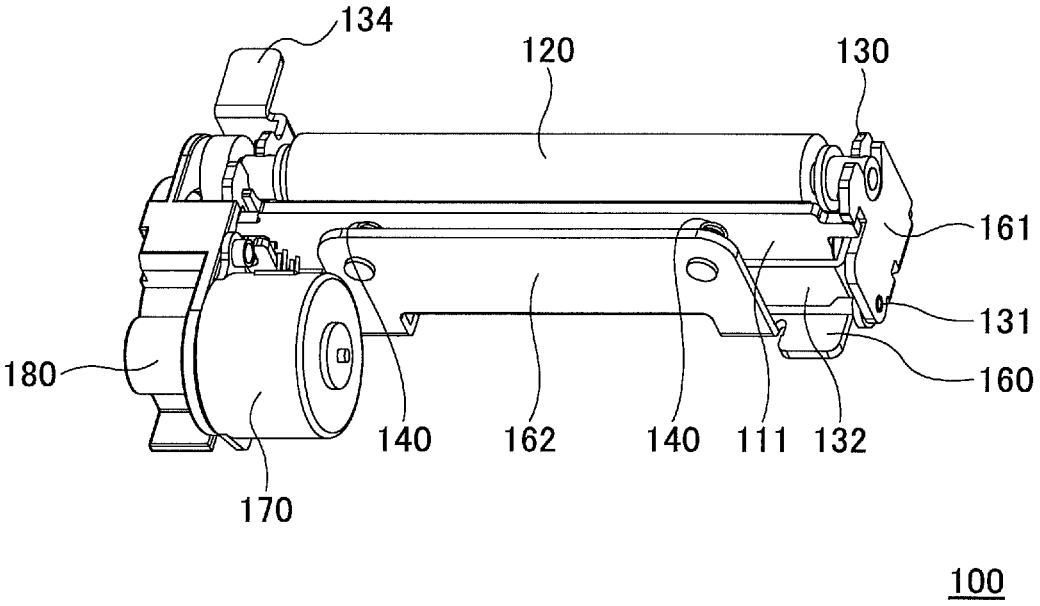
FIG. 4 is a drawing illustrating a printer of an embodiment.
Figure 5:
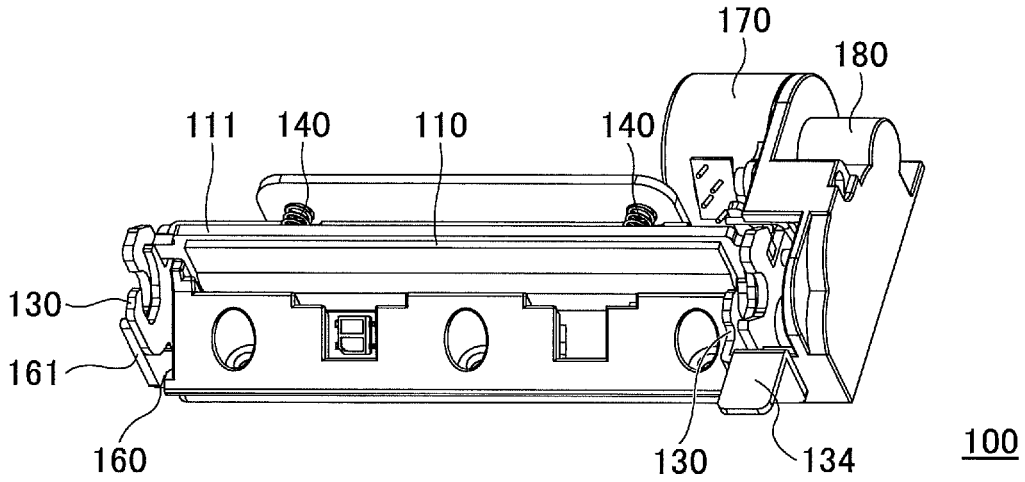
FIG. 5 is a drawing illustrating a printer of an embodiment.
Figure 6:
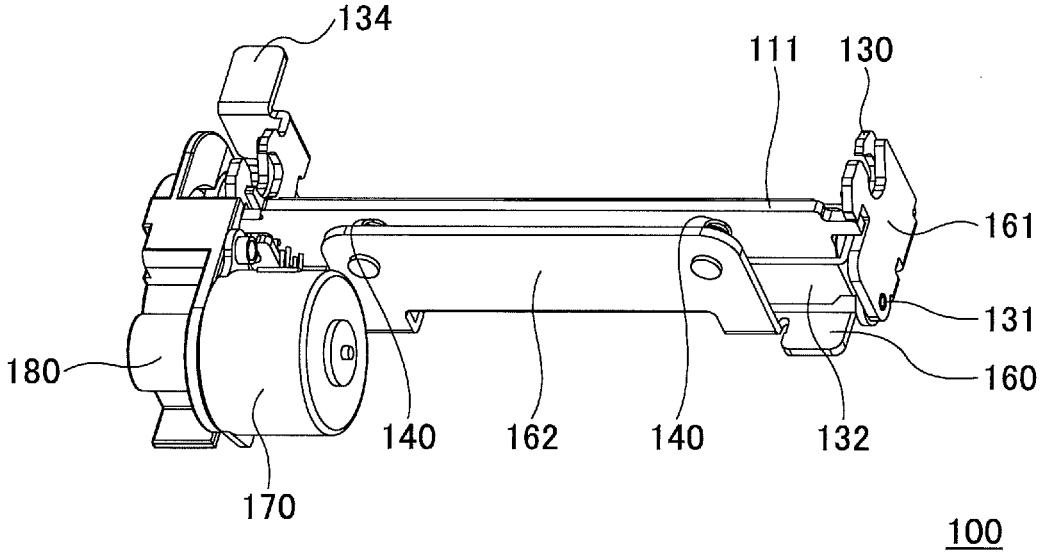
FIG. 6 is a drawing illustrating a printer of an embodiment.
Figure 7:
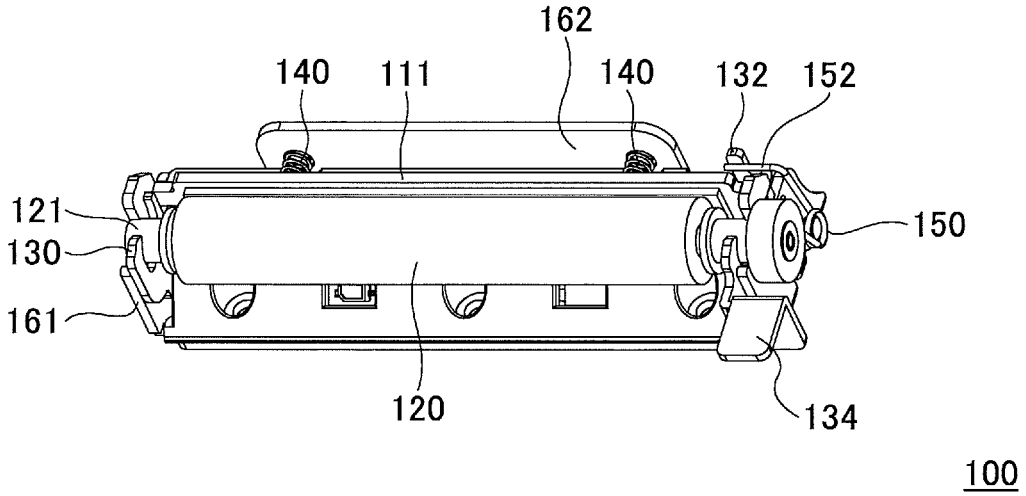
FIG. 7 is a drawing illustrating a printer of an embodiment.
Figure 8:
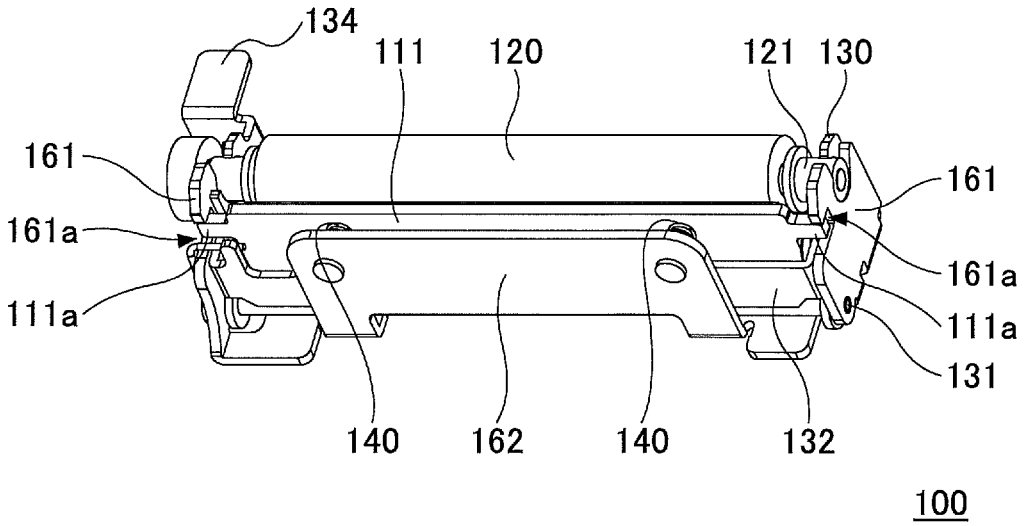
FIG. 8 is a drawing illustrating a printer of an embodiment.
Figure 9:
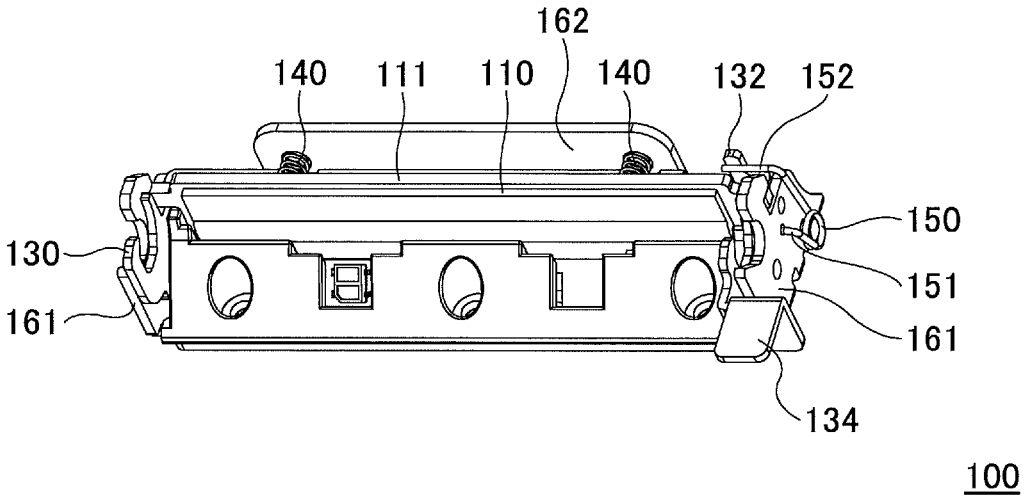
FIG. 9 is a drawing illustrating a printer of an embodiment.
Figure 10:
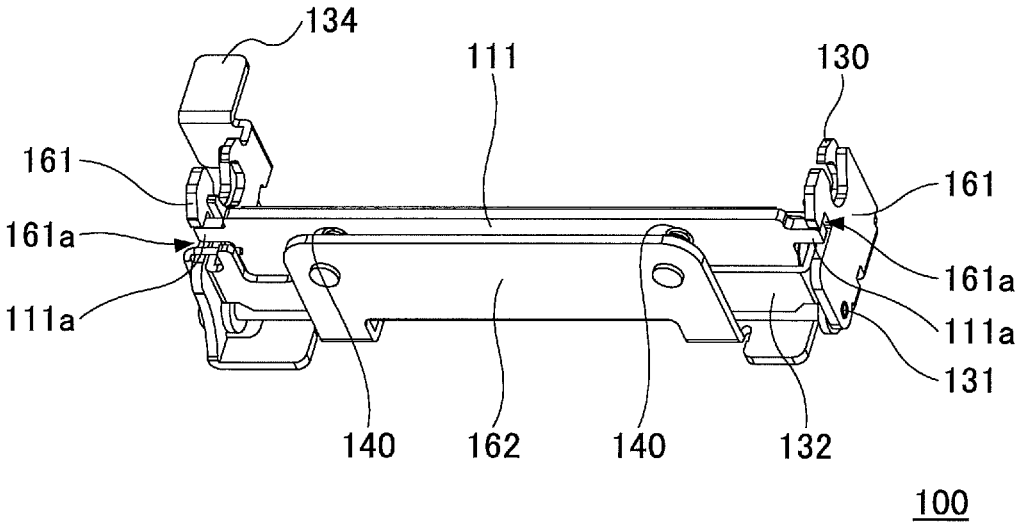
FIG. 10 is a drawing illustrating a printer of an embodiment.
Figure 11:
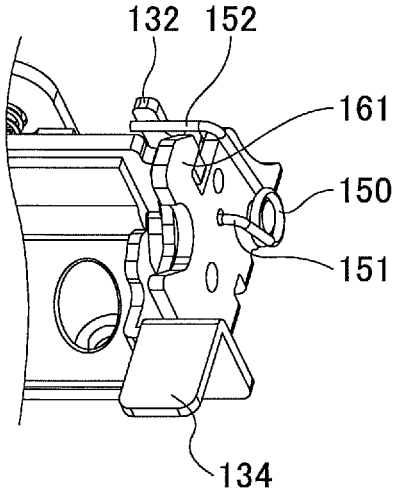
FIG. 11 is an enlarged view of a part of FIG. 9.
Figure 12:
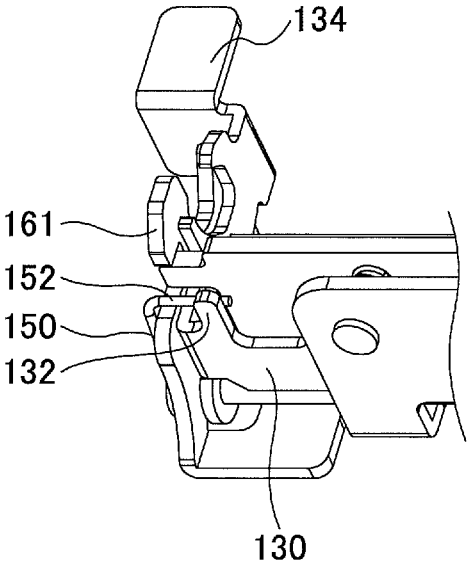
FIG. 12 is an enlarged view of a part of FIG. 10.

FIGS. 3 and 4 are perspective views illustrating parts of the printer 100 of the present embodiment. FIG. 3 is a front perspective view, and FIG. 4 is a rear perspective view. FIGS. 5 and 6 are perspective views of the printer 100 from which the platen roller 120 is detached. FIG. 5 is a front perspective view, and FIG. 6 is a rear perspective view. FIGS. 7 and 8 are perspective views of the printer 100 from which the motor 170 and the gear unit 180 are detached. FIG. 7 is a front perspective view, and FIG. 8 is a rear perspective view. FIGS. 9 and 10 are perspective views of the printer 100 from which the platen roller 120, the motor 170, and the gear unit 180 are detached. FIG. 9 is a front perspective view, and FIG. 10 is a rear perspective view. FIG. 11 is an enlarged view of a part of FIG. 9, and FIG. 12 is an enlarged view of a part of FIG. 10.

The platen roller 120 includes platen bearings 121. The frame 160 includes frame side parts 161 and a frame back part 162 (see, for example, FIG. 4).

The platen bearings 121 of the platen roller 120 are rotatably supported by the open-close arm 130 and the frame side parts 161 of the frame 160. The motor 170 is disposed in the frame 160. When the motor 170 rotates, the platen roller 120 is rotated via the gear unit 180.

The printer 100 further includes a heat sink 111 that is provided on the back side of the thermal head 110 and used as a head support plate. The frame back part 162 of the frame 160 is formed to face the heat sink 111.

The first bias springs 140 may be implemented by a coil spring such as a compression coil spring. In the present embodiment, the first bias springs 140 are disposed between the heat sink 111 and the frame back part 162. The thermal head 110 is pressed via the heat sink 111 by the restoring force of the first bias springs 140 toward the platen roller 120. That is, the first bias springs 140 are disposed between the frame 160 and the thermal head 110, and bias the thermal head 110 toward the platen roller 120.

The open-close arm 130 includes an arm rotation shaft 131, an open-close arm back part 132, open-close arm side parts 133 (see FIG. 14), and an open-close arm operation part 134. The open-close arm 130 is supported by the frame side parts 161 such that the open-close arm 130 is rotatable around the arm rotation shaft 131 relative to the frame 160.

Figure 16:
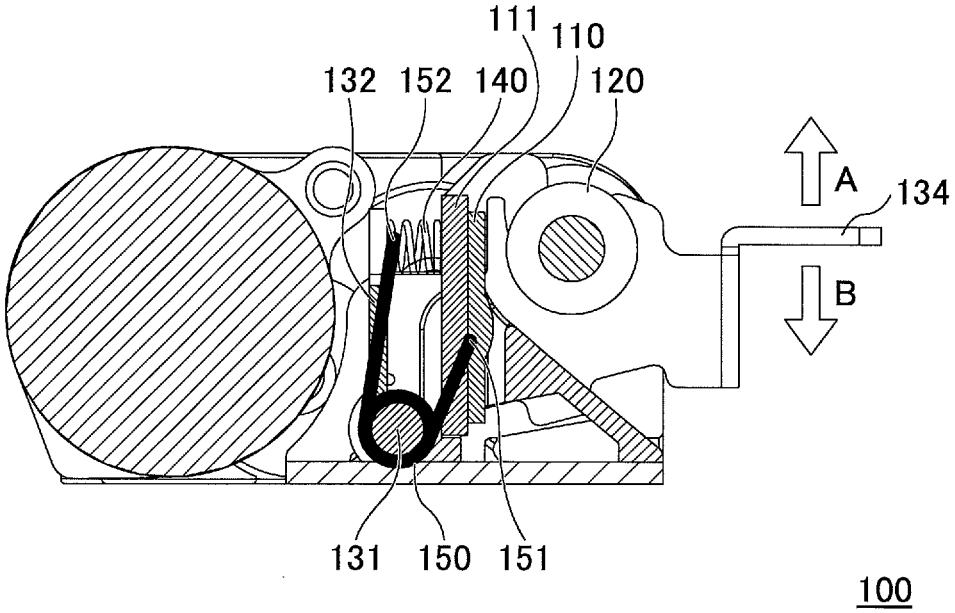
FIG. 16 is a drawing illustrating a second bias spring of an embodiment.

The second bias spring 150 may be implemented by, for example, a torsion coil spring (torsion spring) wound around the arm rotation shaft 131 of the open-close arm 130 (see FIG. 16).

As illustrated by FIGS. 7, 9, and 11, the second bias spring 150 is attached to one of the frame side parts 161 of the frame 160 such that the second bias spring 150 presses the open-close arm back part 132 of the open-close arm 130 in a direction away from the thermal head 110. More specifically, a first end 151 of the second bias spring 150 is connected to the frame side part 161, and a second end 152 of the second bias spring 150 is in contact with a part of the open-close arm back part 132 of the open-close arm 130. The open-close arm back part 132 of the open-close arm 130 is biased by the restoring force of the second bias spring 150 in a direction away from the thermal head 110. The configuration of the second bias spring 150 is described in more detail later.

Figure 13:
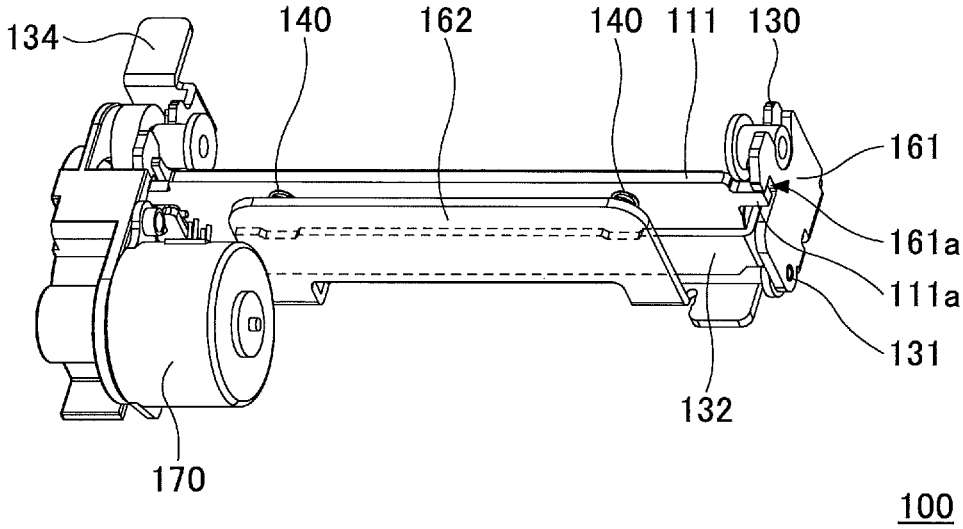
FIG. 13 is a drawing illustrating an open-close arm of an embodiment.
Figure 14:
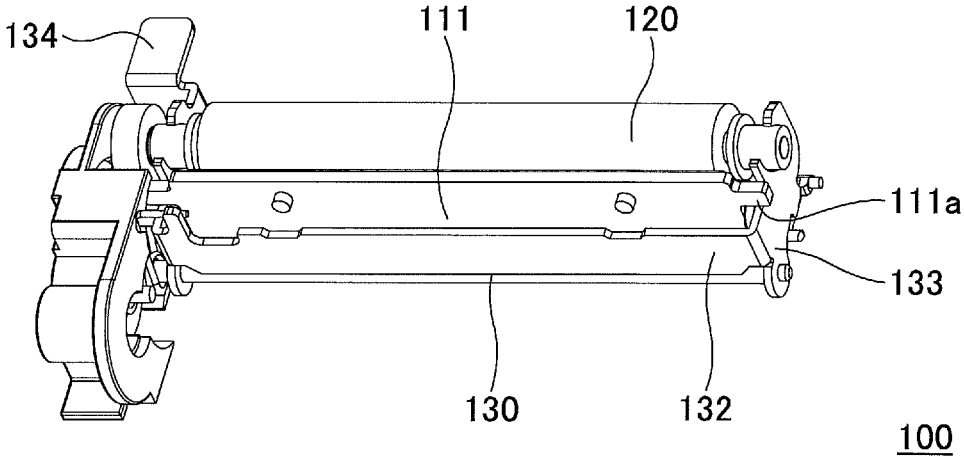
FIG. 14 is a drawing illustrating an open-close arm of an embodiment.
Figure 15:
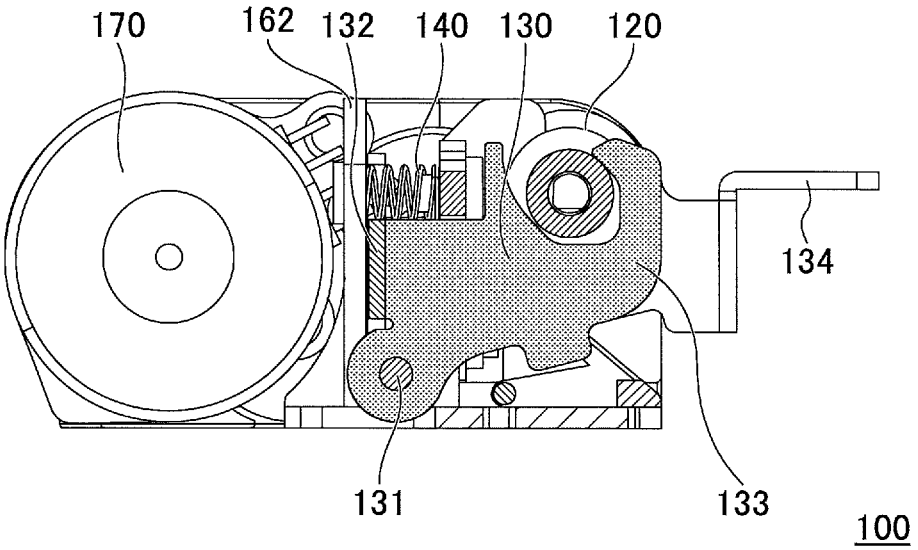
FIG. 15 is a drawing illustrating an open-close arm of an embodiment.

FIG. 13 is a perspective view of the printer 100 used to describe the open-close arm back part 132. FIG. 14 is a drawing obtained by removing the motor 170 and the frame 160 from FIG. 13. FIG. 15 is a side view of the printer 100.

The open-close arm side parts 133 are disposed at the corresponding ends of the platen roller 120.

As illustrated by FIGS. 13 through 15, the open-close arm 130 is formed by connecting the open-close arm side parts 133 with the open-close arm back part 132, and has a shape like a square bracket. The open-close arm back part 132 is substantially parallel to a direction in which the platen roller 120 extends and to a direction in which the thermal head 110 (not shown in FIGS. 13 and 14) extends. The open-close arm side parts 133 may include openings in which the thermal head 110 or support parts for supporting the thermal head 110 are placed.

The open-close arm operation part 134 is used to perform an operation for rotating the open-close arm 130 around the arm rotation shaft 131. When the open-close arm operation part 134 is pressed, the open-close arm operation part 134 rotates around the arm rotation shaft 131 and the open-close arm 130 rotates relative to the frame 160.

In the printer 100 of the present embodiment, as illustrated by FIGS. 8, 10, 13, and 14, protrusions 111*a* are formed at the ends of the heat sink 111. An opening 161*a* is formed in each of the frame side parts 161 of the frame 160.

The heat sink 111 is fixed to the frame 160 by inserting the protrusions 111*a* of the heat sink 111 into the openings 161*a* of the frame side parts 161 of the frame 160.

This configuration makes it possible to place the heat sink 111 and the thermal head 110 connected to the heat sink 111 in a desired position.

<Second Bias Spring>

Next, the second bias spring 150 is described.

In the present embodiment, the second bias spring 150 is in contact with the frame side part 161 of the frame 160 and the open-close arm 130. The second bias spring 150 biases the open-close arm 130 toward (the frame back part 162 of) the frame 160, and presses the platen roller 120 supported by the open-close arm 130 toward the thermal head 110.

Figure 17:
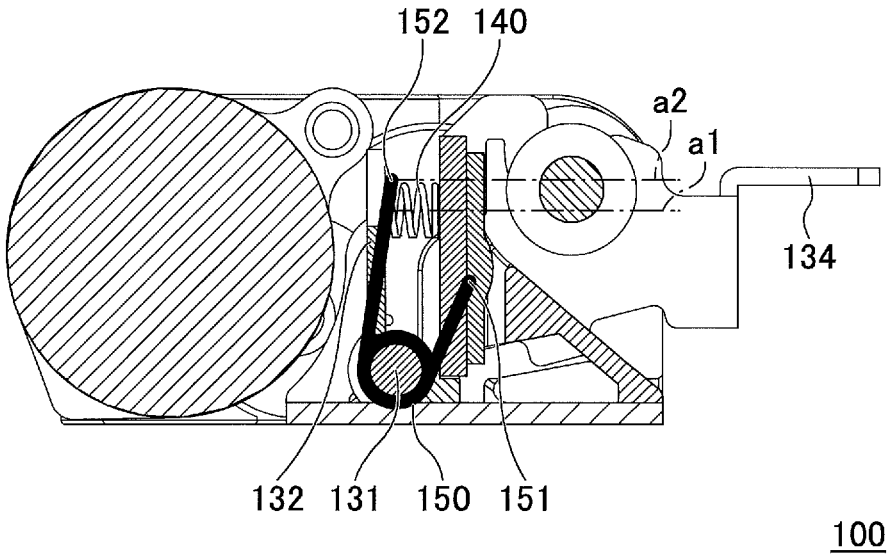
FIG. 17 is a drawing illustrating a second bias spring of an embodiment.

FIGS. 16 and 17 are drawings used to describe the second bias spring 150 of the present embodiment. In FIGS. 16 and 17, the open-close arm side part 133 and the frame side part 161 are omitted for descriptive purposes.

As illustrated by FIG. 16, the second bias spring 150 is implemented, for example, by a torsion coil spring (torsion spring), and includes the first end 151 and the second end 152. The second bias spring 150 is wound around the arm rotation shaft 131 such that the center of the second bias spring 150 is located substantially at the center of the arm rotation shaft 131. The first end 151 of the second bias spring 150 is connected to the frame side part 161 (not shown in FIG. 16). Thus, according to the present embodiment, the second bias spring 150 is fixed to the frame 160. On the other hand, the second end 152 of the second bias spring 150 is in contact with the open-close arm back part 132 of the open-close arm 130. The second bias spring 150 may have a configuration similar to the configuration of a second bias spring 150 of a second embodiment illustrated in FIGS. 47 through 49.

As described later, when the open-close arm operation part 134 is pressed in a direction indicated by an arrow B to, for example, detach the platen roller 120, the open-close arm 130 rotates around the arm rotation shaft 131 relative to the frame 160. On the other hand, because the second bias spring 150 is configured to bias the open-close arm 130 toward the frame 160, a force in a direction indicated by an arrow A is applied to the open-close arm 130 by the restoring force of the second bias spring 150. With this configuration, when the force being applied to the open-close arm 130 by pressing the open-close arm operation part 134 in the direction of the arrow B is removed, a force is applied in the direction of the arrow A by the restoring force of the second bias spring 150 and the open-close arm 130 returns to the home position.

FIG. 17 is a drawing illustrating a positional relationship among the arm rotation shaft 131, the first bias spring 140, and the second bias spring 150.

In FIG. 17, a dashed-dotted line a1 (horizontal line) indicates a position at which a force is applied to the frame back part 162 (not shown in FIG. 17, see FIG. 15) by the first bias spring 140 (i.e., a position at which the first bias spring 140 contacts the frame back part 162). Also, a dashed-dotted line a2 (horizontal line) indicates a position at which the second end 152 of the second bias spring 150 contacts the open-close arm back part 132. Here, the distance between the arm rotation shaft 131 and the dashed-dotted line a2 is greater than the distance between the arm rotation shaft 131 and the dashed-dotted line a1.

In the present embodiment, the second bias spring 150 is implemented by a torsion coil spring (torsion spring). Although the restoring force of a torsion coil spring is generally smaller than the restoring force of a compression coil spring (e.g., the first bias spring 140), the above configuration makes it possible to increase the torque.

<Open-Close Arm>

Next, the open-close arm 130 of the present embodiment is described.

FIGS. 19 and 21 through 31 illustrate a configuration of the open-close arm 130 of the present embodiment.

Figure 19:
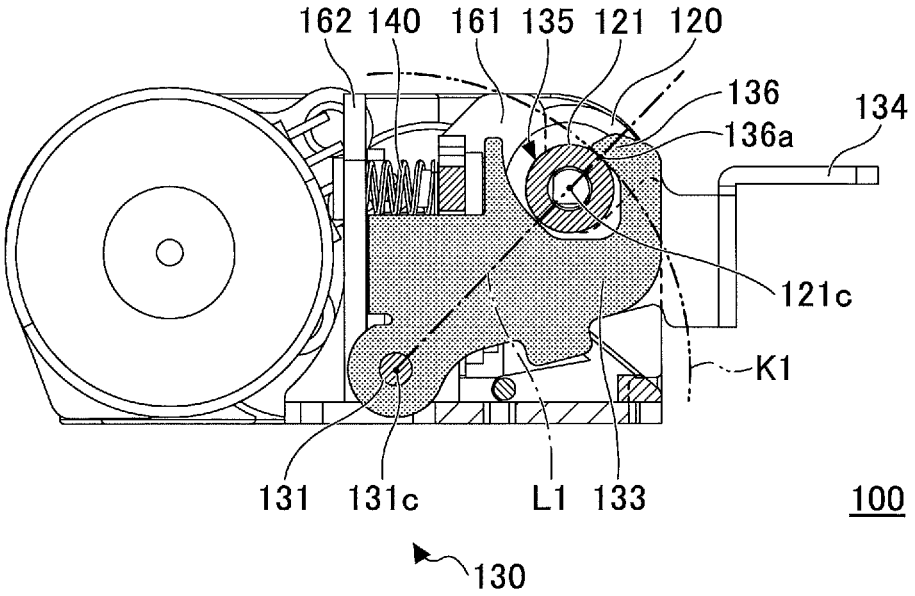
FIG. 19 is a drawing illustrating an open-close arm of an embodiment.

As illustrated by FIG. 19, the open-close arm 130 rotates around the center (131*c*) of the arm rotation shaft 131. The open-close arm side part 133 includes an open-close arm opening 135 in which the platen bearing 121 of the platen roller 120 is placed. The open-close arm side part 133 also includes a lock part 136 that forms a part of the edge of the open-close arm opening 135 and is farthest from the arm rotation shaft 131.

Figure 20:
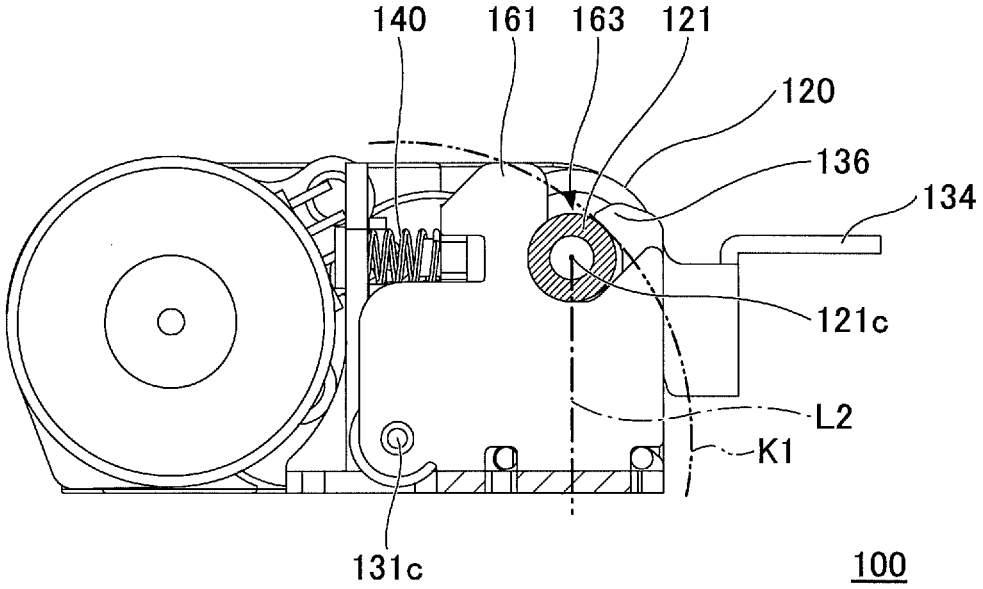
FIG. 20 is a drawing illustrating a frame of an embodiment.

FIG. 20 is a drawing illustrating a configuration of the frame 160 of the present embodiment.

As illustrated by FIG. 20, the frame side part 161 of the frame 160 includes a frame opening 163 in which the platen bearing 121 is placed. In the present embodiment, the platen bearing 121 of the platen roller 120 is rotatably supported by the frame side part 161 of the frame 161 and the open-close arm side part 133 of the open-close arm 130. More specifically, the platen bearing 121 of the platen roller 120 is in contact with an edge of the frame opening 163 of the frame side part 161. Also, the platen bearing 121 of the platen roller 120 is in contact with the lock part 136 forming the open-close arm opening 135 of the open-close arm side part 133. The lock part 136 holds the platen bearing 121 of the platen roller 120 to prevent the platen roller 120 from bouncing out of the frame 160 and the open-close arm 130 when the platen bearing 121 is rotated.

Figure 21:
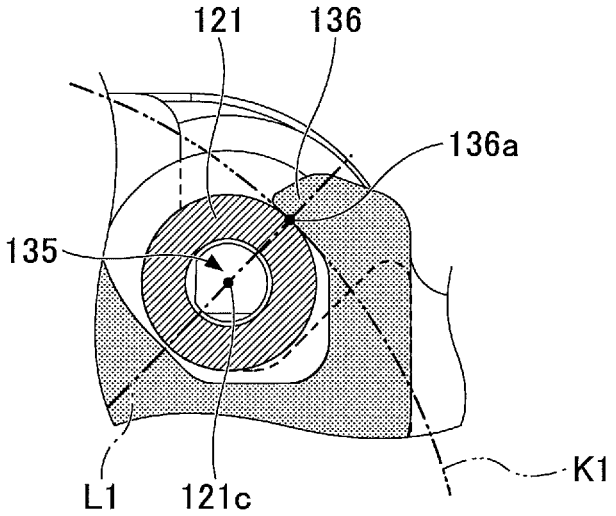
FIG. 21 is an enlarged view of a part of FIG. 19.

FIG. 21 is an enlarged view of a part of FIG. 19.

As illustrated by FIGS. 19 and 21, the platen bearing 121 is in contact with the lock part 136 forming the open-close arm opening 135 at a contact part 136*a* that is on an extension line L1 connecting the center 131*c* of the arm rotation shaft 131 and a center 121*c* of the platen bearing 121. The lock part 136 forming the open-close arm opening 135 is shaped such that the contact part 136*a* constitutes a part of an arc K1 around the center 131*c* of the arm rotation shaft 131.

In the present embodiment, as illustrated by FIG. 19, the lock part 136 extends into an area above the extension line L1 connecting the center 131*c* of the arm rotation shaft 131 and the center 121*c* of the platen bearing 121. In other words, the lock part 136 extends across the extension line L1 into a side where the first bias spring 140 is provided. This configuration makes it possible to more firmly hold the platen bearing 121.

Figure 22:
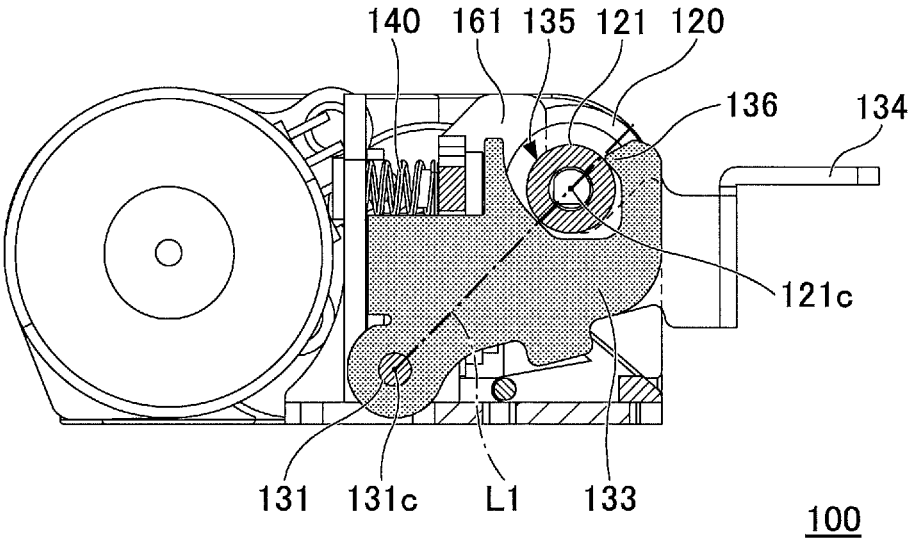
FIG. 22 is a drawing illustrating a variation of an open-close arm of an embodiment.

FIG. 22 is a drawing illustrating a variation of the open-close arm 130 of the present embodiment.

As illustrated by FIG. 22, the lock part 136 may be disposed below the extension line L1 connecting the center 131*c* of the arm rotation shaft 131 and the center 121*c* of the platen bearing 121. That is, the lock part 136 may be formed such that the lock part 136 does not extend across the extension line L1 into a side where the first bias spring 140 is provided.

Figure 23:
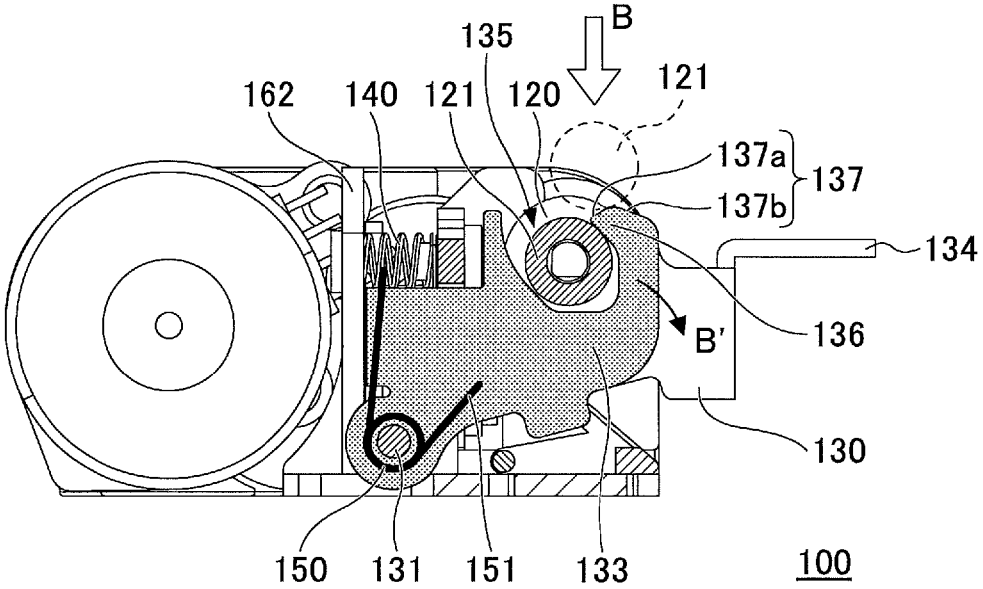
FIG. 23 is a drawing illustrating an open-close arm of an embodiment.
Figure 24:
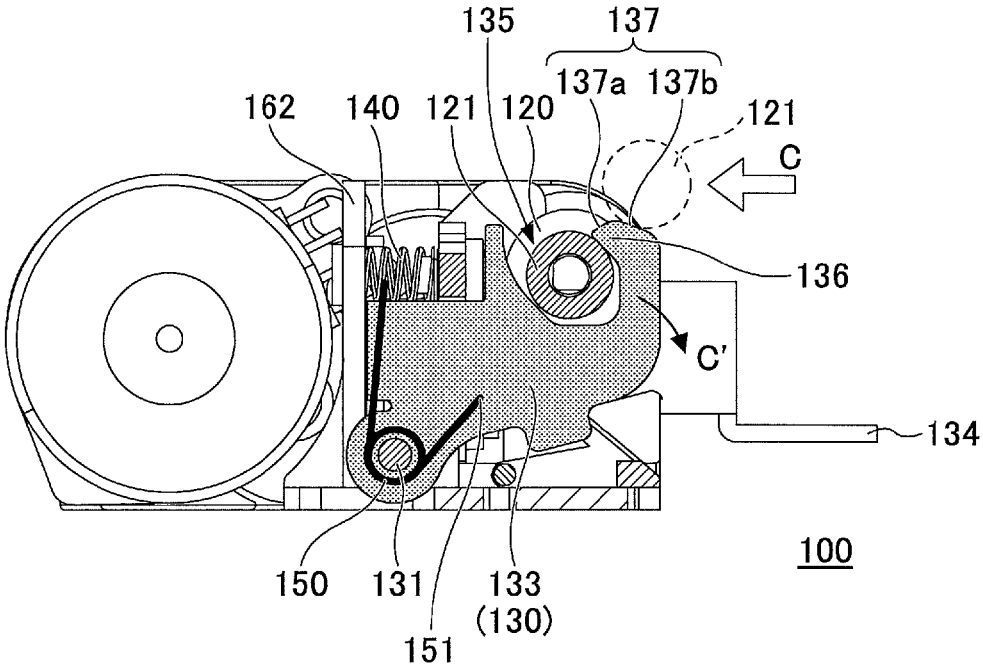
FIG. 24 is a drawing illustrating an open-close arm of an embodiment.

FIGS. 23 and 24 are drawings used to describe operations to cause the open-close arm 130 to hold the platen roller 120.

As illustrated by FIGS. 23 and 24, an outer contact part 137 is formed at the outer edge of the lock part 136 of the open-close arm 130. The outer contact part 137 contacts the platen bearing 121 when the platen bearing 121 is placed in the open-close arm opening 135. The outer contact part 137 includes a first outer contact part 137*a* and a second outer contact part 137*b*.

As illustrated by FIG. 23, when the platen roller 120 is placed into the open-close arm opening 135 in a direction (indicated by an arrow B) that is substantially perpendicular to the direction in which the force of the first bias spring 140 acts, the platen bearing 121 contacts the first outer contact part 137*a*.

In this case, the platen roller 120 can be placed into the open-close arm opening 135 by rotating the open-close arm 130 in a direction of an arrow B' around the arm rotation shaft 131. In the cut-away side view of FIG. 23, the first outer contact part 137*a* is sloped such that the first outer contact part 137*a* forms an acute angle with a surface in the open-close arm opening 135 that the platen bearing 121 contacts when the platen bearing 121 is placed in the open-close arm opening 135.

As illustrated by FIG. 24, when the platen roller 120 is placed into the open-close arm opening 135 in a direction (indicated by an arrow C) that is substantially parallel to the direction in which the force of the first bias spring 140 acts, the platen bearing 121 contacts the second outer contact part 137*b*. In this case, the platen roller 120 can be placed into the open-close arm opening 135 by rotating the open-close arm 130 in a direction of an arrow C' around the arm rotation shaft 131. In the cut-away side view of FIG. 24, the second outer contact part 137*b* is sloped such that the second outer contact part 137*b* forms an acute angle with the first contact part 137*a*. Also, the slope of the second outer contact part 137*b* forms an acute angle with the horizontal direction. With this configuration, when the platen roller 120 is brought into contact with the second outer contact part 137*b*, the platen roller 120 presses the open-close arm 130 downward. In this case, the open-close arm operation part 134 may be disposed at a lower position as illustrated in FIG. 24 so as not to obstruct the entry path of the platen roller 120.

Figure 27:
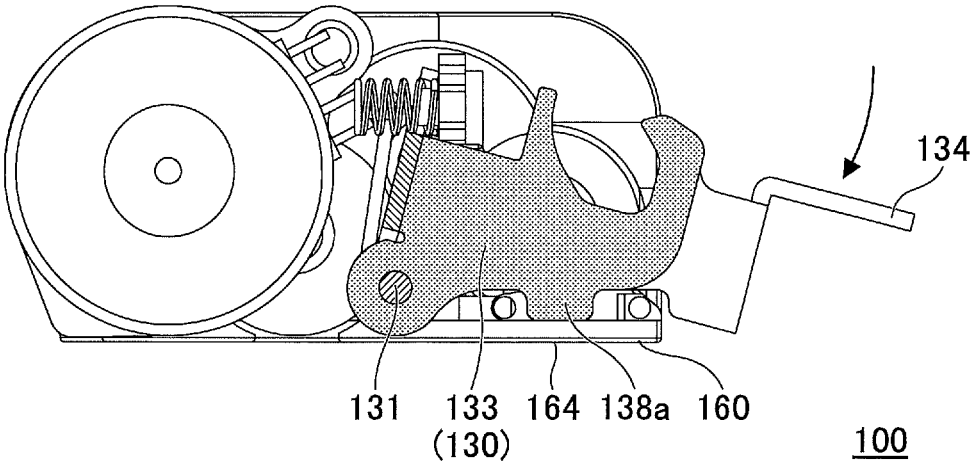
FIG. 27 is a drawing illustrating an open-close arm of an embodiment.

As illustrated by FIG. 27, the open-close arm side part 133 of the open-close arm 130 also includes a protrusion 138*a*. When the open-close arm operation part 134 is pressed in a direction of an arrow to rotate the open-close arm 130 around the arm rotation shaft 131, the protrusion 138*a* stops the rotation at a predetermined position. More specifically, when the open-close arm 130 is rotated around the arm rotation shaft 131, the protrusion 138*a* contacts a frame bottom part 164 of the frame 160 and stops the rotation of the open-close arm 130. This configuration makes it possible to prevent the open-close arm 130 from being rotated more than necessary.

Figure 28:
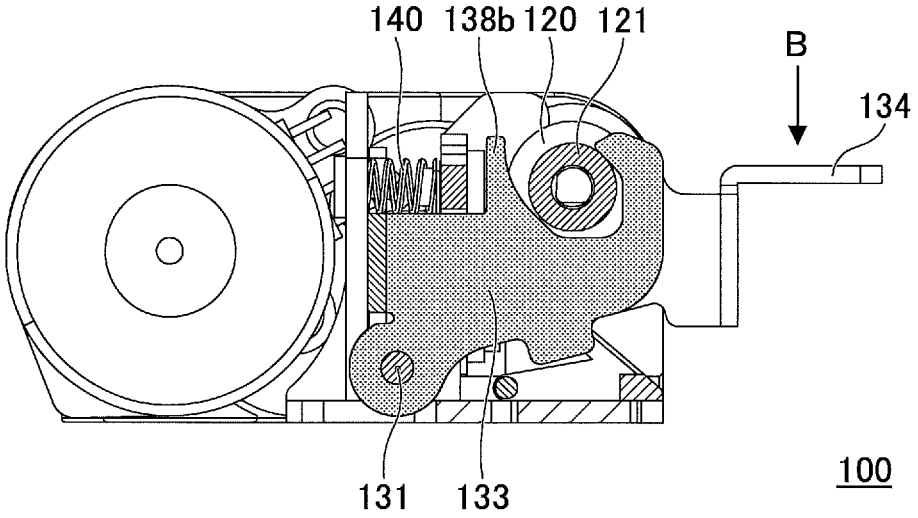
FIG. 28 is a drawing illustrating an open-close arm of an embodiment.
Figure 29:
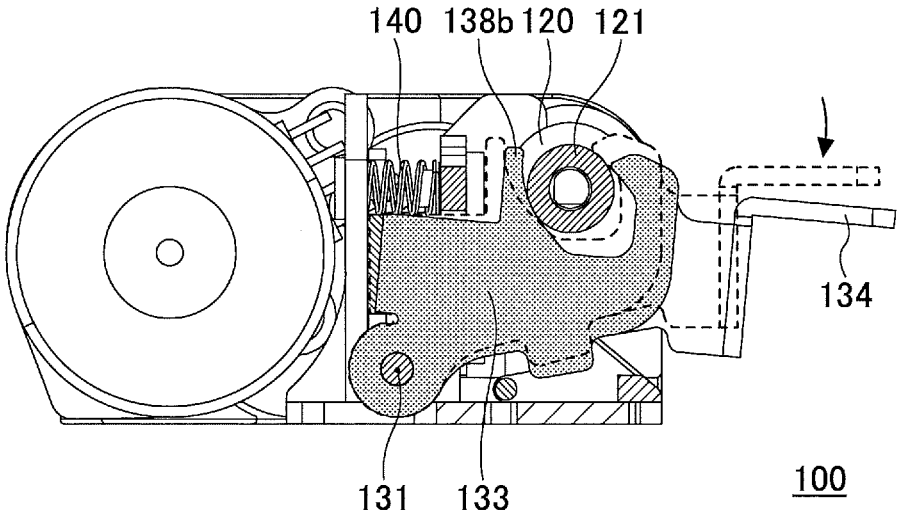
FIG. 29 is a drawing illustrating an open-close arm of an embodiment.

FIGS. 28 and 29 are drawings used to describe operations to detach the platen roller 120 from the open-close arm 130 and the frame 160.

Figure 30:
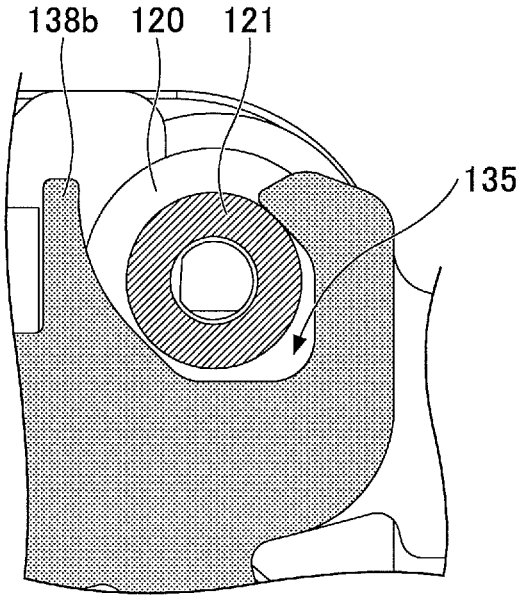
FIG. 30 is an enlarged view of a part of FIG. 28.
Figure 31:
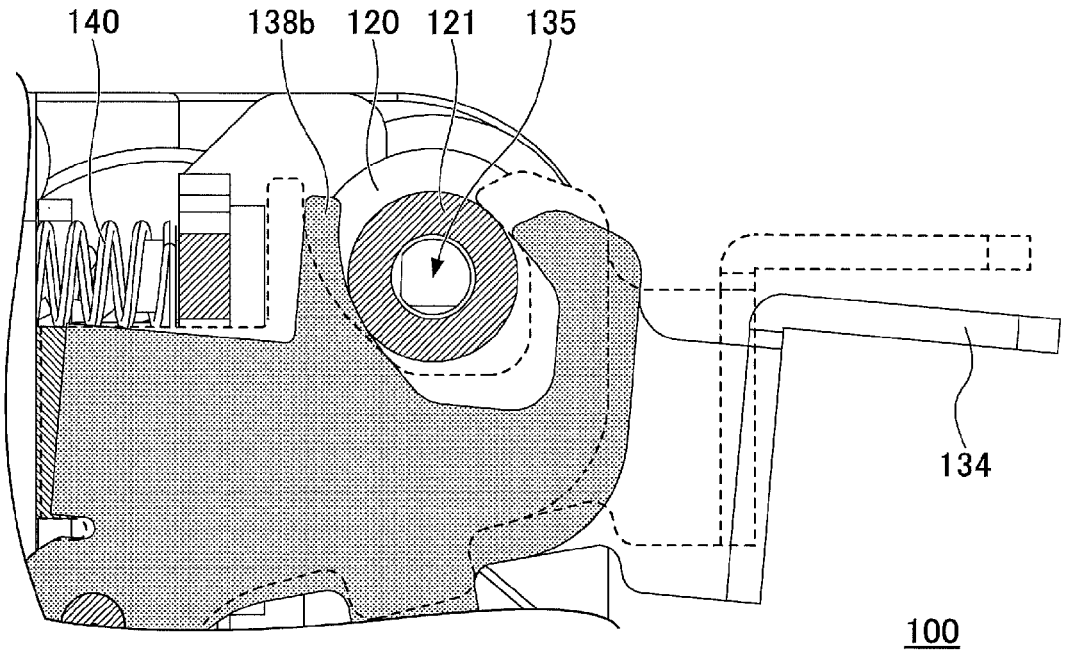
FIG. 31 is an enlarged view of a part of FIG. 29.

In FIG. 28, the open-close arm operation part 134 has not been pressed. In FIG. 29, the open-close arm operation part 134 is being pressed. FIG. 30 is an enlarged view of a part of FIG. 28, and FIG. 31 is an enlarged view of a part of FIG. 29. In FIG. 29, a dotted line indicates the open-close arm 130 in a state illustrated in FIG. 28. In FIG. 31, a dotted line indicates the open-close arm 130 in a state illustrated in FIG. 30.

Also, as illustrated in FIGS. 28 and 29, the open-close arm side part 133 of the open-close arm 130 includes a platen detaching part 138*b*. The platen detaching part 138*b* is disposed between the thermal head 110 and the platen bearing 121 of the platen roller 120. When the open-close arm operation part 134 is pressed in a direction of an arrow B to rotate the open-close arm 130 around the arm rotation shaft 131 relative to the frame 160, the platen detaching part 138*b* moves the platen bearing 121 away from the thermal head 110 so that the platen bearing 121 can be smoothly taken out from the open-close arm opening 135 and the frame opening 163.

More specifically, when the open-close arm operation part 134 is pressed, the platen detaching part 138*b* contacts the platen bearing 121 and pushes the platen bearing 121 away from the thermal head 110 (rightward in FIG. 29). As a result, the platen bearing 121 is ejected from the open-close arm opening 135 and the frame opening 163 along the platen detaching part 138*b*. This configuration makes it possible to easily detach the platen roller 120 from the printer 100.

<Frame>

Next, the frame 160 of the present embodiment is described.

FIGS. 32 through 41 illustrate a configuration of the frame 160 of the present embodiment. The frame 160 is described below with reference to FIGS. 32 through 41 as well as FIG. 20.

Figure 32:
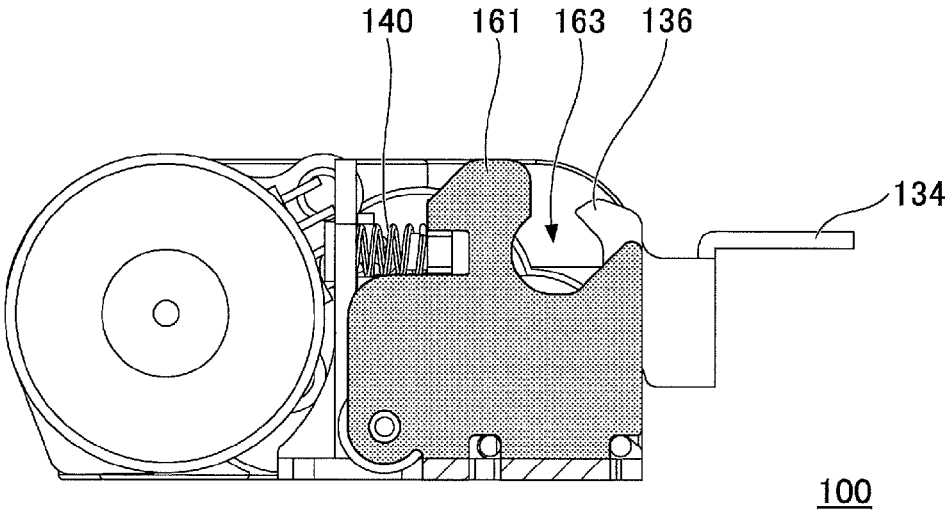
FIG. 32 is a drawing illustrating a frame of an embodiment.

In the printer 100 of the present embodiment, as illustrated by FIG. 32, the frame side part 161 includes the frame opening 163 in which the platen bearing 121 is placed.

First, the shape of the frame opening 163 is described with reference to FIG. 20. In FIG. 20, L2 indicates a line that is perpendicular to a direction (rightward direction in FIG. 20) in which the force of the first bias spring 140 acts and that passes through the center 121*c* of the platen bearing 121. On a first side (left side in FIG. 20) of the line L2 where the first bias spring 140 (or the thermal head 110) is provided, the frame opening 163 has a diameter that is substantially the same as the external diameter of the platen bearing 121.

Figure 34:
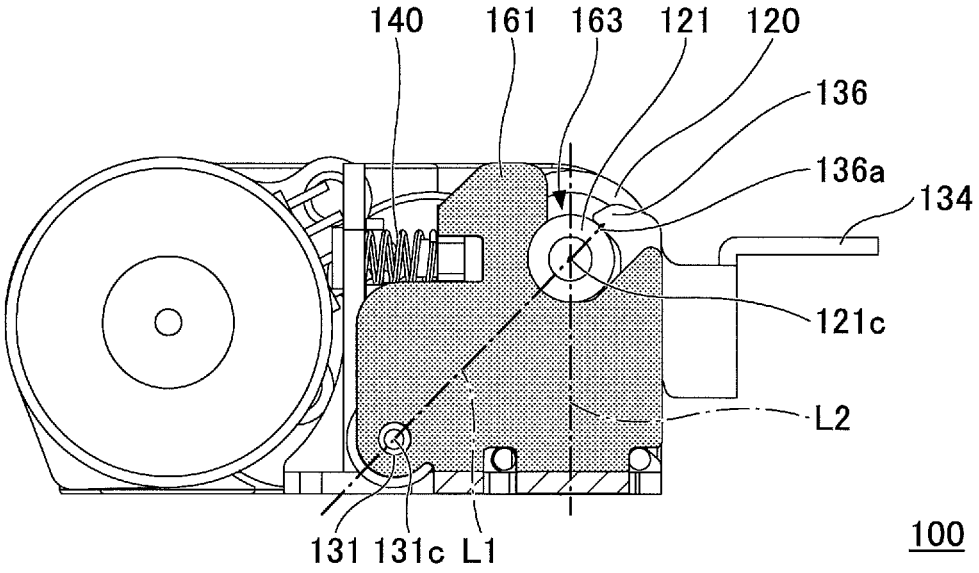
FIG. 34 is a drawing used to describe a relationship among a platen bearing, an open-close arm, and a frame according to an embodiment.
Figure 35:
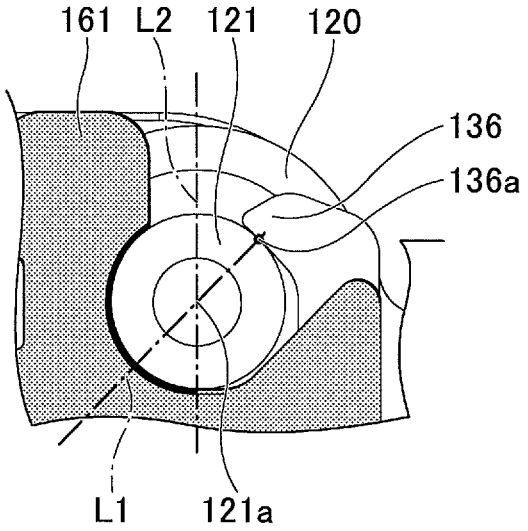
FIG. 35 is an enlarged view of a part of FIG. 34.

With this configuration, as illustrated by FIGS. 34 and 35, the platen bearing 121 is in contact with the edge of the frame opening 163 of the frame side part 161 of the frame 160, on the first side of the line L2 where the first bias spring 140 is provided. On the other hand, on a second side that is across the line L2 from the first side where the first bias spring 140 is provided, the platen bearing 121 is in contact with the contact part 136*a* of the lock part 136 of the open-close arm side part 133 of the open-close arm 130, instead of the frame 160. The contact part 136*a* is basically a point.

Figure 38:
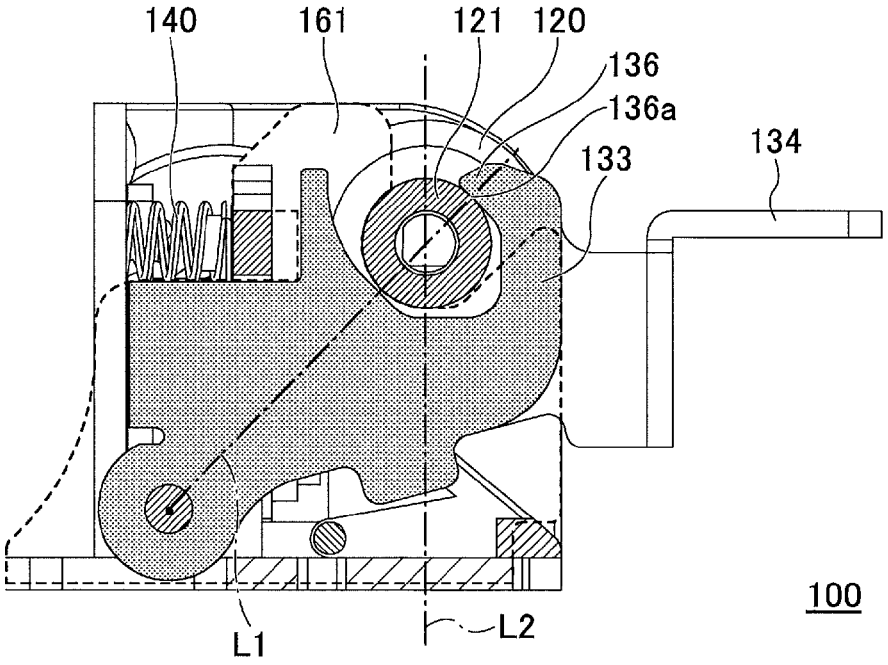
FIG. 38 is a drawing used to describe a relationship among a platen bearing, an open-close arm, and a frame according to an embodiment.

FIG. 38 is a drawing used to describe a positional relationship between the frame side part 161 of the frame 160 and the open-close arm side part 133 of the open-close arm 130.

According to the printer 100 of the present embodiment, as illustrated by FIG. 38, on the first side of the line L2 where the first bias spring 140 is provided, the frame side part 161 of the frame 160 is closer to the platen bearing 121 than the open-close arm side part 133 of the open-close arm 130. That is, on the first side of the line L2 where the first bias spring 140 is provided, the platen bearing 121 is in contact with the frame side part 161 of the frame 160. On the other hand, on the second side that is across the line L2 from the first side where the first bias spring 140 is provided, the platen bearing 121 is in contact with the contact part 136*a* of the lock part 136 of the open-close arm 130.

Figure 39:
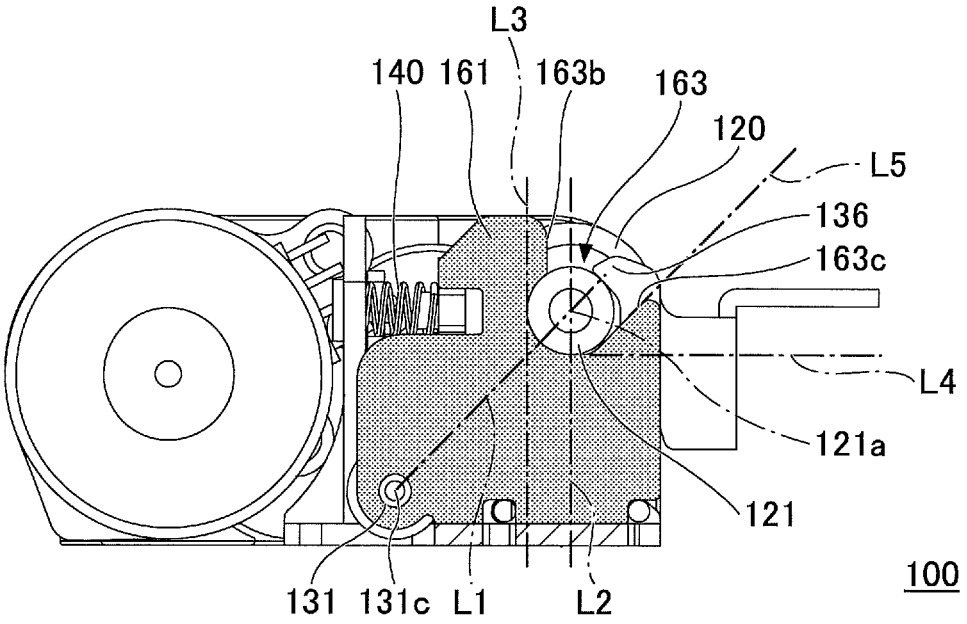
FIG. 39 is a drawing illustrating a frame.

FIG. 39 is a drawing used to describe the shape of the frame opening 163 of the frame 160.

As illustrated by FIG. 39, the frame opening 163 of the frame 160 includes an upper opening edge 163*b* (an example of a first opening edge) on a side where the first bias spring 140 is provided, and a lower opening edge 163*c* (an example of a second opening edge) on an opposite side that is across the platen bearing 121 from the side where the first bias spring 140 is provided. The upper opening edge 163*b* is disposed between the line L2 and a line L3 that is substantially parallel to the line L2 and touches the platen bearing 121 on the side where the first bias spring 140 is provided. The upper opening edge 163*b* may protrude over the platen bearing 121. In the present embodiment, the upper opening edge 163*b* may extend substantially parallel to the line L2 as illustrated by FIG. 39.

The lower opening edge 163*c* is disposed between a line L4 and a line L5. The line L4 is substantially parallel to a direction in which the force of the first bias spring 140 acts, and touches the platen bearing 121. The line L5 is parallel to the extension line L1 connecting the center 131*c* of the arm rotation shaft 131 and the center 121*c* of the platen bearing 121, and touches the platen bearing 121 on a side where the arm rotation shaft 131 is provided.

Figure 40:
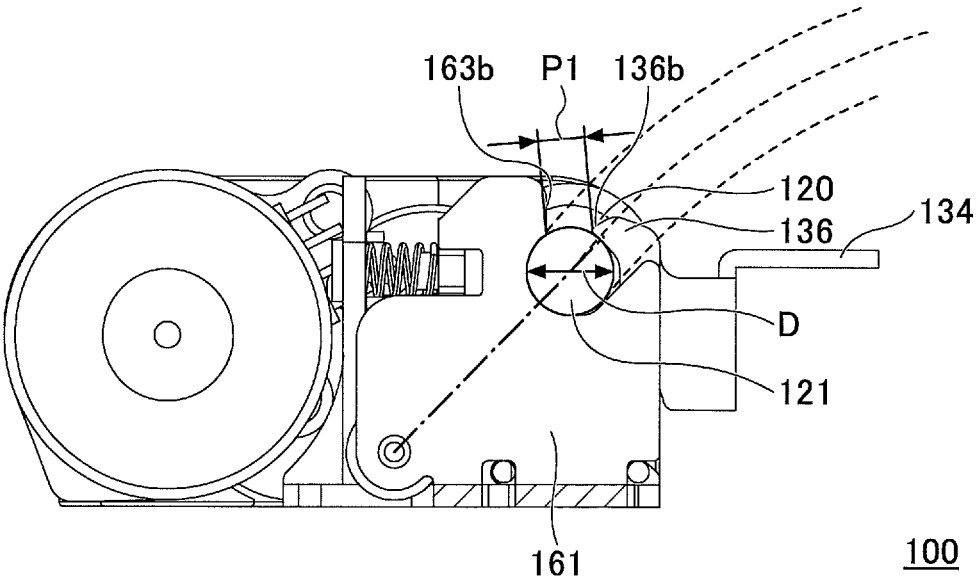
FIG. 40 is a drawing used to describe a method of detaching a platen.
Figure 41:
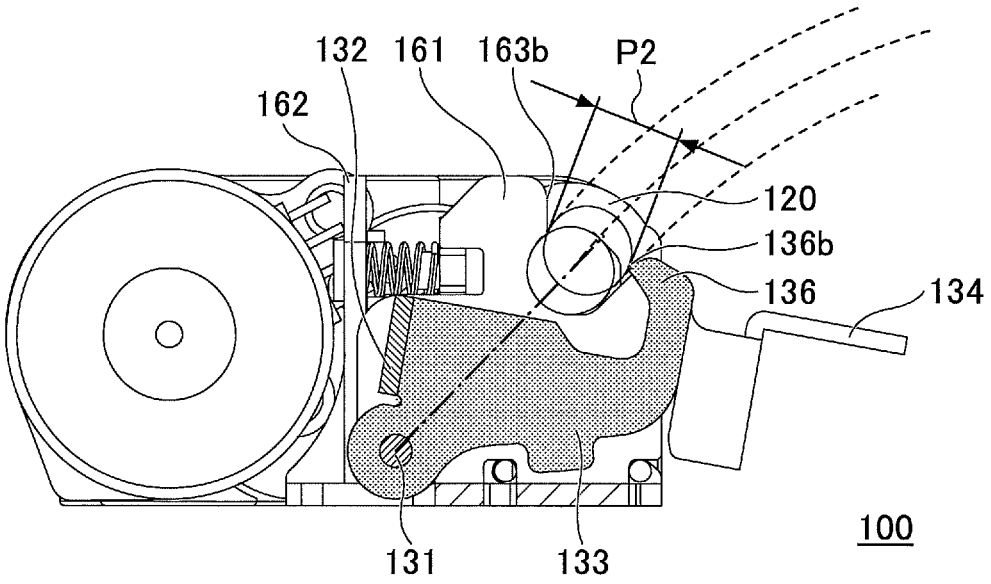
FIG. 41 is a drawing used to describe a method of detaching a platen.

FIGS. 40 and 41 are drawings used to describe a positional relationship between the frame opening 163 of the frame 160 and the open-close arm opening 135 of the open-close arm 130.

In FIG. 40, the platen roller 120 is supported by the open-close arm side part 133 of the open-close arm 130 and the frame side part 161 of the frame 160. In the state of FIG. 40, a distance P1 between the upper opening edge 163*b* of the frame side part 161 of the frame 160 and a tip 136*b* of the lock part 136 of the open-close arm 130 is less than a diameter D of the platen bearing 121 (P1<D). With this configuration, the platen bearing 121 is supported by the frame 160 and the open-close arm 130.

FIG. 41 illustrates a state where the open-close arm operation part 134 is pressed downward. In this state, a distance P2 between the upper opening edge 163*b* of the frame side part 161 of the frame 160 and the tip 136*b* of the lock part 136 of the open-close arm 130 becomes greater than the diameter D of the platen bearing 121 so that the platen roller 120 can be detached. In FIG. 41, for descriptive purposes, some components (such as the platen detaching part 138*b*) of the open-close arm side part 133 of the open-close arm 130 are omitted. In FIGS. 40 and 41, dotted lines indicate a path of the platen bearing 121 being detached.

Next, a variation of the present embodiment is described.

Figure 18:
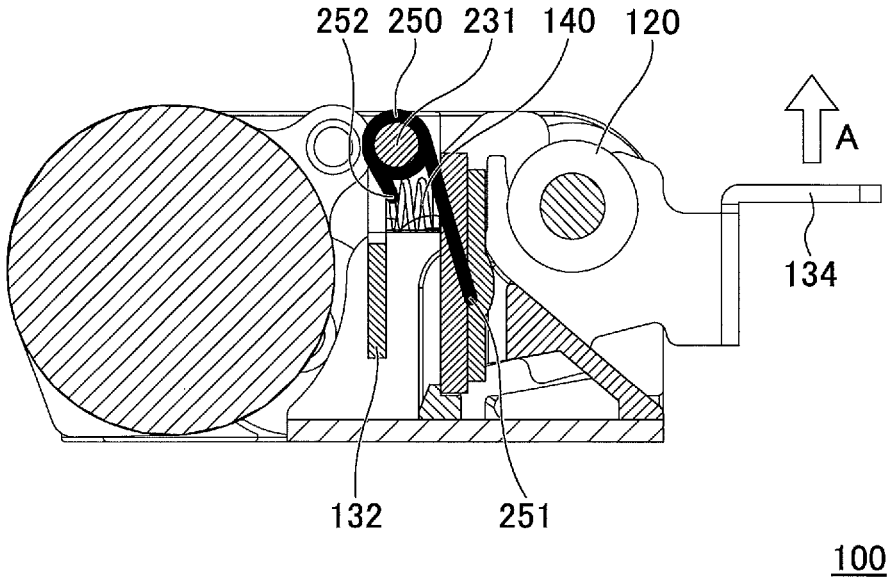
FIG. 18 is a drawing illustrating a variation of a second bias spring of an embodiment.

FIG. 18 is a drawing illustrating a second bias spring 250 according to a variation of the present embodiment. In FIG. 18, the open-close arm 130 is disposed in a different position, and the second bias spring 250 has a configuration different from the configuration of the second bias spring 150 described with reference to FIGS. 16 and 17.

In this variation, as illustrated by FIG. 18, an arm rotation shaft 231 of the open-close arm 130 is provided in an upper part (in FIG. 18) of the open-close arm side part 133 of the open-close arm 130. The second bias spring 250 is wound around the arm rotation shaft 231 such that the center of the second bias spring 250 is located substantially at the center of the arm rotation shaft 231. A first end 251 of the second bias spring 250 is connected to the frame side part 161 (not shown in FIG. 18), and a second end 252 of the second bias spring 250 is in contact with the open-close arm back part 132 of the open-close arm 130.

Figure 25:
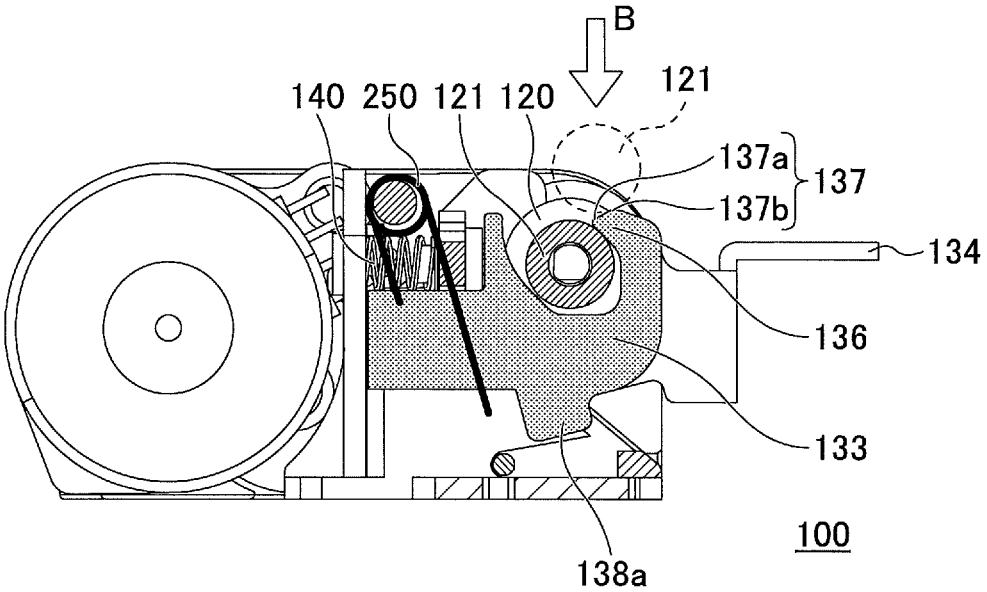
FIG. 25 is a drawing illustrating an open-close arm of an embodiment.
Figure 26:
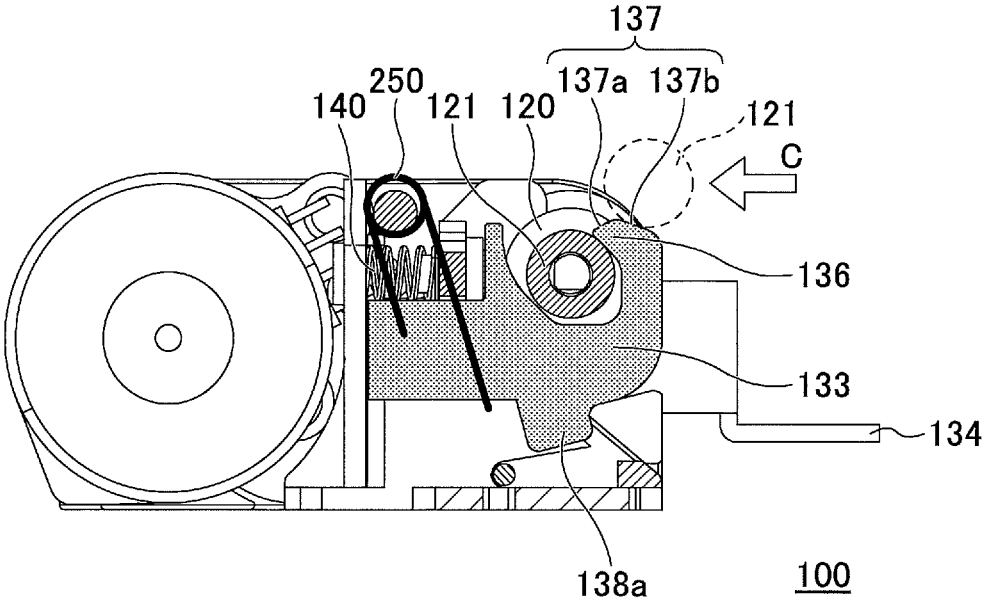
FIG. 26 is a drawing illustrating an open-close arm of an embodiment.

FIGS. 25 and 26 are drawings used to describe operations to cause the open-close arm 130 to hold the platen roller 120 in the case of the printer 100 of FIG. 18. The operations to cause the open-close arm 130 to hold the platen roller 120 are similar to the operations described with reference to FIGS. 23 and 24. FIG. 25 illustrates a case where the platen roller 120 is placed into the open-close arm opening 135 in a direction (indicated by an arrow B) that is substantially perpendicular to the direction in which the force of the first bias spring 140 acts. FIG. 26 illustrates a case where the platen roller 120 is placed into the open-close arm opening 135 in a direction (indicated by an arrow C) that is substantially parallel to the direction in which the force of the first bias spring 140 acts.

Figure 33:
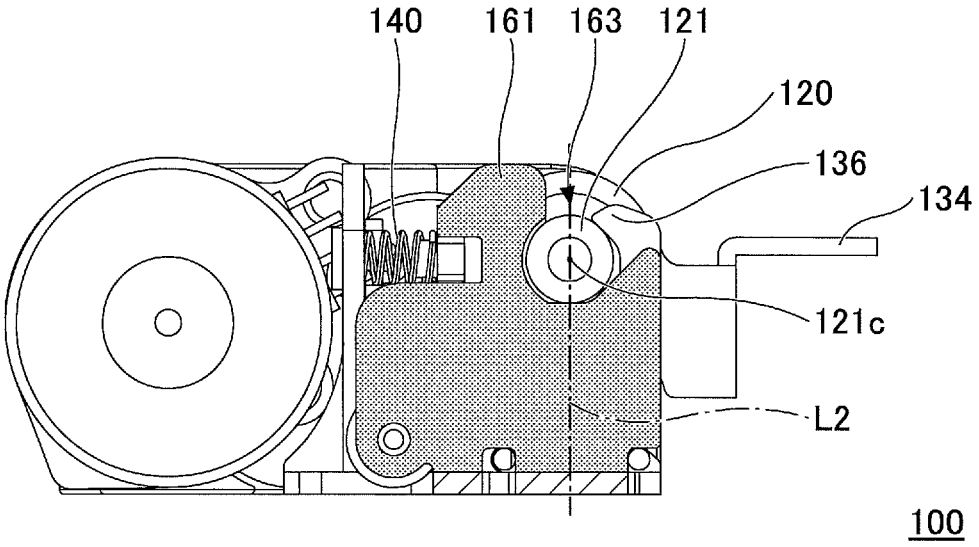
FIG. 33 is a drawing illustrating a variation of a frame of an embodiment.

FIG. 33 is a drawing illustrating a variation of the frame 160 of the present embodiment.

As illustrated by FIG. 33, the frame opening 163 may be formed to have a diameter that is slightly greater than the external diameter of the platen bearing 121.

Figure 36:
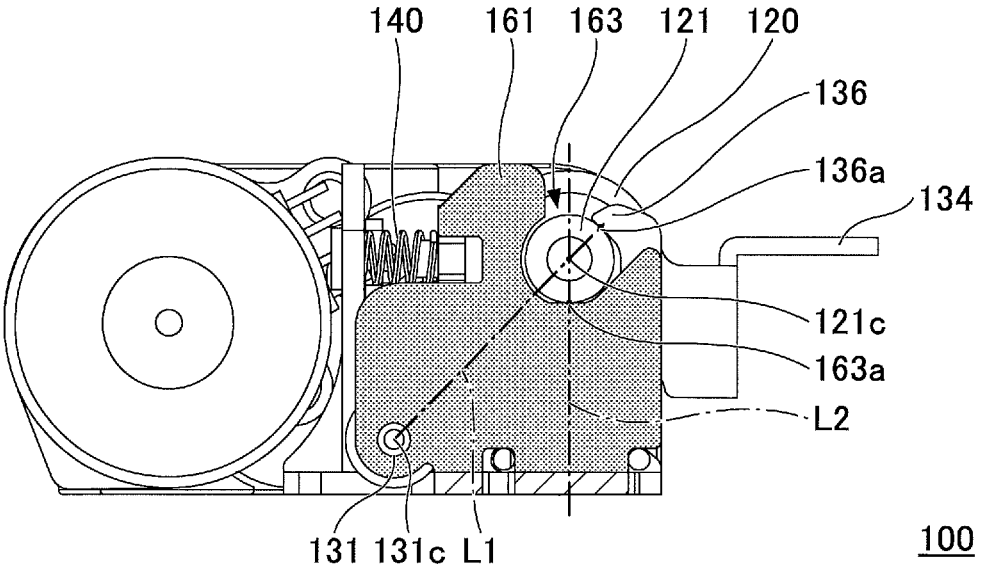
FIG. 36 is a drawing used to describe a relationship among a platen bearing, an open-close arm, and a frame according to an embodiment.
Figure 37:
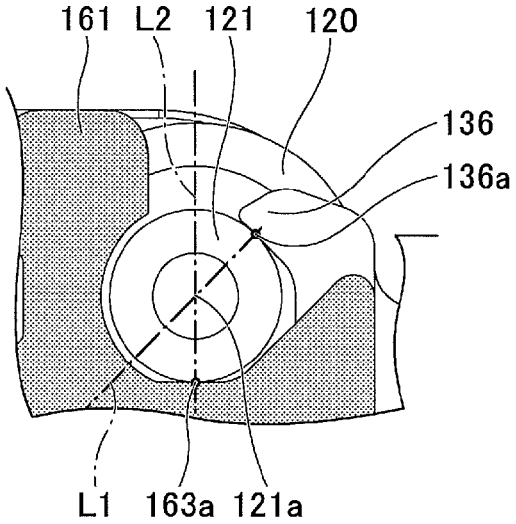
FIG. 37 is an enlarged view of a part of FIG. 36.

In this case, as illustrated by FIGS. 36 and 37, the platen bearing 121 is in contact with the frame side part 161 of the frame 160 at a contact point 163*a* near an intersection between the line L2 and an edge of the frame opening 163. Also, on a side that is opposite to the side where the first bias spring 140 is provided, the platen bearing 121 is in contact with the lock part 136 of the open-close arm side part 133 of the open-close arm 130 at the contact part 136*a* that is on the extension line L1 connecting the center 131*c* of the arm rotation shaft 131 and the center 121*c* of the platen bearing 121.

<Position Detection Sensor of Open-Close Arm>

Figure 42:
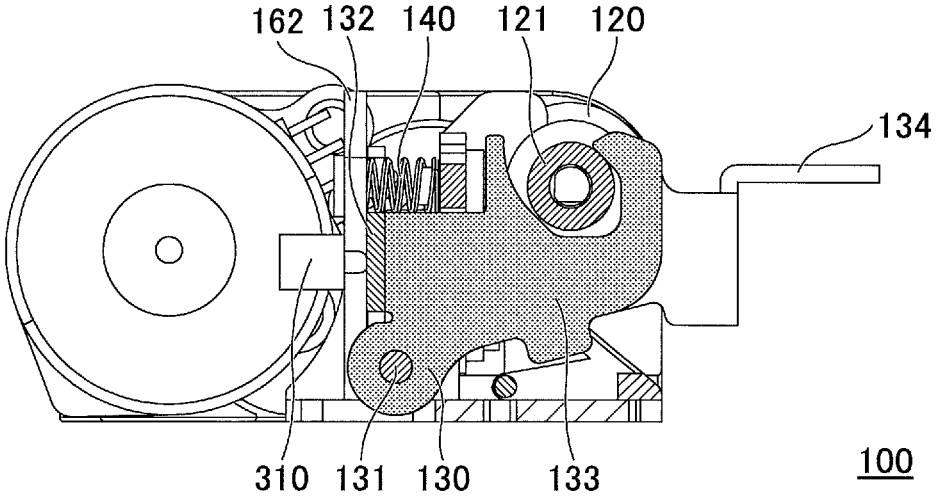
FIG. 42 is a drawing illustrating a switch of an open-close arm.
Figure 43:
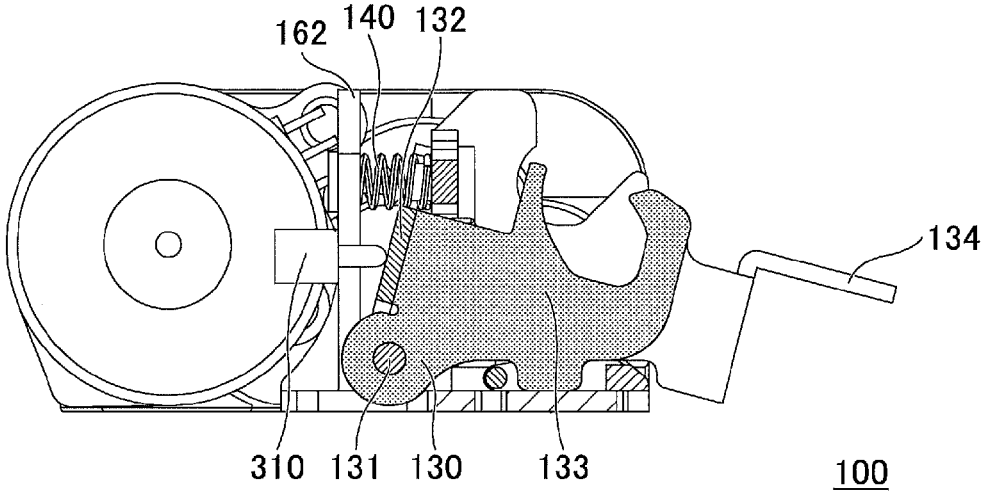
FIG. 43 is a drawing illustrating a switch of an open-close arm.

As illustrated by FIGS. 42 and 43, the printer 100 of the present embodiment may also include a sensor 310 for detecting the position of the open-close arm 130.

FIG. 42 illustrates a state where the platen roller 120 is held by the open-close arm 130 and the frame 160. In this state, the open-close arm back part 132 of the open-close arm 130 is substantially in contact with the frame back part 162 of the frame 160. The sensor 310 may be configured to detect a state where the open-close arm back part 132 of the open-close arm 130 is in contact with the frame back part 162 of the frame 160. In the example of FIG. 42, the sensor 310 is pressed and turned on by the open-close arm back part 132 of the open-close arm 130.

The printer 100 may also include a recording paper detection sensor (not shown) for detecting the presence of recording paper. In the state of FIG. 42, when the presence of recording paper is detected by the recording paper detection sensor, the printer 100 is controlled to normally print information on the recording paper. On the other hand, when no recording paper is detected by the recording paper detection sensor, the printer 100 is controlled to not perform print operations.

FIG. 43 illustrates a state where the open-close arm operation part 134 is pressed downward and the platen roller 120 is detached. In this state, the open-close arm back part 132 of the open-close arm 130 is away from the sensor 310 and the sensor 310 is turned off. In this state, the printer 100 is controlled to not perform print operations.

Although not illustrated in FIG. 43, the printer 100 may include a control unit that controls print operations based on outputs from the sensor 310 and the recording paper detection sensor.

<Recording Paper Guide>

Figure 44:
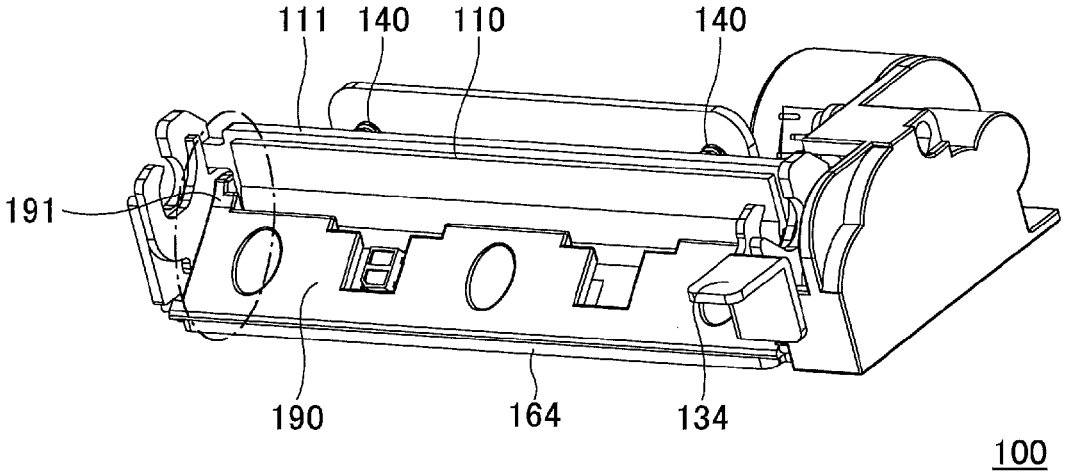
FIG. 44 is a drawing illustrating a recording paper guide.
Figure 45:
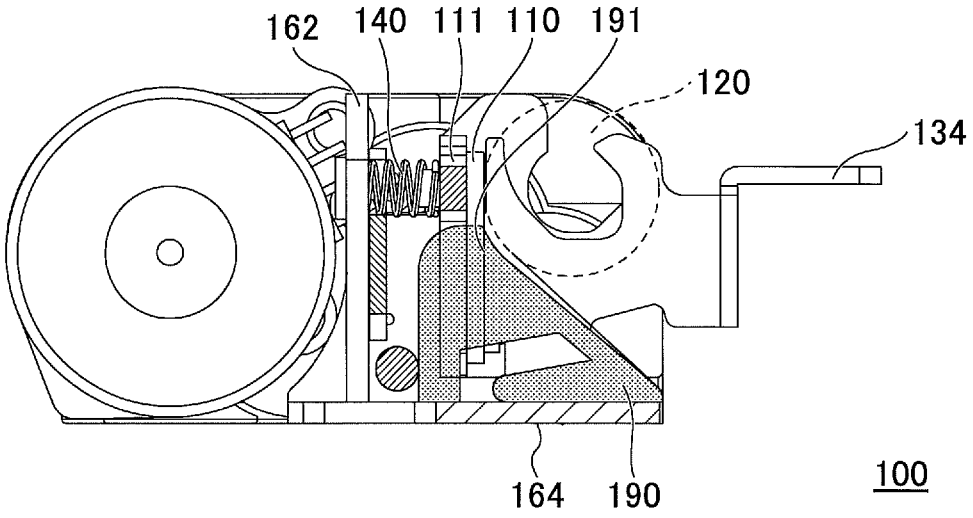
FIG. 45 is a drawing illustrating a recording paper guide.

As illustrated by FIGS. 44 and 45, the printer 100 of the present embodiment may include a recording paper guide 190 on the frame bottom part 164. Guide parts 191 extending toward the thermal head 110 are provided at the ends of the recording paper guide 190. The guide parts 191 are positioned on the corresponding sides of recording paper (not shown). The guide parts 191 make it possible to smoothly feed recording paper (not shown) toward the thermal head 110.

Figure 46:
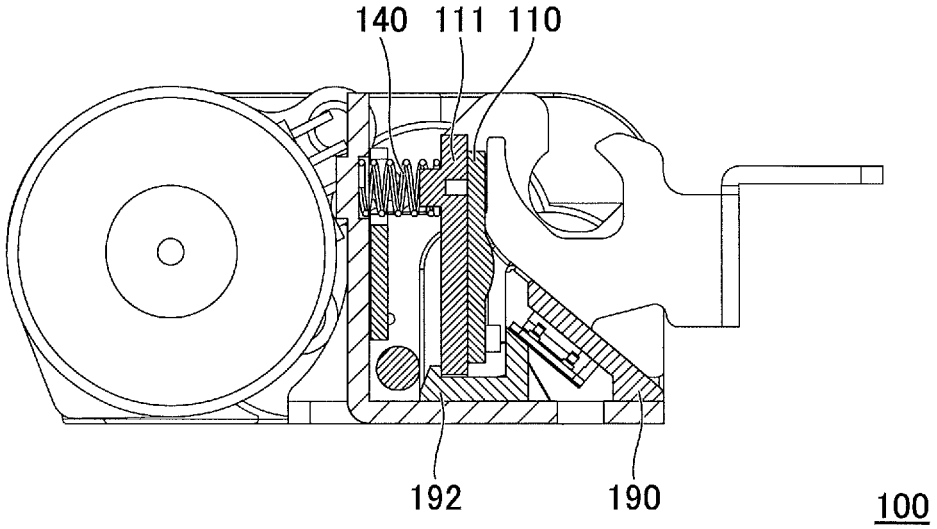
FIG. 46 is a drawing illustrating a recording paper guide.

As illustrated by FIG. 46, the recording paper guide 190 may include a support part 192 for supporting the thermal head 110 or the heat sink 111.

The printer 100 of the present embodiment is configured such that strong stress is not applied to a thermal head when attaching or detaching a platen roller. This configuration makes it possible to increase the durability, life, and reliability of the printer 100.

In the printer 100 of the present embodiment, the first bias spring(s) 140 is disposed between the frame back part 162 of the frame 160 and the thermal head 110, and the thermal head 110 is biased by the first bias spring 140 toward the platen roller 120 relative to the frame back part 162. With this configuration, even when the open-close arm 130 is rotated to attach or detach the platen roller 120, the first spring 140 is not influenced by the open-close arm 130 and is barely expanded or contracted.

The printer 100 of the present embodiment includes the second bias spring 150 that biases the open-close arm 130 toward the frame back part 162 of the frame 160. Also in the present embodiment, the platen bearing 121 of the platen roller 120 is supported by the open-close arm opening 135 of the open-close arm 130 and the frame opening 163 of the frame 160, and the platen roller 120 is biased by the restoring force of the second bias spring 150 toward the thermal head 110. This configuration makes it possible to stably maintain a contact between the thermal head 110 and the platen roller 120.

Also in the present embodiment, when attaching or detaching the platen roller 120, the open-close arm 130 is rotated to move the platen roller 120 away from the thermal head 110 against the restoring force of the second bias spring 150.

With this configuration, strong stress is not applied to the thermal head 110 when attaching or detaching the platen roller 120. Accordingly, this configuration makes it possible to prevent the thermal head 110 from being deformed or damaged, and makes it possible to provide a highly-reliable printer with a long life.

The configuration of the present embodiment also makes it possible to reliably hold the platen roller 120 in the open-close arm opening 135 of the open-close arm 130 and the frame opening 163 of the frame 160.

Further, with the second bias spring 150, the open-close arm 130 can be returned to the home position by the restoring force of the second bias spring 150 after being rotated relative to the frame 160.

Second Embodiment

<Printer>

A printer according to a second embodiment is described below.

FIGS. 47 through 51 illustrate a configuration of a printer 100A of the present embodiment.

The printer 100A of the second embodiment has a configuration similar to the configuration of the printer 100 of the first embodiment described with reference to FIGS. 3 through 14. The lateral orientation of the printer 100A in FIGS. 47 through 51 is opposite to that of the printer 100 in FIGS. 3 through 14.

<Operations of Open-Close Arm>

Operations of the open-close arm 130 of the printer 100A of the present embodiment when attaching or detaching the platen roller 120 is described below.

Figure 47:
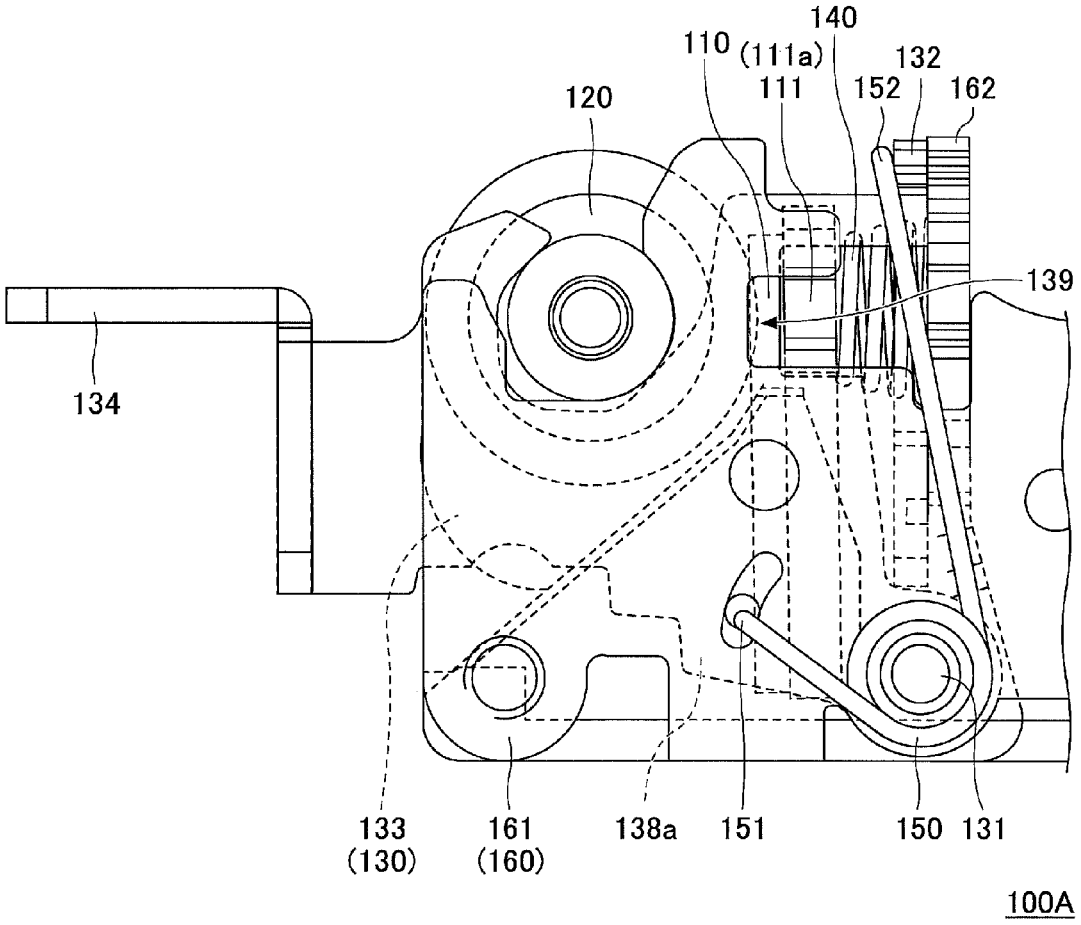
FIG. 47 is a drawing used to describe operations of an open-close arm of a printer of an embodiment.
Figure 48:
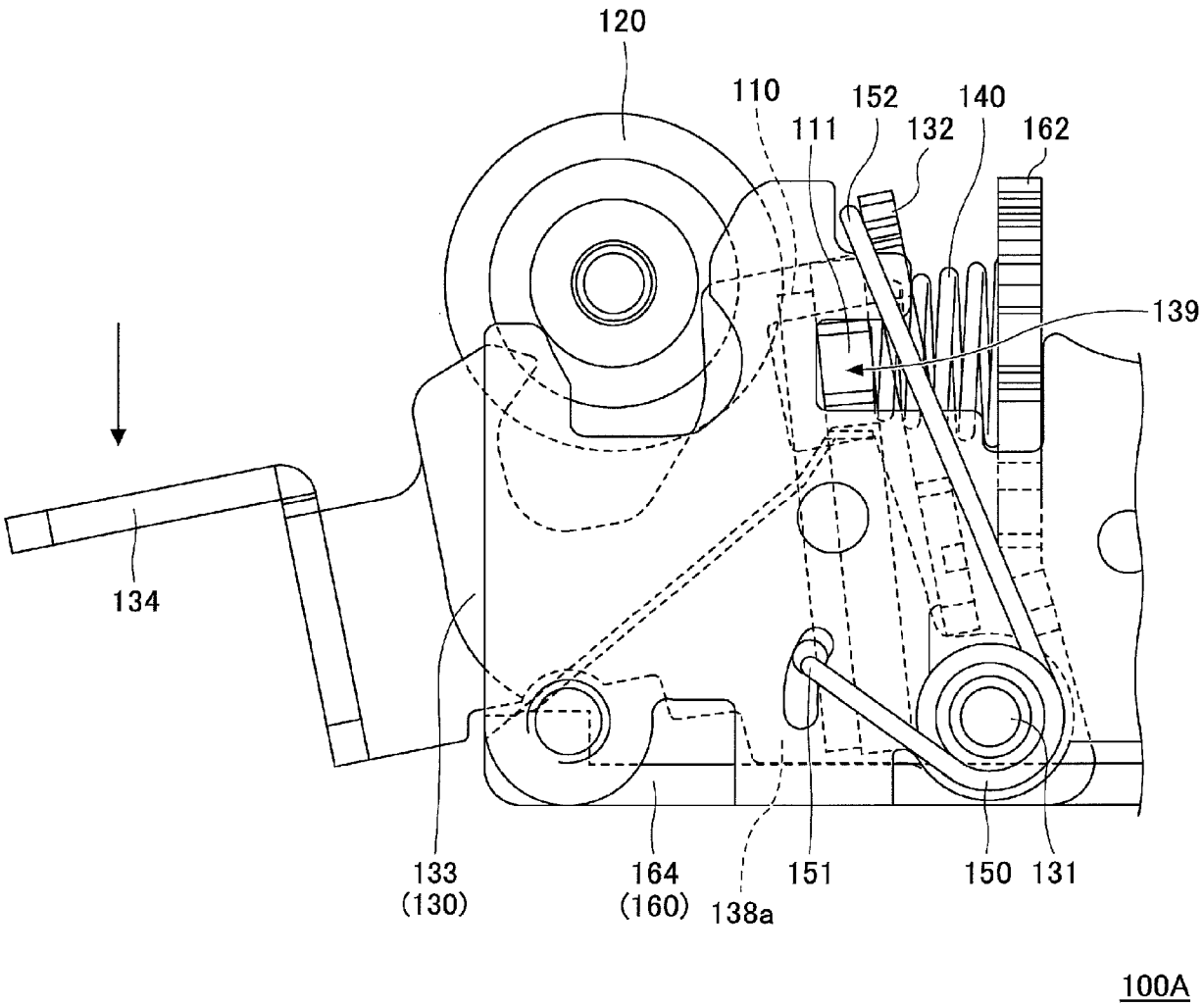
FIG. 48 is a drawing used to describe operations of an open-close arm of a printer of an embodiment.
Figure 49:
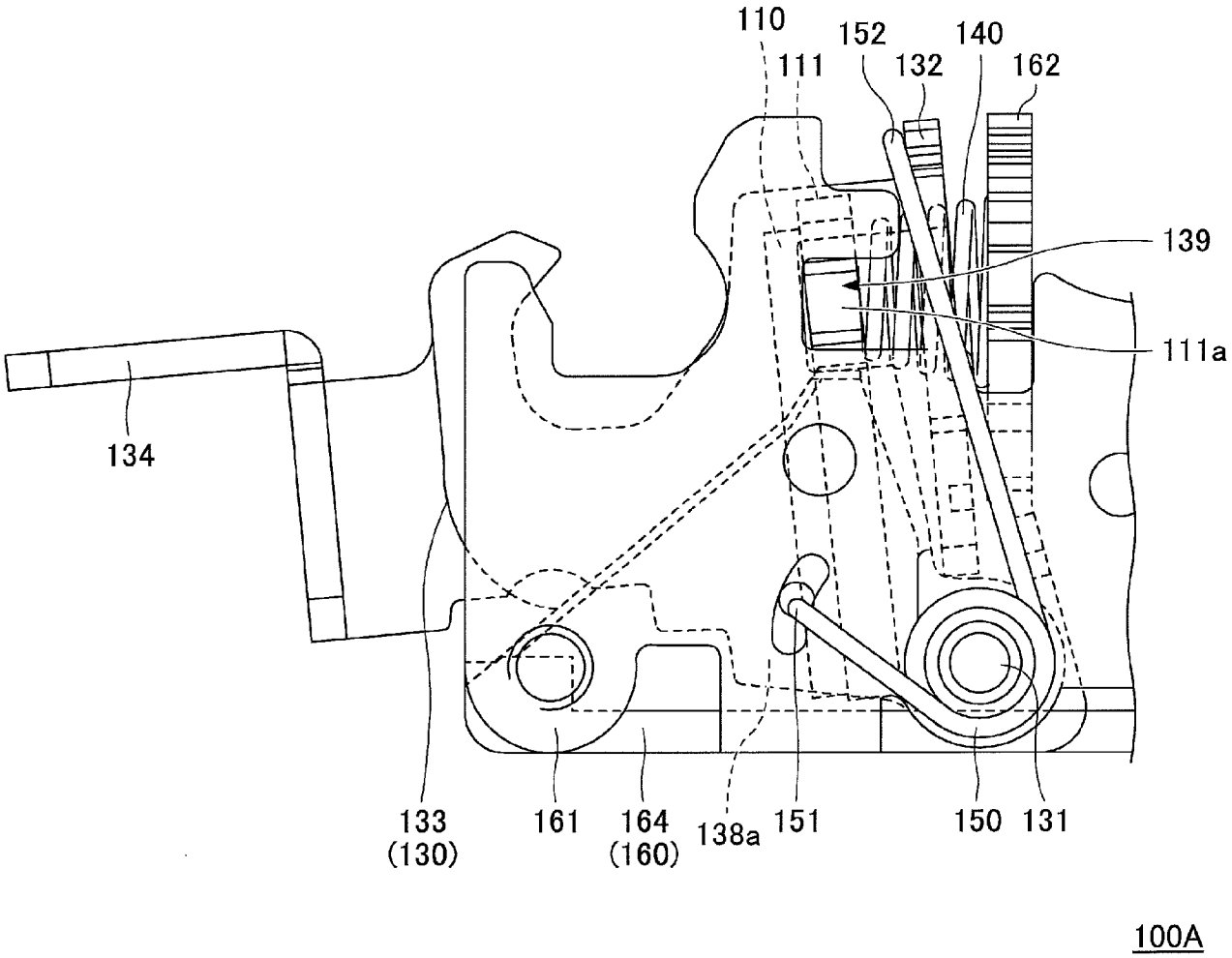
FIG. 49 is a drawing used to describe operations of an open-close arm of a printer of an embodiment.

FIGS. 47 through 49 are drawings used to describe a positional relationship between the open-close arm 130 and the frame 160 of the printer 100A.

FIG. 47 illustrates a state (first state) where the platen roller 120 is in the printer 100A. FIG. 48 illustrates a state (second state) where the open-close arm 130 is rotated relative to the frame 160 to the maximum extent to detach the platen roller 120. FIG. 49 illustrates a neutral state (third state) after the platen roller 120 is detached.

The printer 100A of the present embodiment is configured such that the positional relationship between the frame 160 and the open-close arm 130 is in one of the first state, the second state, and the third state illustrated by FIGS. 47 through 49.

In the first state of FIG. 47 where the platen roller 120 is in the printer 100A, the thermal head 110 is pressed toward the platen roller 120 via the heat sink 111 by the first bias spring 140 that is disposed between the heat sink 111 and the frame back part 162. In the first state where the platen roller 120 is in a predetermined position, the platen roller 120 presses the thermal head 110 and applies a force via the heat sink 111 on the back of the thermal head 111 to the first bias spring 140 in a direction to contract the first bias spring 140. In this state, information can be printed on recording paper (not shown) placed between the thermal head 110 and the platen roller 120. Also in this state, the frame back part 162 and the open-close arm back part 132 are substantially in contact with each other.

In the present embodiment, a protrusion 111*a* may be formed at each end of the heat sink 111. Also, each of the open-close arm side parts 133 of the open-close arm 130 includes an opening 139 in which the protrusion 111*a* at the corresponding end of the heat sink 111 is placed. In the first state illustrated by FIG. 47, an edge of the opening 139 of the open-close arm side part 133 is not engaged with the protrusion 111*a* of the heat sink 111, and there is a space between the protrusion 111*a* of the heat sink 111 and the open-close arm side part 133 in the opening 139 of the open-close arm side part 133.

In the second state of FIG. 48, the open-close arm 130 is rotated relative to the frame 160 to the maximum extent to detach the platen roller 120. When the open-close arm operation part 134 is pressed downward by an external force, e.g., by a human hand, the open-close arm 130 rotates around the arm rotation shaft 131 relative to the frame 160, and it becomes possible to detach the platen roller 120.

Similarly to the first embodiment, the second bias spring 150 may be implemented by, for example, a torsion coil spring (torsion spring) wound around the arm rotation shaft 131 of the open-close arm 130.

In the second state, the open-close arm 130 is biased by the restoring force of the second bias spring 150 toward the frame back part 162 of the frame 160. However, because the open-close arm operation part 134 is being pressed against the restoring force of the second bias spring 150, the open-close arm back part 132 of the open-close arm 130 moves away from the frame back part 162 of the frame 160. Also, along with the movement of the open-close arm 130, the platen roller 120 moves away from the thermal head 110 and the heat sink 111. Accordingly, the thermal head 110 and the heat sink 111 are pressed by the restoring force of the first bias spring(s) 140 toward the platen roller 120. However, because the first bias spring 140 is disposed between the frame 160 and the heat sink 111, the first bias spring 140 barely expands or contracts even when the open-close arm 130 moves.

Also in the second state, the protrusion 138*a* of the open-close arm 130 contacts the frame bottom part 164 of the frame 160, and the open-close arm 130 stops at a predetermined position.

In the third state of FIG. 49, the platen roller 120 has been detached and no force is being applied to the open-close arm operation part 134.

In this state, the heat sink 111 is pressed by the restoring force of the first bias spring 140 toward a position where the platen roller 120 was located. Also, because no force is being applied to the open-close arm operation part 134, the open-close arm 130 is biased by the restoring force of the second bias spring 150 toward the home position (the position indicated in FIG. 47) where the open-close arm 130 is located when the platen roller 120 is attached. In the third state, the edge of the opening 139 (first engaging part) of the open-close arm side part 133 engages (contacts) the protrusion 111*a* (second engaging part), and the heat sink 111 and the open-close arm 130 press each other. As a result, the third state is maintained. The third state occurs during the transition of the open-close arm 130 from the second state to the first state, and is a state where the restoring force of the first bias spring 140 and the restoring force of the second bias spring 150 are balanced. In the present embodiment, the third state is referred to as a "neutral state".

In the present embodiment, when the platen roller 120 is not attached and no force is being applied to the open-close arm operation part 134, the open-close arm 130 is always in the neutral state illustrated by FIG. 49.

Also in the present embodiment, whether to perform printing on recording paper (not shown) can be easily determined by detecting the position of the open-close arm 130 relative to the frame 160 in each state. When it is detected that the open-close arm 130 is in the first state illustrated by FIG. 47 and recording paper (not shown) exists, printing is performed on the recording paper. When it is detected that the open-close arm 130 is in one of the second and third states illustrated by FIGS. 48 and 49, printing on the recording paper is not performed.

<Method of Attaching Platen Roller>

Next, a method of attaching the platen roller 120 to the printer 100A of the present embodiment is described.

Figure 50:
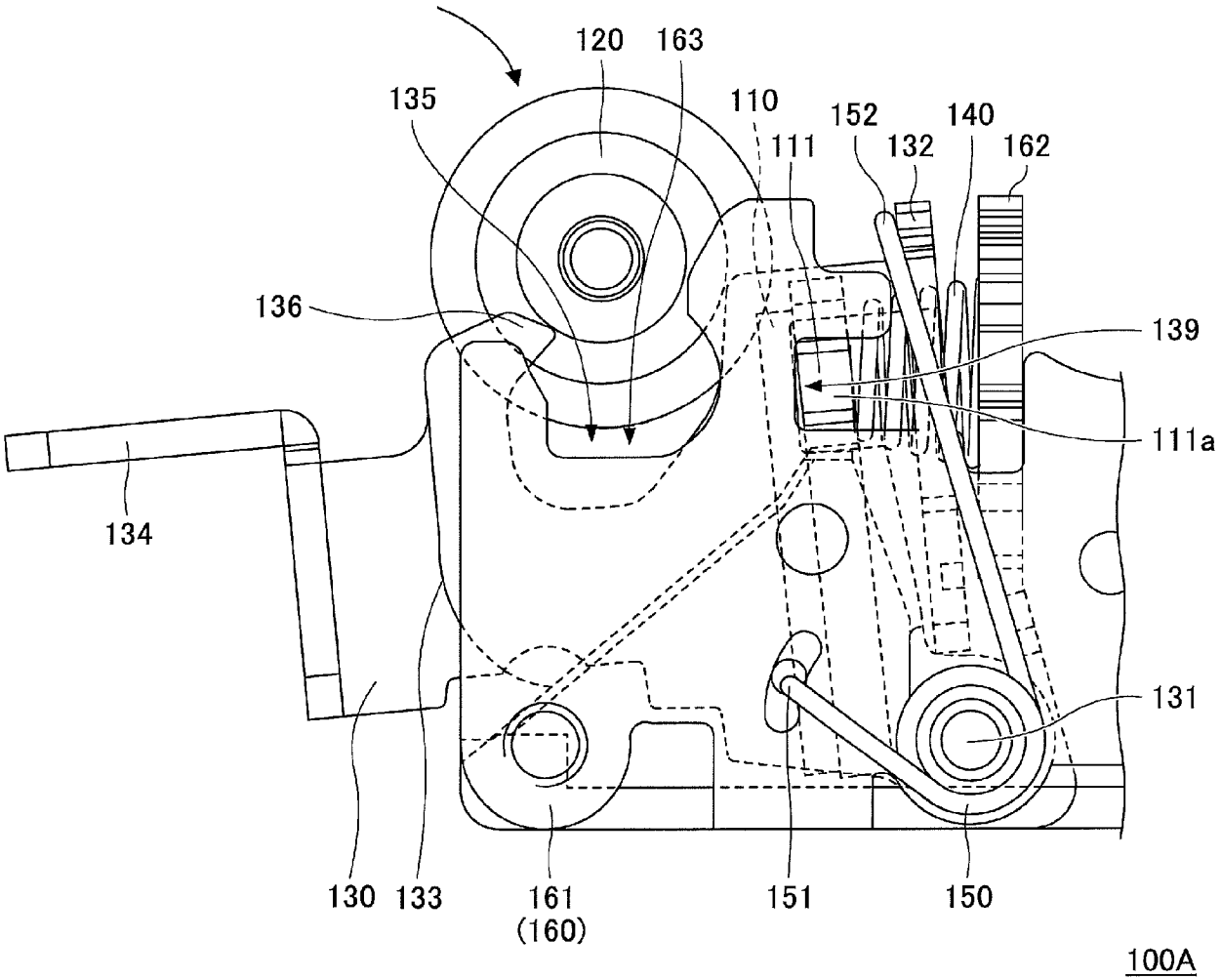
FIG. 50 is a drawing used to describe a method of installing a platen roller in a printer of an embodiment.
Figure 51:
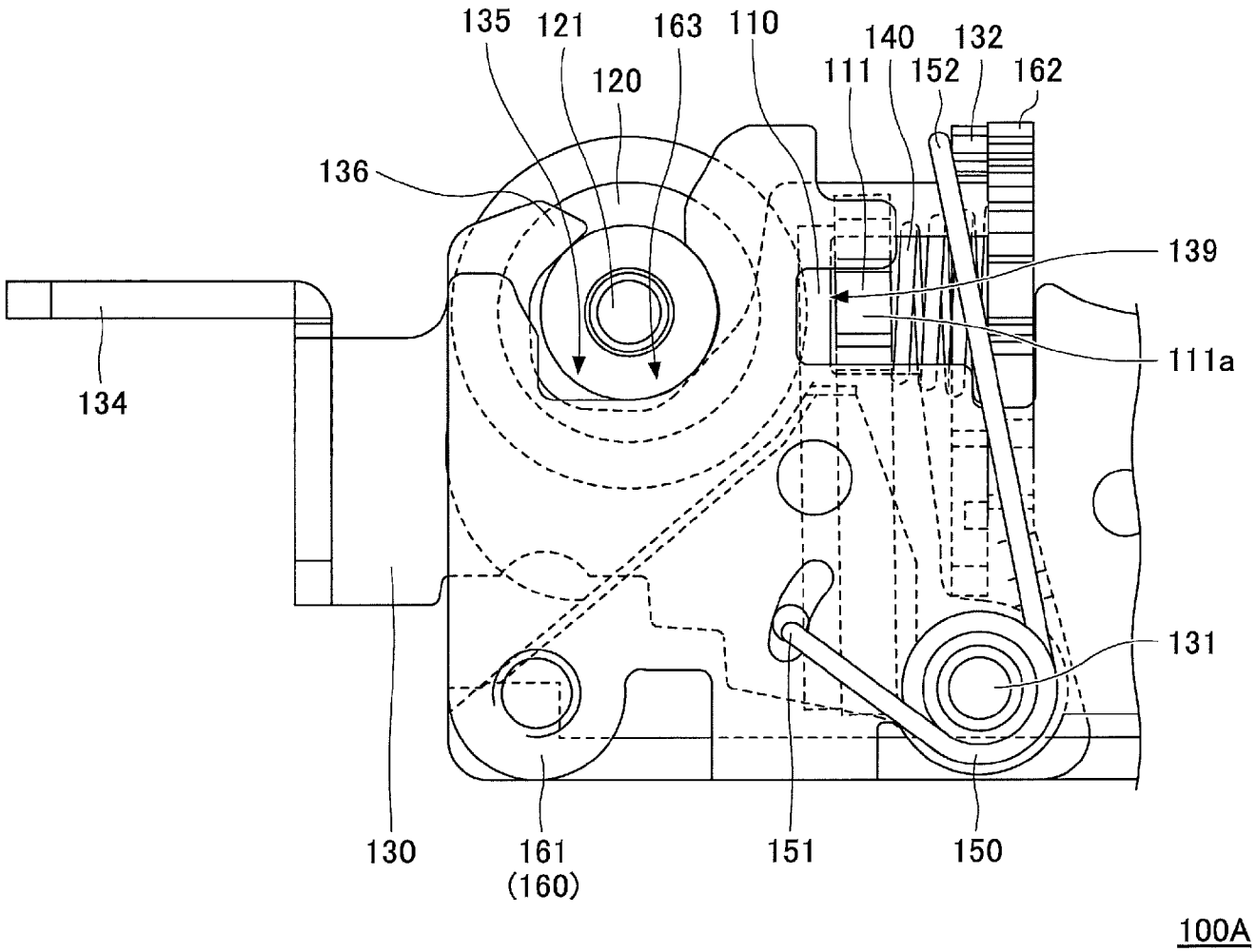
FIG. 51 is a drawing used to describe a method of installing a platen roller in a printer of an embodiment.
Figure 52:
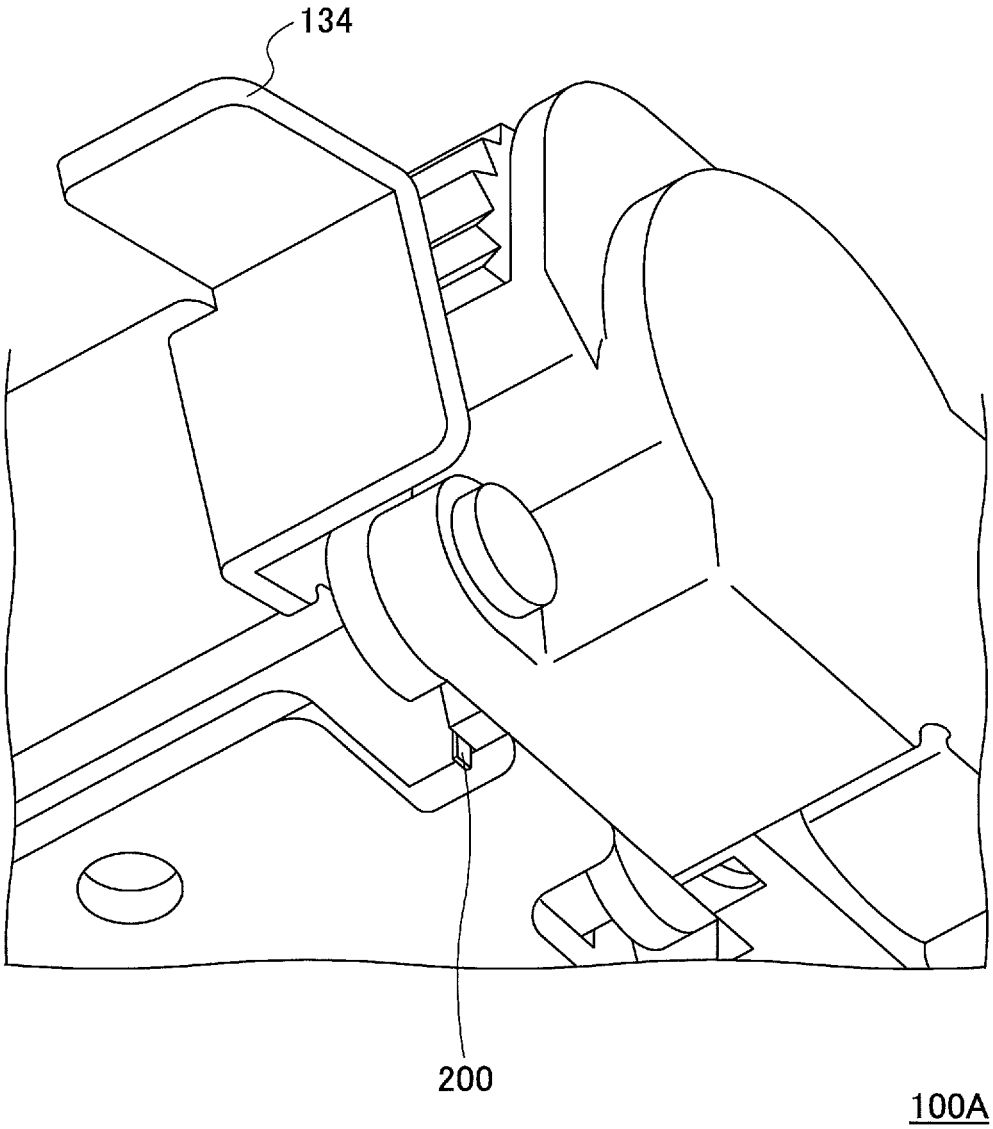
FIG. 52 is a drawing illustrating a switch of a printer of an embodiment.
Figure 53:
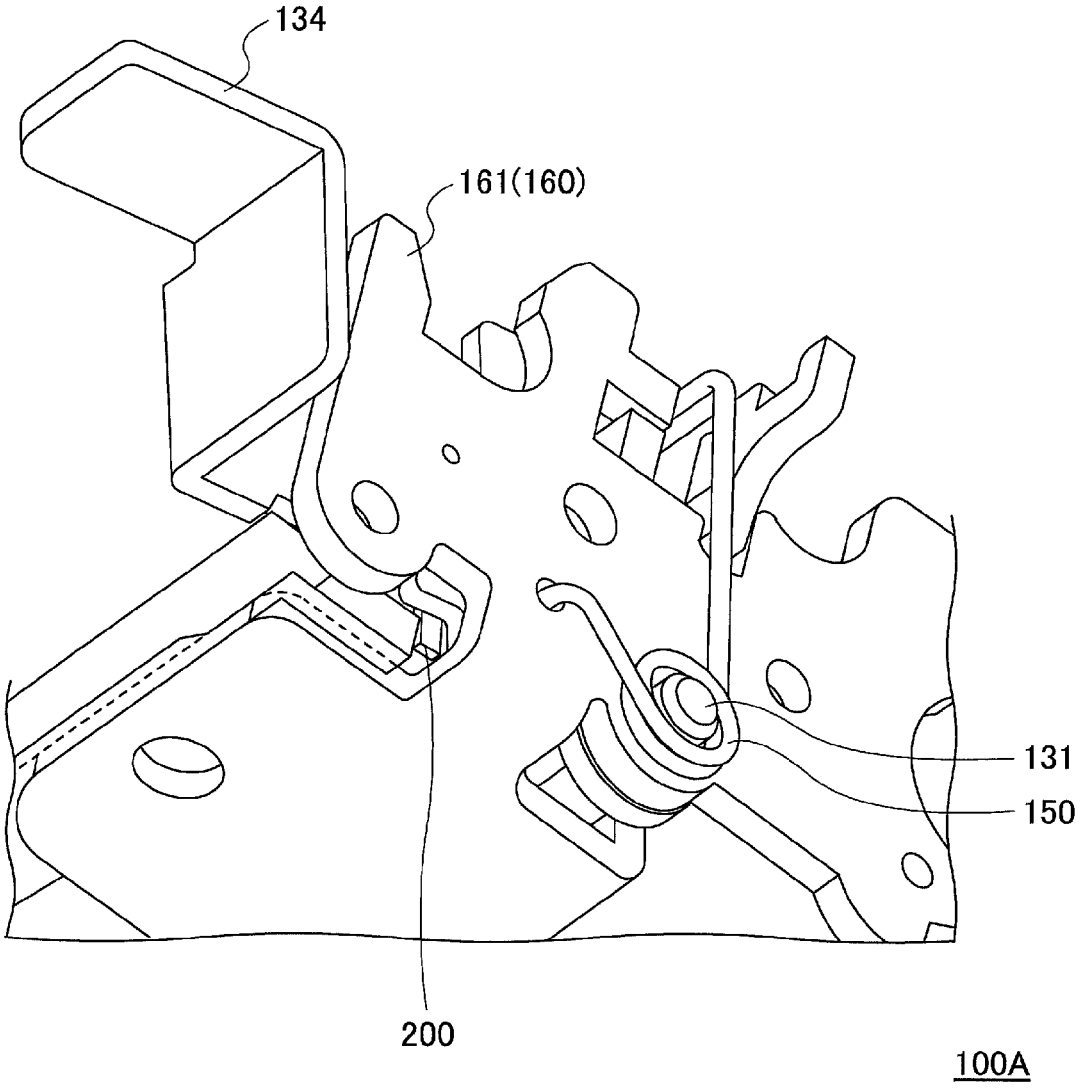
FIG. 53 is a drawing illustrating a switch of a printer of an embodiment.

As illustrated by FIG. 50, in the printer 100A of the present embodiment, the frame side part 161 of the frame 160 includes the frame opening 163. Also, the open-close arm side part 133 of the open-close arm 130 includes the open-close arm opening 135. The platen bearing 121 of the platen roller 120 is placed in the frame opening 163 and the open-close arm opening 135 so that the platen roller 120 is rotatably supported by the frame side part 161 of the frame 160 and the open-close arm side part 133 of the open-close arm 130.

The platen bearing 121 of the platen roller 120 is brought into contact with the lock part 136 forming an edge of the open-close arm opening 135 to place the platen bearing 121 into the frame opening 163 and the open-close arm opening 135. As a result, a force is applied to the first bias spring 140 in a direction to contract the first bias spring 140.

Next, when the platen bearing 121 is placed further into the frame opening 163 and the open-close arm opening 135, a force is further applied to the first bias spring 140 in a direction to contract the first bias spring 140. As a result, the heat sink 111 and the thermal head 110 move toward the frame back part 162. When the heat sink 111 moves, the protrusions 111*a* at the ends of the heat sink 111 also move in the opening 139 of the open-close arm side part 133 toward the frame back part 162. As a result, the force being applied via the heat sink 111 to the open-close arm side part 133 in a direction away from the frame back part 162 is removed, and the open-close arm 130 is caused by the restoring force of the second bias spring 150 to rotate around the arm rotation shaft 131. When the platen bearing 121 is placed completely in the frame opening 163 and the open-close arm opening 135, the platen bearing 121 is held by the lock part 136 of the open-close arm 130, and the platen roller 120 is rotatably supported. This state is the first state described above.

Through the above process, the platen roller 120 can be attached to the printer 100A of the present embodiment.

<Switch>

Next, a control process to determine whether to perform printing on recording paper is described.

The printer 100A of the present embodiment includes a switch that is a detection unit used in a control process to determine whether to perform printing on recording paper. More specifically, as illustrated by FIGS. 52 through 56, the printer 100A of the present embodiment includes a switch 200. The switch 200 includes a switch body 201 and a switch movable part 202.

Also, a protrusion 233 (see, for example, FIG. 54) is formed on the inner surface of the open-close arm side part 133 of the open-close arm 130. The switch 200 is disposed such that the switch movable part 202 is pressed by the protrusion 233 of the open-close arm 130 when the position of the open-close arm 130 relative to the frame 160 is in the second state (FIG. 48) or the third state (FIG. 49), and the switch movable part 202 is not pressed by the protrusion 233 of the open-close arm 130 when the position of the open-close arm 130 relative to the frame 160 is in the first state (FIG. 47). Also, the switch 200 is configured to output a signal to prevent the printer 100A from performing printing on recording paper when the switch movable part 202 is pressed by the protrusion 233 of the open-close arm 130.

Figure 54:
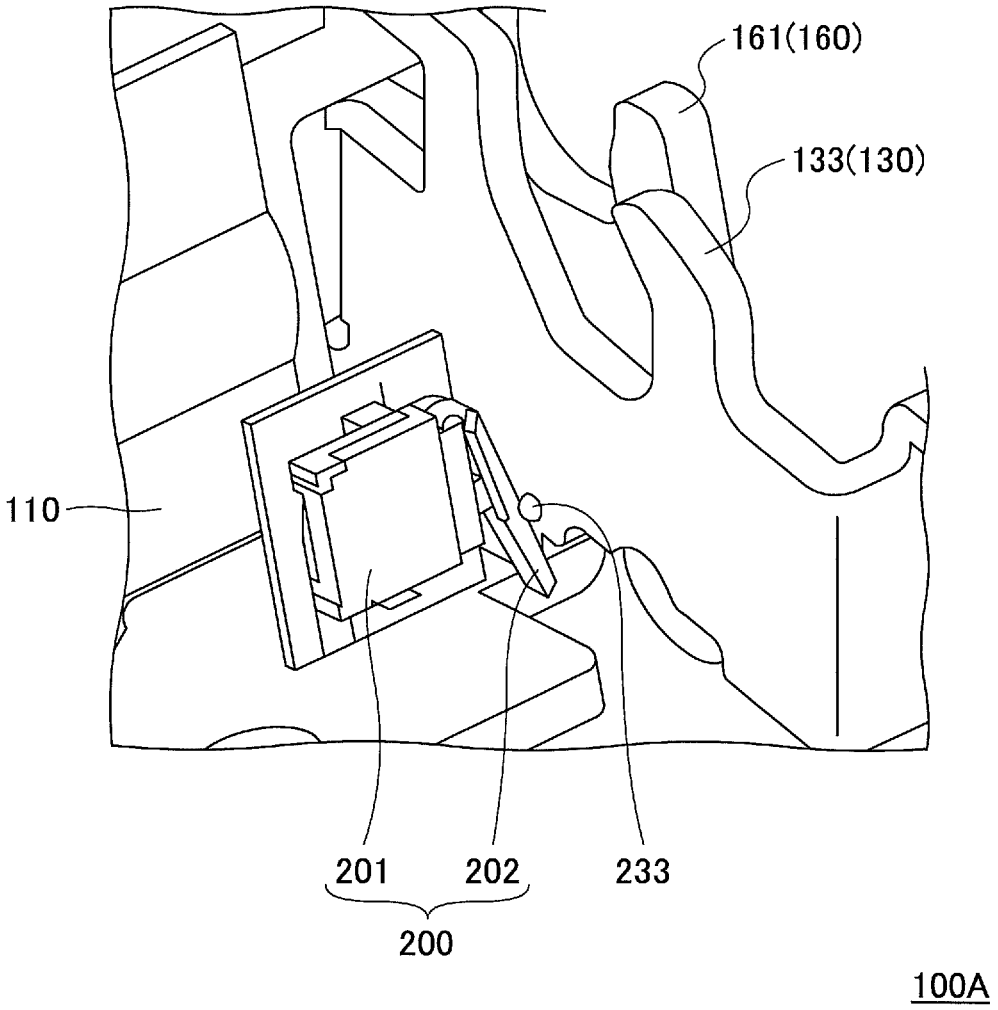
FIG. 54 is a drawing illustrating a switch of a printer of an embodiment.

FIG. 54 corresponds to the second state illustrated by FIG. 48. In this state, the switch movable part 202 is pressed by the protrusion 233 formed on the inner surface of the open-close arm side part 133 of the open-close arm 130 (ON state). In the second state, because the platen roller 120 is being attached or detached, the printer 100A is controlled to not perform printing on recording paper.

Figure 55:
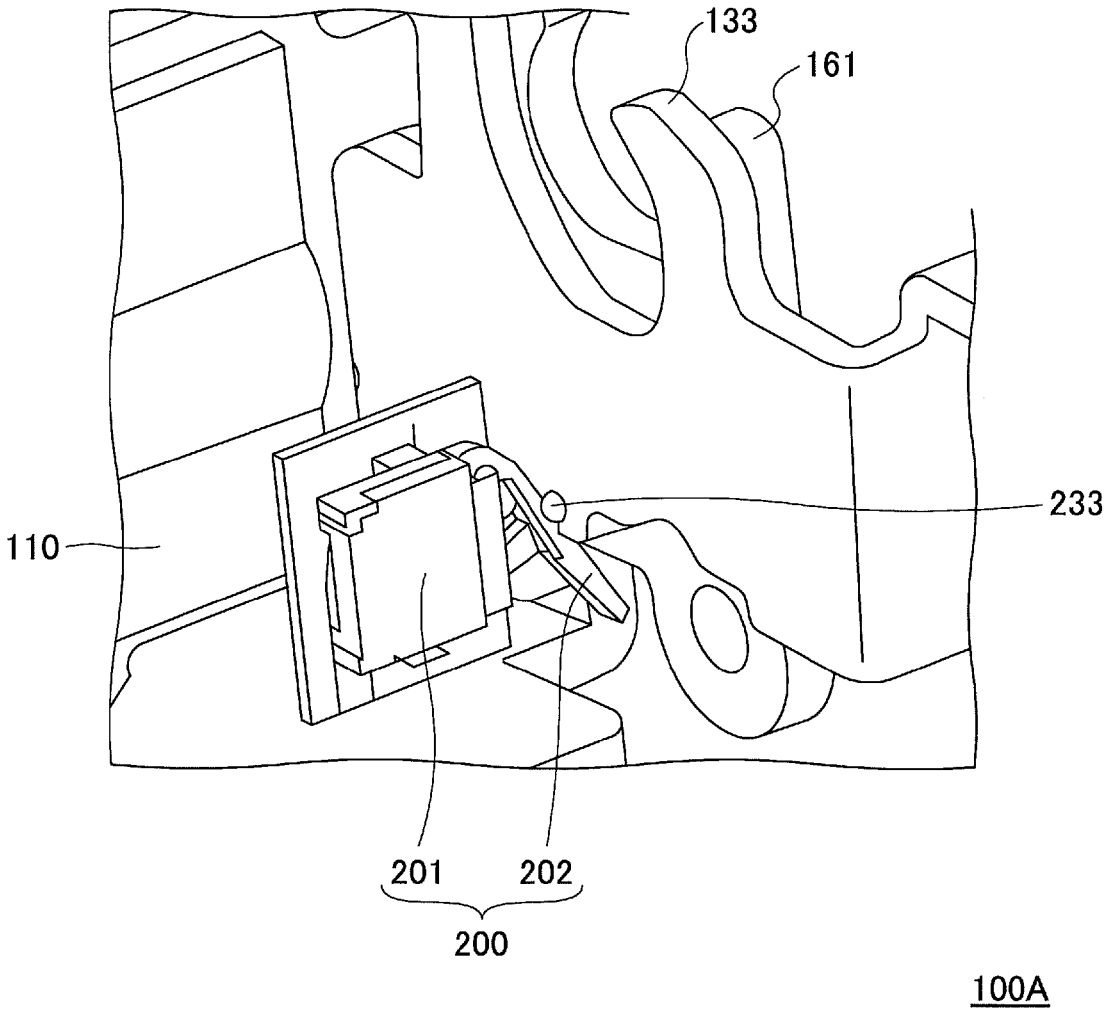
FIG. 55 is a drawing illustrating a switch of a printer of an embodiment.

FIG. 55 corresponds to the third state illustrated by FIG. 49. Also in this state, similarly to FIG. 54, the switch movable part 202 is pressed by the protrusion 233 formed on the inner surface of the open-close arm side part 133 of the open-close arm 130 (ON state). In the third state, because the platen roller 120 is not attached, the printer 100A is controlled to not perform printing on recording paper.

Figure 56:
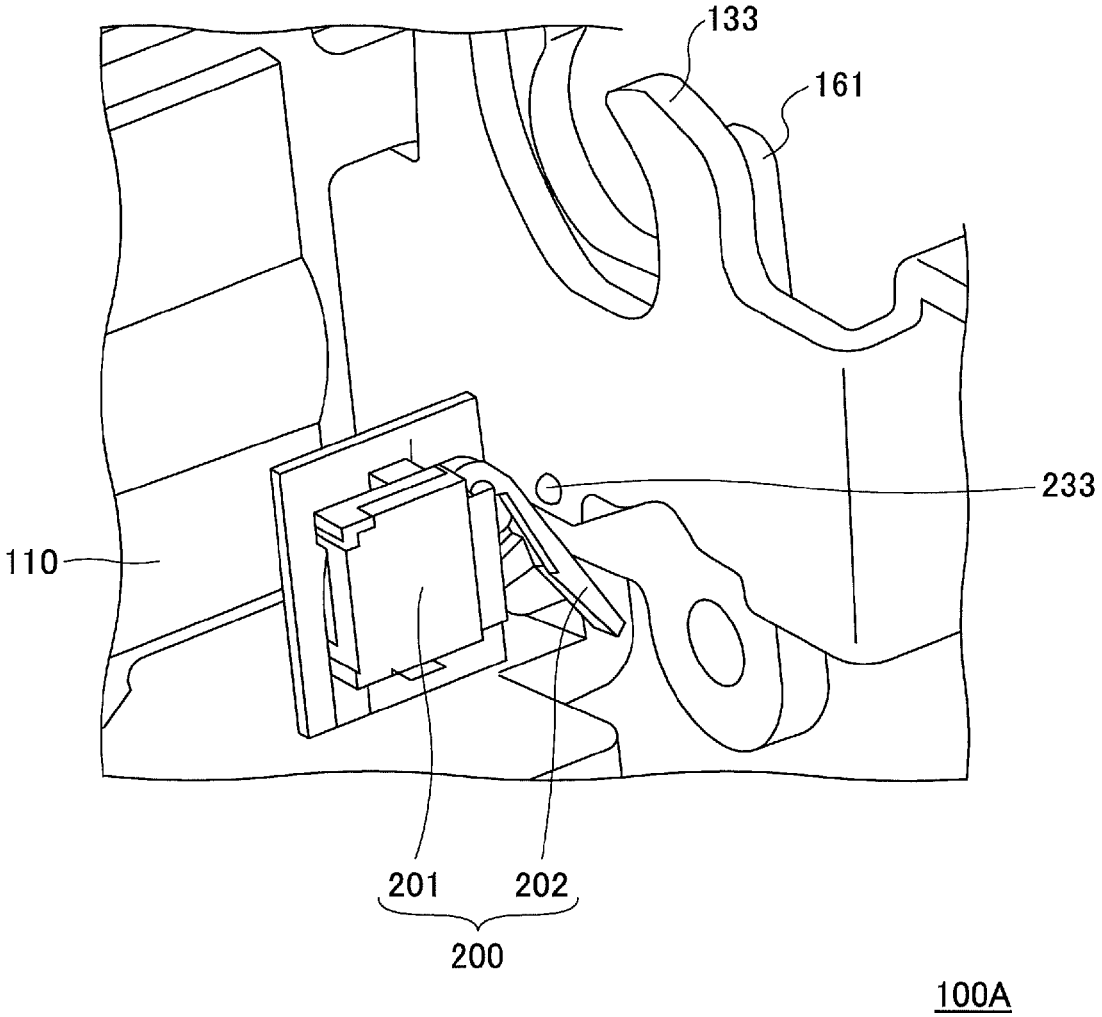
FIG. 56 is a drawing illustrating a switch of a printer of an embodiment.

FIG. 56 corresponds to the first state illustrated by FIG. 47. In this state, the switch movable part 202 is not pressed by the protrusion 233 formed on the inner surface of the open-close arm side part 133 of the open-close arm 130 (OFF state). In the first state, because the platen roller 120 is set in the predetermined position, the printer 100A is controlled to perform printing on recording paper when the recording paper is present.

A control unit (not shown) controls the printer 100A to perform or not perform printing on recording paper based on the state of the switch 200, i.e., whether the switch 200 is in the ON state or the OFF state.

The printer 100A of the present embodiment may also include a recording paper detection sensor (not shown) for detecting the presence of recording paper. Although not illustrated in figures, the printer 100A may further include a control unit that controls print operations based on outputs from the switch 200 and the recording paper detection sensor.

Similarly to the first embodiment, the printer 100A of the second embodiment is configured such that strong stress is not applied to a thermal head when attaching or detaching a platen roller. This configuration makes it possible to increase the durability, life, and reliability of the printer 100A.

The printer 100A of the present embodiment can also determine whether to perform print operations based on the position of the open-close arm 130.

Third Embodiment

<Printer>

A printer according to a third embodiment is described below.

A printer 100B of the third embodiment has a configuration similar to the configuration of the printer 100 of the first embodiment described with reference to FIGS. 3 through 14.

Figure 57:
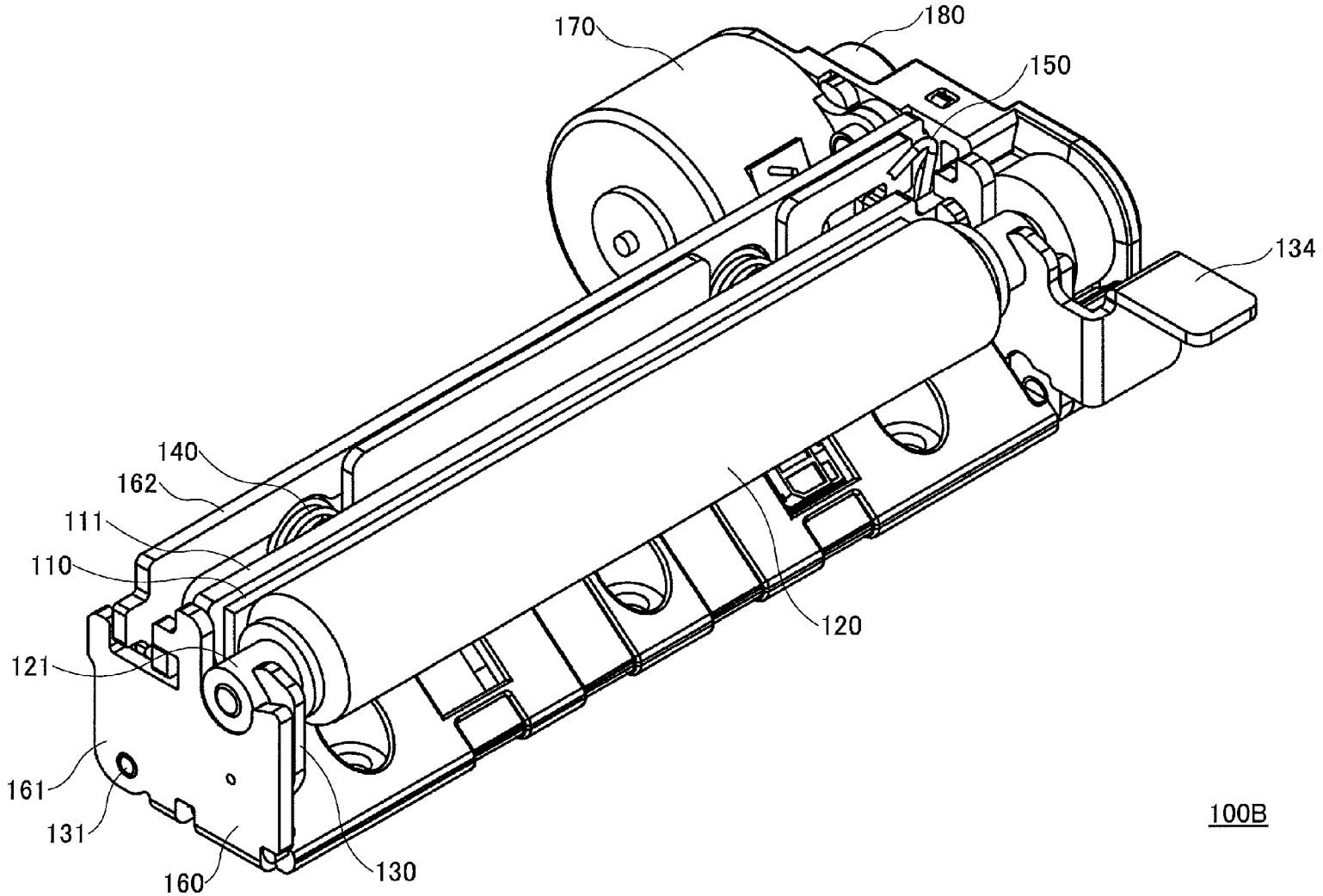
FIG. 57 is a perspective view of a printer of an embodiment.

FIG. 57 is a perspective view illustrating an exemplary configuration of the printer 100B of the present embodiment. As illustrated by FIG. 57, the printer 100B of the present embodiment includes a thermal head 110 used as a print head, a platen roller 120, an open-close arm 130, first bias springs 140, a second bias spring 150, a frame 160, a motor 170, and a gear unit 180. The thermal head 110 used as a print head, the platen roller 120, the open-close arm 130, the first bias springs 140, and the second bias spring 150 are disposed in the frame 160.

As described later, in the printer 100B of the present embodiment, the platen roller 120 is held onto the frame 160 by a force applied by the first bias springs 140.

In the present embodiment, the first bias spring 140 may be implemented by a coil spring. The second bias spring 150 may be implemented by a torsion coil spring (torsion spring).

The platen roller 120 includes a platen bearing 121. The frame 160 includes frame side parts 161 and a frame back part 162.

The platen bearing 121 of the platen roller 120 is rotatably supported by the frame side parts 161 of the frame 160. When the motor 170 rotates, the platen roller 120 is rotated via the gear unit 180.

The printer 100B further includes a heat sink 111 that is provided on the back side of the thermal head 110 and used as a head support plate. The frame 160 includes the frame back part 162 that faces the heat sink 111. The first bias springs 140 are disposed between the heat sink 111 and the frame back part 162. The thermal head 110 is pressed via the heat sink 111 by the restoring force of the first bias springs 140 toward the platen roller 120.

The open-close arm 130 includes an arm rotation shaft 131. The open-close arm 130 is supported by the frame side parts 161 such that the open-close arm 130 is rotatable around the arm rotation shaft 131 relative to the frame 160.

Similarly to the first and second embodiments, the second bias spring 150, which is implemented, for example, by a torsion coil spring (torsion spring), is provided between the open-close arm 130 and the frame 160. More specifically, although not illustrated in FIG. 57, one end of the second bias spring 150 is connected to the frame side part 161, and the other end of the second bias spring 150 is in contact with an open-close arm back part 132 of the open-close arm 130. The open-close arm 130 can be rotated around the arm rotation shaft 131 by pressing the open-close arm operation part 134 downward. When the force being applied to the open-close arm operation part 134 is removed, the open-close arm operation part 134 is caused to move upward by the restoring force of the second bias spring 150, and the open-close arm 130 moves toward the home position.

<Frame>

Figure 58:
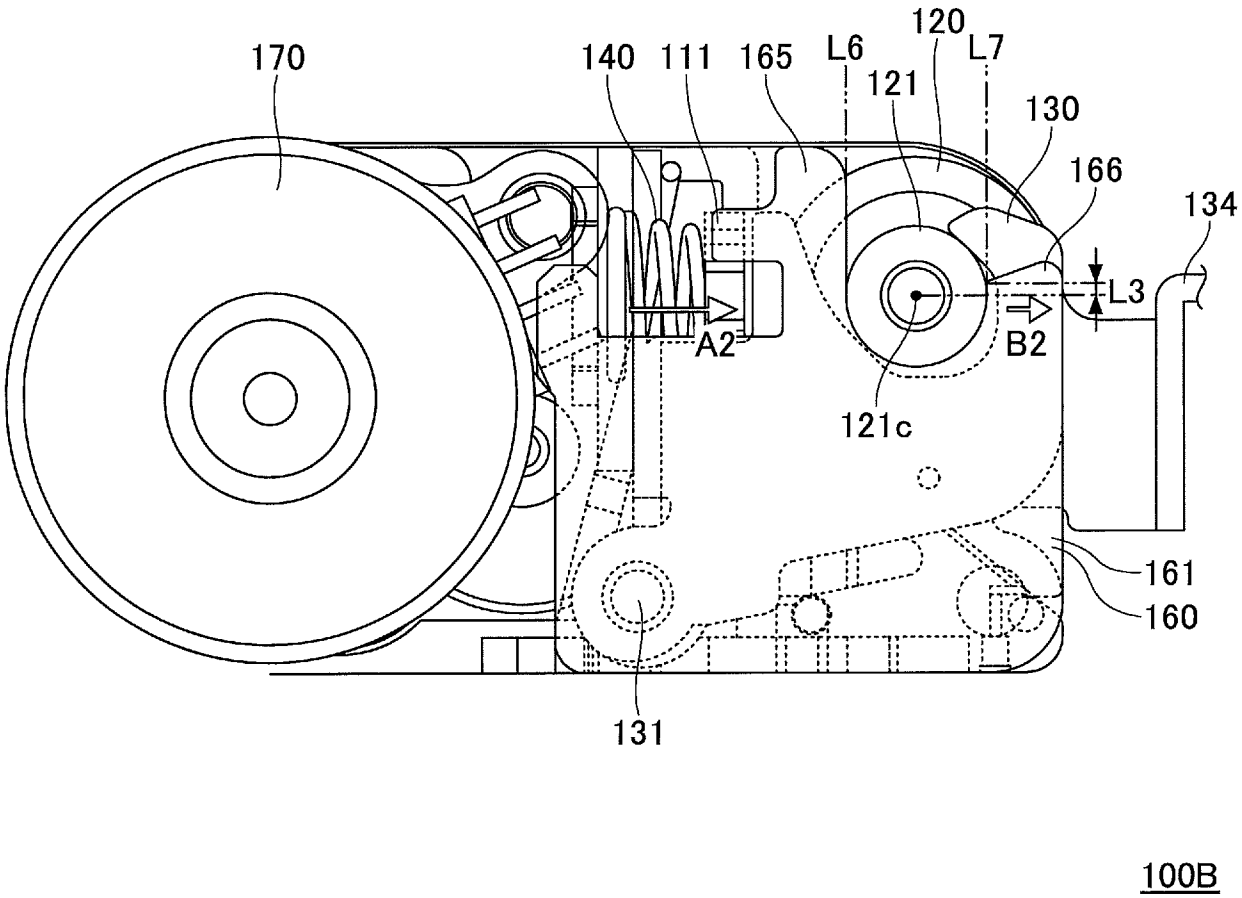
FIG. 58 is a drawing illustrating a printer of an embodiment.
Figure 59:
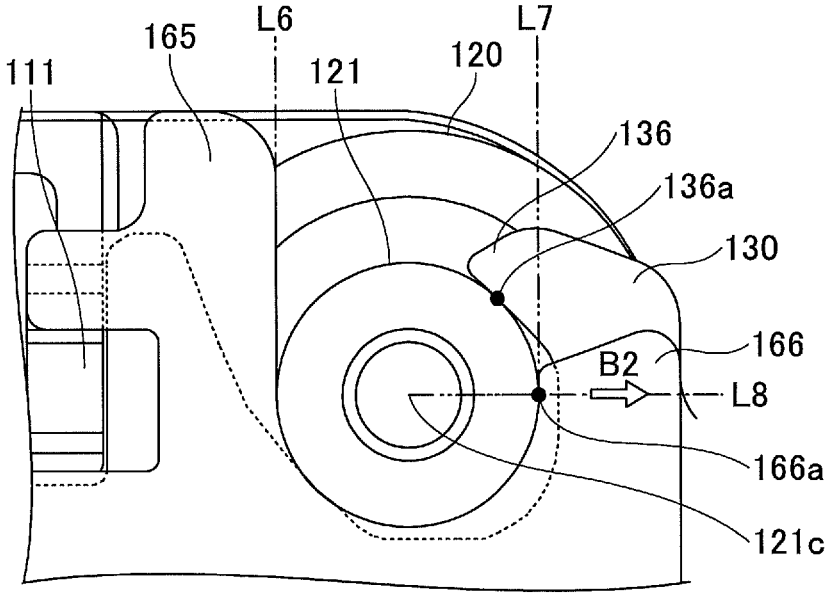
FIG. 59 is an enlarged view of a part of FIG. 58.
Figure 60:
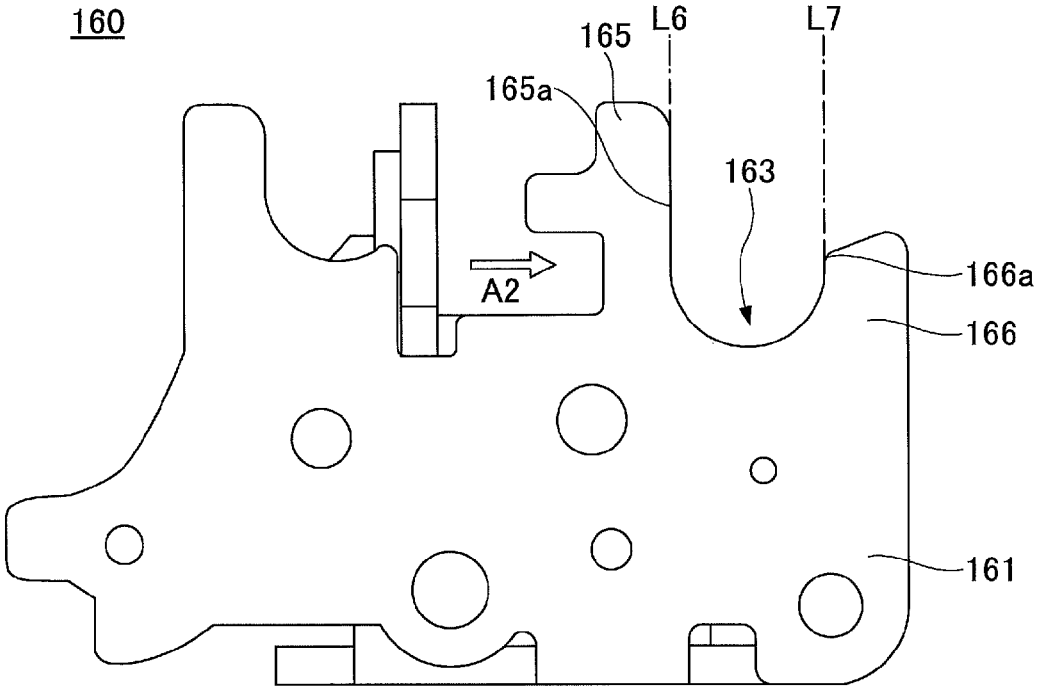
FIG. 60 is a drawing illustrating a frame of an embodiment.

Next, the frame 160 is described with reference to FIGS. 58 through 60. FIG. 58 is a side view of the printer 100B of the present embodiment, FIG. 59 is an enlarged view of a part of FIG. 58, and FIG. 60 is a side view of the frame 160.

The frame side part 161 of the frame 160 includes a frame opening 163 that accepts the platen bearing 121 to support the platen roller 120. The frame opening 163 has a U-like shape. A first guide part 165 and a second guide part 166 are formed at an entry part of the frame opening 163 to guide the platen bearing 121 into the frame opening 163. The first guide part 165 is disposed closer to the thermal head 110 (the heat sink 111) than the second guide part 166, and is longer than the second guide part 166.

A line L6 along a linear edge 165*a* of the first guide part 165 forming a part of the frame opening 163 is substantially parallel to a line L7 along a linear edge 166*a* of the second guide part 166 forming a part of the frame opening 163.

The direction in which the line L6 and the line L7 extend is substantially perpendicular to a direction indicated by an arrow A2 in which the restoring force of the first bias spring 140 acts.

In the printer 100B of the present embodiment, the heat sink 111 and the thermal head 110 are biased by the restoring force of the first bias spring 140 toward the platen roller 120. The platen bearing 121 of the platen roller 120 is in contact with and supported by the edge 166*a* of the second guide part 166 forming a part of the frame opening 163 of the frame 160. Accordingly, the line L7 is a tangent of a contact point between the edge 166*a* of the second guide part 166 and the platen bearing 121.

The edge 166*a* of the second guide part 166 forming a part of the frame opening 163 is disposed on a line L8 that is parallel to a direction in which the restoring force of the first bias spring 140 acts and passes through the center 121*c* of the platen bearing 121, or disposed in an area above the line L8 in FIG. 59. In the printer 100B of the present embodiment, the length of the linear edge 166*a* of the second guide part 166 which overlaps the line L7 is about 0.2 mm.

<Open-Close Arm>

Figure 61:
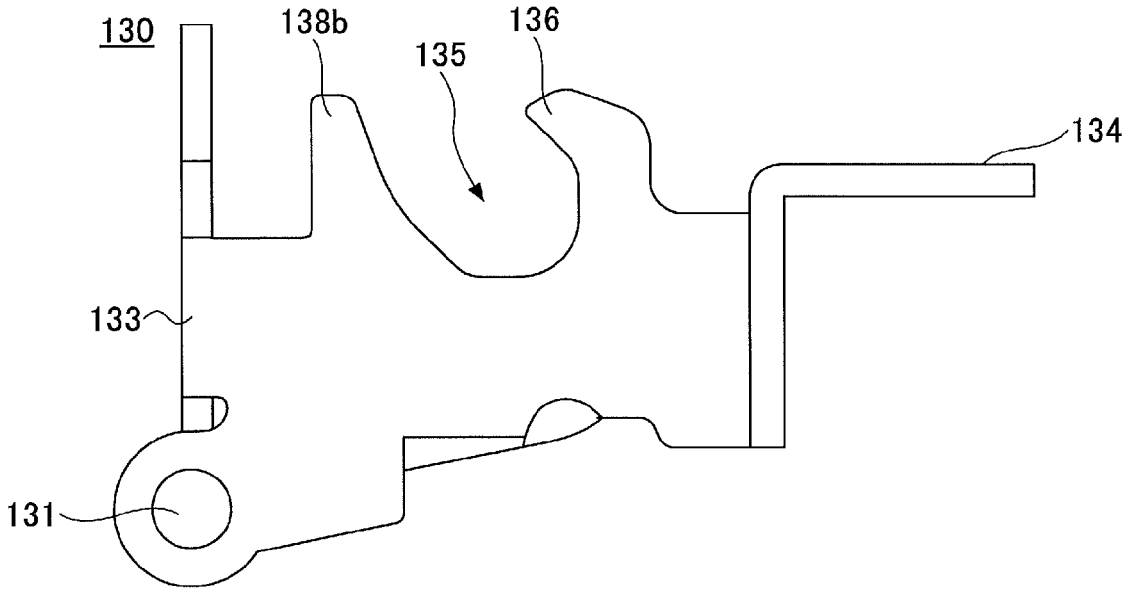
FIG. 61 is a drawing illustrating an open-close arm of an embodiment.

Next, the open-close arm 130 is described with reference to FIGS. 58, 59, and 61. FIG. 61 is a side view of the open-close arm 130.

The open-close arm 130 includes the open-close arm back part 132, the open-close arm side parts 133, and the open-close arm operation part 134.

The open-close arm 130 can be rotated around the arm rotation shaft 131 by pressing the open-close arm operation part 134. The open-close arm side part 133 includes an open-close arm opening 135 in which the platen bearing 121 of the platen roller 120 is placed. The open-close arm side part 133 also includes a lock part 136 that forms a part of the edge of the open-close arm opening 135 and is farthest from the arm rotation shaft 131. Further, the open-close arm side part 133 includes a platen detaching part 138*b* that is on the other side of the open-close arm opening 135 from the lock part 136, and presses the platen bearing 121 outward when detaching the platen roller 120.

In the present embodiment, the platen bearing 121 of the platen roller 120 is pressed by the restoring force of the first bias spring 140 in a direction indicated by an arrow A2. Also, the platen bearing 121 presses the frame 160 in a direction indicated by an arrow B2. With this configuration, the platen bearing 121 is rotatably supported by the frame 160. That is, although the platen bearing 121 is in the open-close arm opening 135, the platen bearing 121 is supported by the frame 160 in the direction of the arrow A2 in which the restoring force of the first bias spring 140 acts. The lower part of the platen bearing 121 below the center 121*c* is not in contact with the open-close arm 130 in the direction of the arrow B2. Thus, the weight of the platen bearing 121 is not applied to the open-close arm 130, and the platen bearing 121 is not supported by the open-close arm 130.

Although the platen bearing 121 is in contact with the lock part 136 of the open-close arm 130 at the contact part 136*a*, the lock part 136 is provided to prevent the platen bearing 121 from moving upward and downward in the figure. That is, the open-close arm 130 does not support the platen bearing 121 in the direction of the arrow A2 in which the restoring force of the first bias spring 140 acts, but prevents the movement of the platen roller 120 in a direction that is substantially perpendicular to the direction of the arrow A2.

<Method of Detaching Platen Roller 120>

Figure 62:
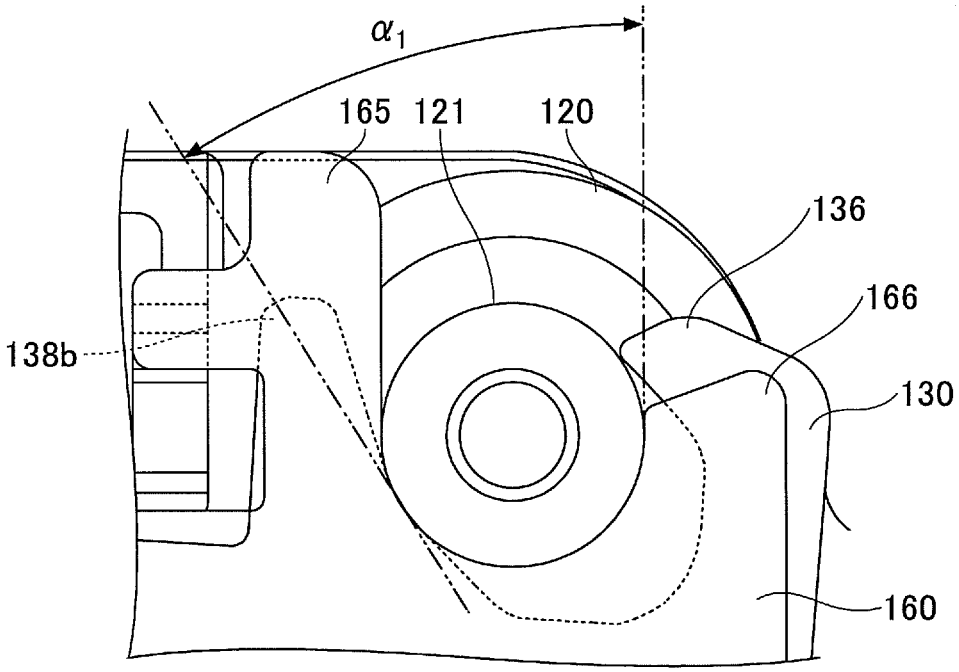
FIG. 62 is a drawing used to describe a method of detaching a platen roller of a printer of an embodiment.

Next, a method of detaching the platen roller 120 from the printer 100B of the present embodiment is described with reference to FIGS. 62 through 65. In the printer 100B of the present embodiment, to detach the platen roller 120, the open-close arm operation part 134 of the open-close arm 130 is pressed downward as illustrated in, for example, FIG. 57. When the open-close arm operation part 134 is pressed downward, the open-close arm 130 changes from a state illustrated by FIG. 59 to a state illustrated by FIG. 62. In the state of FIG. 62, because the platen bearing 121 is in contact with the lock part 136 of the open-close arm 130, the platen bearing 121 cannot move out of the frame opening 163.

Figure 63:
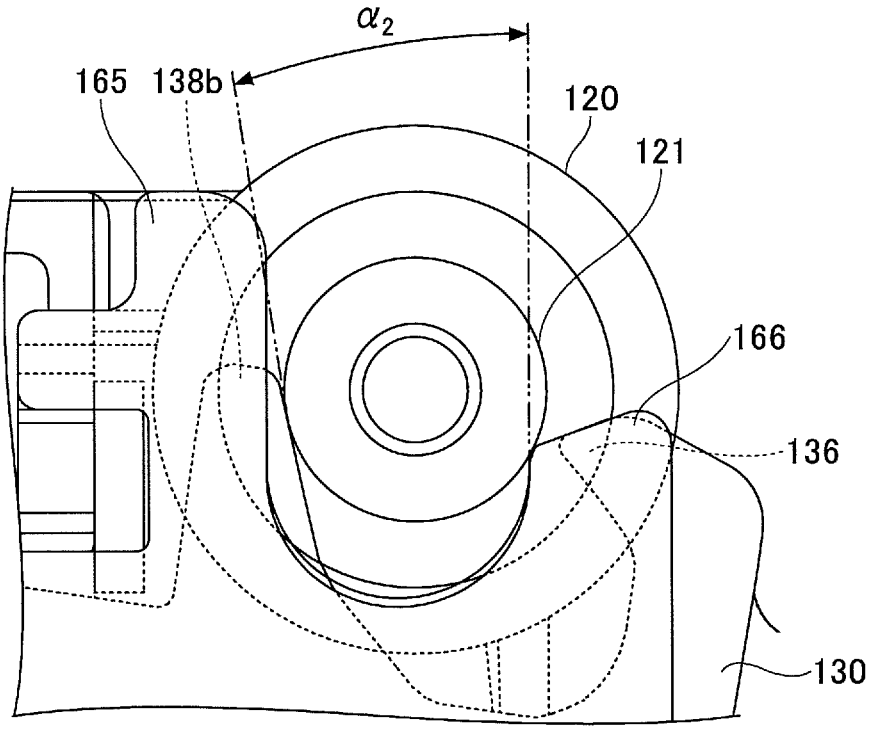
FIG. 63 is a drawing used to describe a method of detaching a platen roller of a printer of an embodiment.

When the open-close arm operation part 134 is pressed further downward, the open-close arm 130 changes to a state illustrated by FIG. 63, and the platen bearing 121 moves away from the lock part 136 of the open-close arm 130. As a result, it becomes possible to move the platen bearing 121 out of the frame opening 163. On the other hand, the platen detaching part 138*b* of the open-close arm 130 contacts the platen bearing 121 and pushes the platen bearing 121 out of the frame opening 163.

When the open-close arm 130 changes from the state of FIG. 62 to the state of FIG. 63, an angle between a contact point at which the platen bearing 121 contacts the open-close arm 130 and a contact point at which the platen bearing 121 contacts the frame opening 163 changes from $\alpha 1$ to $\alpha 2$ ($\alpha 1 > \alpha 2$).

Figure 64:
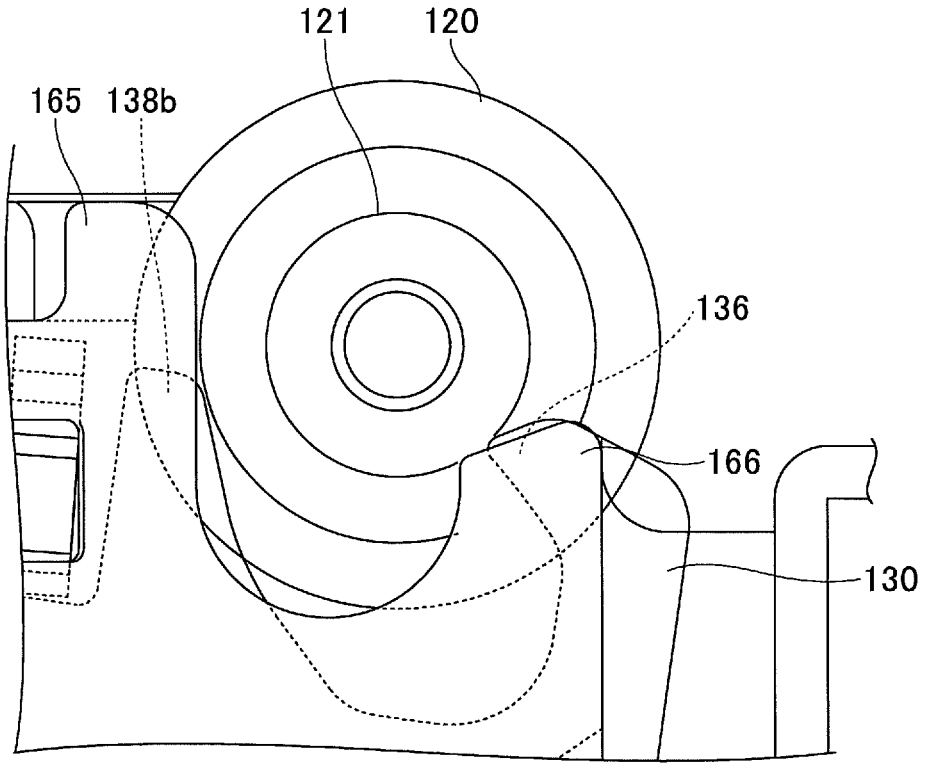
FIG. 64 is a drawing used to describe a method of detaching a platen roller of a printer of an embodiment.

Then, when the force being applied to the open-close arm 130 is removed, the restoring force of the second bias spring 150 is applied to the open-close arm 130 in a direction to return to the home position, and the open-close arm 130 changes to a state illustrated by FIG. 64. The platen bearing 121 pushed out of the frame opening 163 moves to a position above the lock part 136 of the open-close arm 130.

Figure 65:
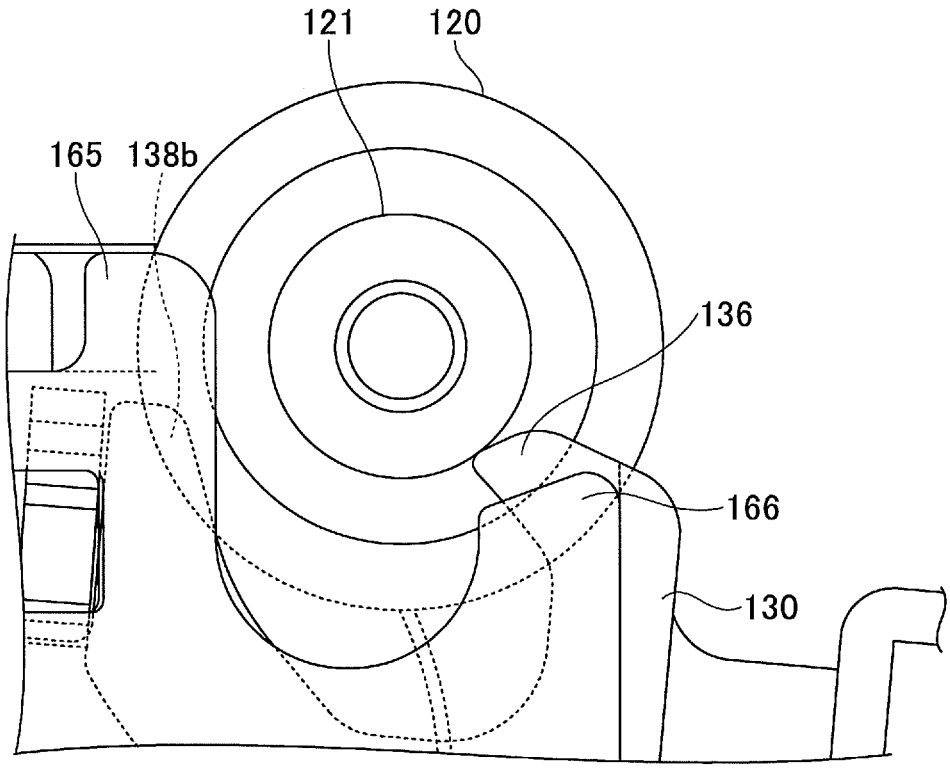
FIG. 65 is a drawing used to describe a method of detaching a platen roller of a printer of an embodiment.

After that, the open-close arm 130 is caused to return to the home position by the second bias spring 150 and changes into a state illustrated by FIG. 65. Then, the platen bearing 121 is moved above the lock part 136 and lift up.

The above configuration makes it possible to take the platen bearing 121 out of the frame opening 163 and detach the platen roller 120.

Similarly to the first embodiment, the printer 100B of the third embodiment is configured such that strong stress is not applied to a thermal head when attaching or detaching a platen roller. This configuration makes it possible to increase the durability, life, and reliability of the printer 100B.

The printer 100B of the third embodiment is also configured such that the platen roller 120 is supported by the frame 160 while the platen roller 120 is rotated. With this configuration, force is not applied by the rotating platen roller 120 to the open-close arm 130. Therefore, this configuration makes it possible to prevent deformation and displacement of the open-close arm 130. Accordingly, the configuration of the third embodiment makes it possible to improve the durability of the printer 100B, keep the platen roller 120 in a desired position, and prevent degradation of print quality.

Also, providing the platen detaching part 138*b* as a part of the open-close arm 130 makes it possible to smoothly detach the platen roller 120 by rotating the open-close arm 130.

Fourth Embodiment

Next, a fourth embodiment is described. In the fourth embodiment, the shape of an open-close arm is different from the shape of the open-close arm 130 of the third embodiment.

Figure 66:
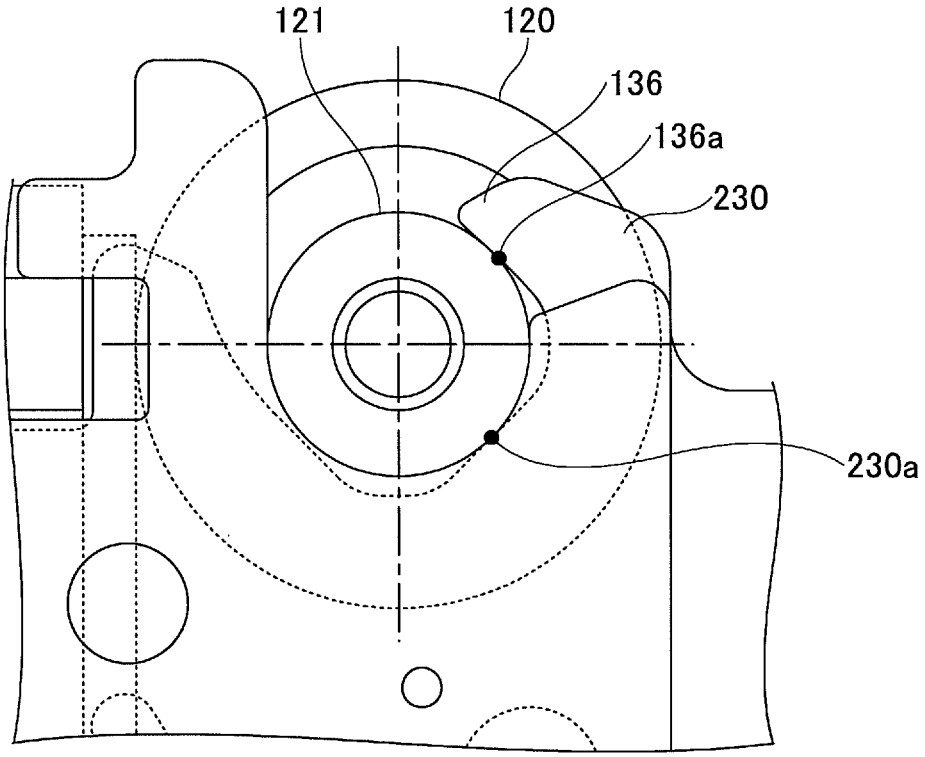
FIG. 66 is a drawing illustrating a printer of an embodiment.

FIG. 66 is a drawing illustrating a configuration of an open-close arm 230 of the present embodiment.

As illustrated by FIG. 66, in a printer of the present embodiment, the platen bearing 121 of the platen roller 120 is in contact with the open-close arm 230 at a contact part 136*a* of the lock part 136 and at a contact part 230*a* that is located deeper in the open-close arm opening 135 than the contact part 136*a*. Making the platen bearing 121 contact the open-close arm 130 at the contact part 230*a* makes it possible to improve the positional accuracy of the contact part 136*a* at which the platen bearing 121 contacts the open-close arm 130.

That is, because the platen bearing 121 of the platen roller 120 contacts the open-close arm 230 at two points, i.e., the contact part 136*a* and the contact part 230*a* in the present embodiment, the distance between the contact part 230*a* and the contact part 136*a* can be made constant and the positional accuracy of the contact part 136*a* can be improved.

Configurations of the printer of the fourth embodiment other than those described above are substantially the same as the third embodiment.

Fifth Embodiment

Next, a fifth embodiment is described. The fifth embodiment is related to the rotational direction of the platen roller 120.

In the present embodiment, the platen roller 120 is rotated such that a part of the platen bearing 121 in contact with the edge 166*a* of the second guide part 166 of the frame 160 moves downward, i.e., toward the bottom of the frame opening 163. More specifically, as indicated by arrows in FIG. 67, the platen roller 120 is rotated clockwise. In other words, the platen roller 120 is rotated in a direction that faces the tip of the lock part 136.

When the platen roller 120 is rotated clockwise, due to a frictional force at a part of the platen roller 120 that contacts the thermal head 110 via recording paper, a downward force is applied to the part of the platen bearing 121 contacting the edge 166*a* of the second guide part 166. With this configuration, a force is applied to the platen bearing 121 in a direction toward the bottom of the frame opening 163. Accordingly, this configuration makes it possible to prevent the platen roller 120 from jumping out of the printer. Thus, the printer of the present embodiment is configured to prevent the platen bearing 121 from moving out of the frame opening 163 when the platen roller 120 is rotated for printing.

The above described effect of the present embodiment is explained in more detail below. Assuming that the platen roller 120 is rotated counterclockwise in FIG. 67, an upward force is applied to the part of the platen bearing 121 contacting the edge 166*a* of the second guide part 166. As a result, a force is applied to the platen bearing 121 in a direction toward the outside of the frame opening 163. This may cause the platen roller 120 to jump out of the printer. In the present embodiment, the platen roller 120 is rotated clockwise in FIG. 67 so that a force is applied to the platen bearing 121 in a direction toward the bottom of the frame opening 163. This configuration makes it possible to prevent the platen bearing 121 from moving out of the frame opening 163.

Figure 67:
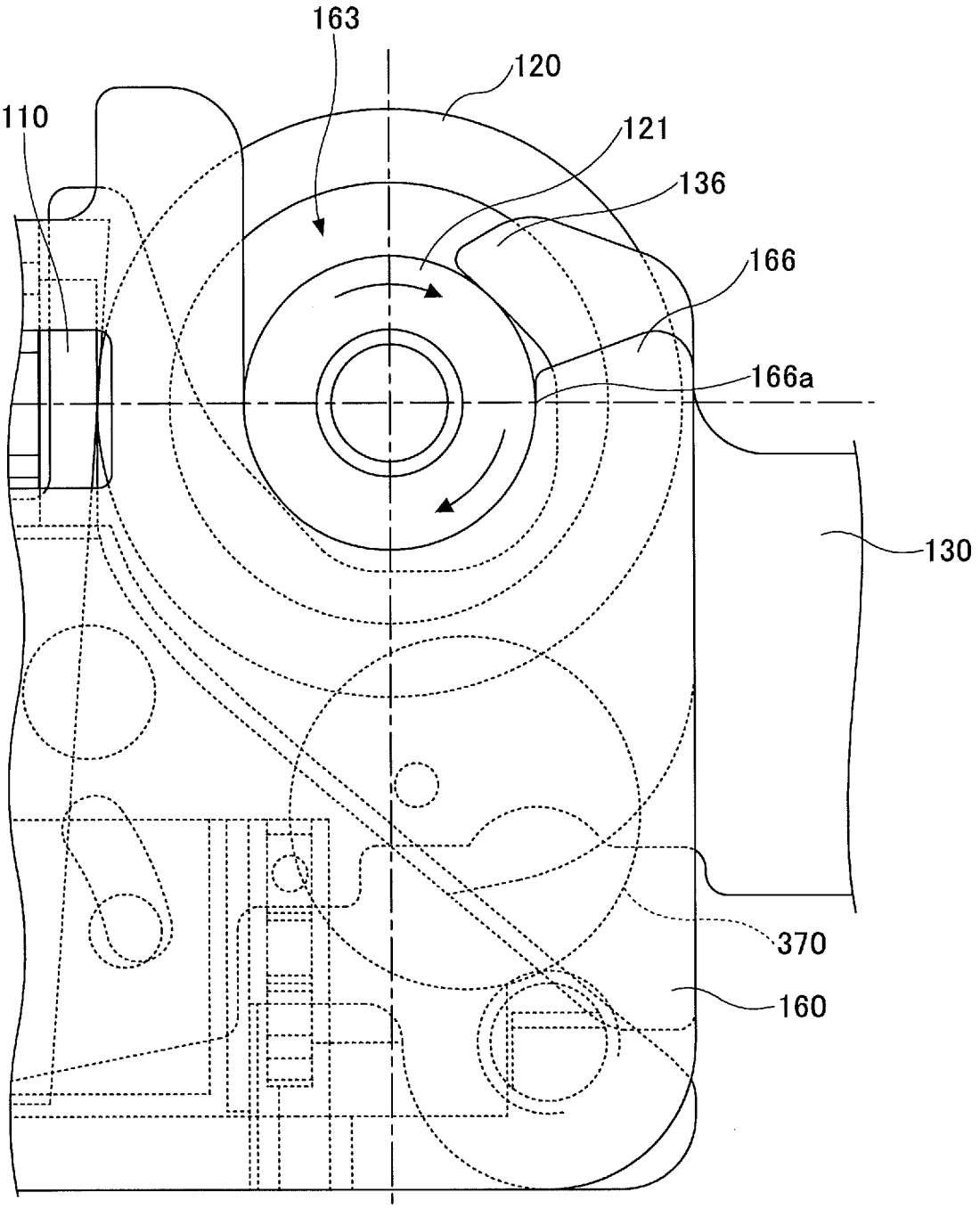
FIG. 67 is a drawing illustrating a printer of an embodiment.

For the above purpose, as illustrated in FIG. 67, the printer of the fifth embodiment may include a gear unit 370 for reversing the rotational direction of the platen roller 120. Configurations of the printer of the fifth embodiment other than those described above are substantially the same as the third embodiment.

Sixth Embodiment

First, a printer 900 including a thermal head and an open-close arm with a back support plate is described. The printer 900 is similar to the printer 900 that is described in the first embodiment with reference to FIGS. 1 and 2. A force applied to a thermal head 910 and a platen roller 920 when detaching the platen roller 920 is described with reference to FIGS. 68 and 69.

Figure 68:
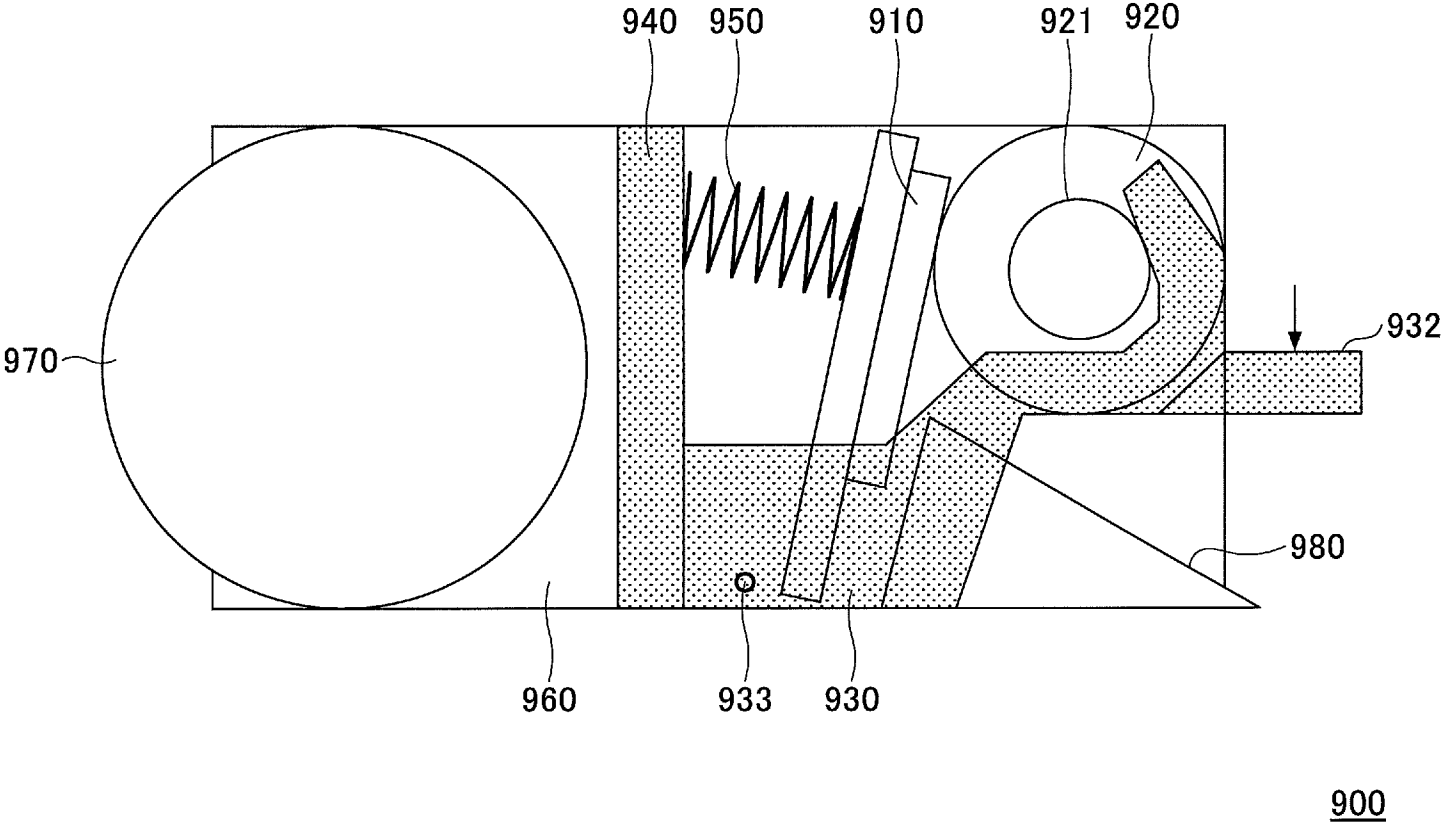
FIG. 68 is a drawing illustrating a related-art printer.
Figure 69:
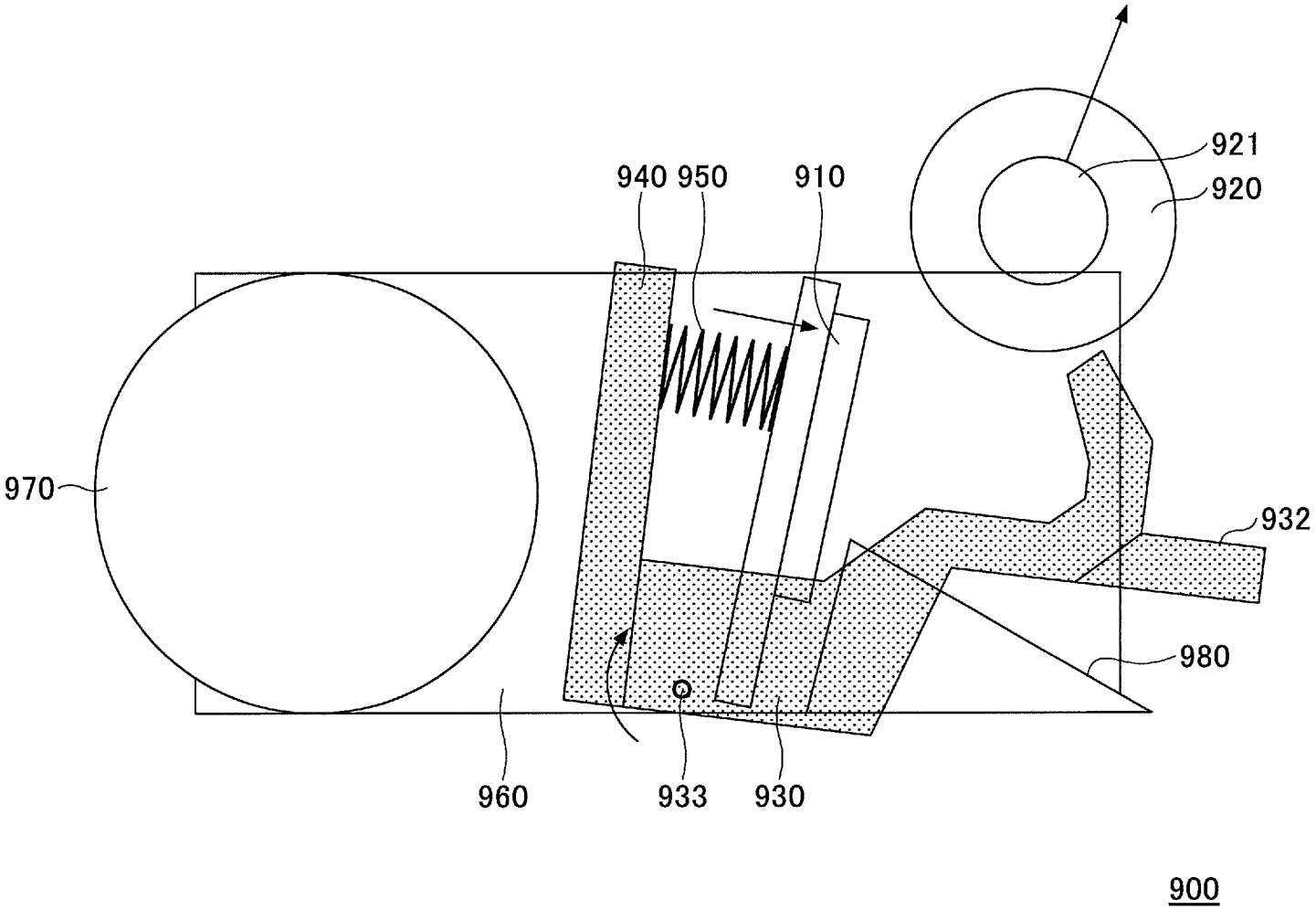
FIG. 69 is a drawing illustrating a related-art printer.

As illustrated by FIG. 68, the printer 900 (e.g., a thermal printer) includes a thermal head 910 used as a print head, a platen roller 920, an arm 930, a coil spring 950, a recording paper guide 980 for guiding recording paper (not shown), and a motor 970 for feeding the recording paper. The arm 930 includes a back support plate 940 and an operation part 932. A platen bearing 921 of the platen roller 920 is supported by the arm 930. A heat sink is attached to the thermal head 910.

The coil spring 950 is disposed between the back support plate 940 and the thermal head 910. The thermal head 910 is pressed by the restoring force of the coil spring 950 toward the platen roller 920. More specifically, the thermal head 910 is pressed by the coil spring 950 via the heat sink attached to the thermal head 910. The arm 930 is attached to a frame 960 and rotatable around an arm rotation shaft 933. The arm 930 can be rotated around the arm rotation shaft 933 and changed to a state illustrated by FIG. 69 by pressing the operation part 932 in a direction indicated by an arrow. Thus, the platen roller 920 can be detached by rotating the arm 930 supporting the platen bearing 921 of the platen roller 920 around the arm rotation shaft 933.

Because the back support part 940 is a part of the arm 930, when the arm 930 is rotated around the arm rotation shaft 933 to detach the platen roller 920, the back support plate 940 also moves toward the thermal head 910. As a result, the coil spring 950 contracts, and the restoring force of the coil spring 950 increases. When the restoring force of the coil spring 950 increases, a strong force is applied to the thermal head 910 and a strong force is also applied to the platen roller 920 that is about to be detached. Such a strong force applied to the thermal head 910 and the platen roller 920 may deform and damage the thermal head 910 and the platen roller 920, and reduce their life.

<Printer>

Next, a printer 100C according to a sixth embodiment is described.

Figure 70:
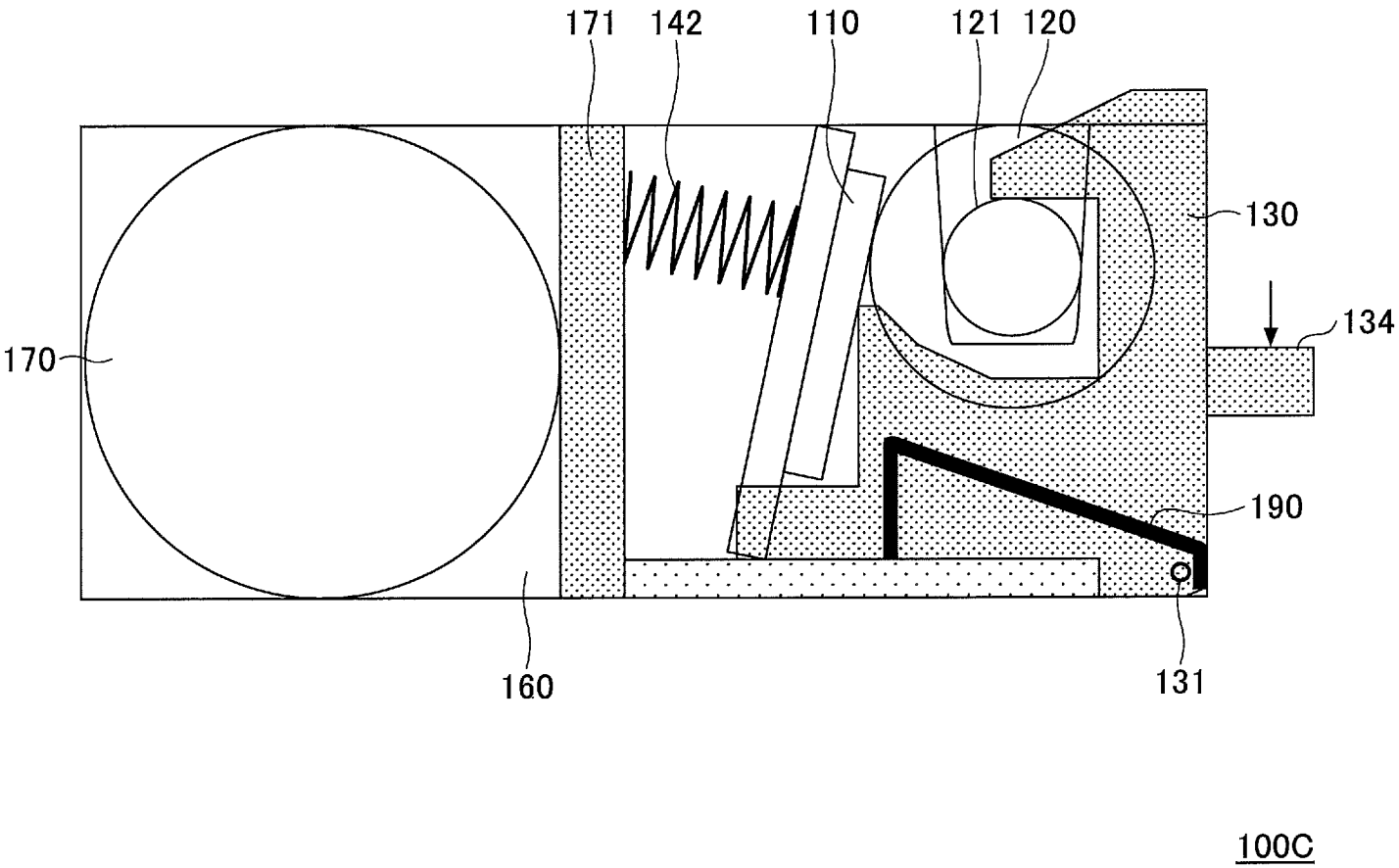
FIG. 70 is a drawing illustrating a printer of an embodiment.

As illustrated by FIG. 70, the printer 100C of the present embodiment includes a thermal head 110 used as a print head, a platen roller 120, an open-close arm 130, a coil spring 142, a frame 160, a recording paper guide 190 for guiding recording paper (not shown), and a motor 170 for feeding the recording paper. The open-close arm 130 includes an open-close arm operation part 134. A platen bearing 121 of the platen roller 120 is supported by the frame 160 and the open-close arm 130. In the present embodiment, a heat sink is attached to the thermal head 110. Accordingly, in the present embodiment, the thermal head 110 may indicate a thermal head or a combination of a thermal head and a heat sink attached to the thermal head.

The frame 160 includes a frame back support plate 171. The coil spring 142 is disposed between the frame back support plate 171 and the thermal head 110. That is, one end of the coil spring 142 is connected to the frame back support plate 171 and the other end of the coil spring 142 is in contact with the thermal head 110. With this configuration, the thermal head 110 is pressed by the restoring force of the coil spring 142 toward the platen roller 120. In the present embodiment, the thermal head 110 is pressed by the coil spring 142 via the heat sink attached to the thermal head 110.

Figure 71:
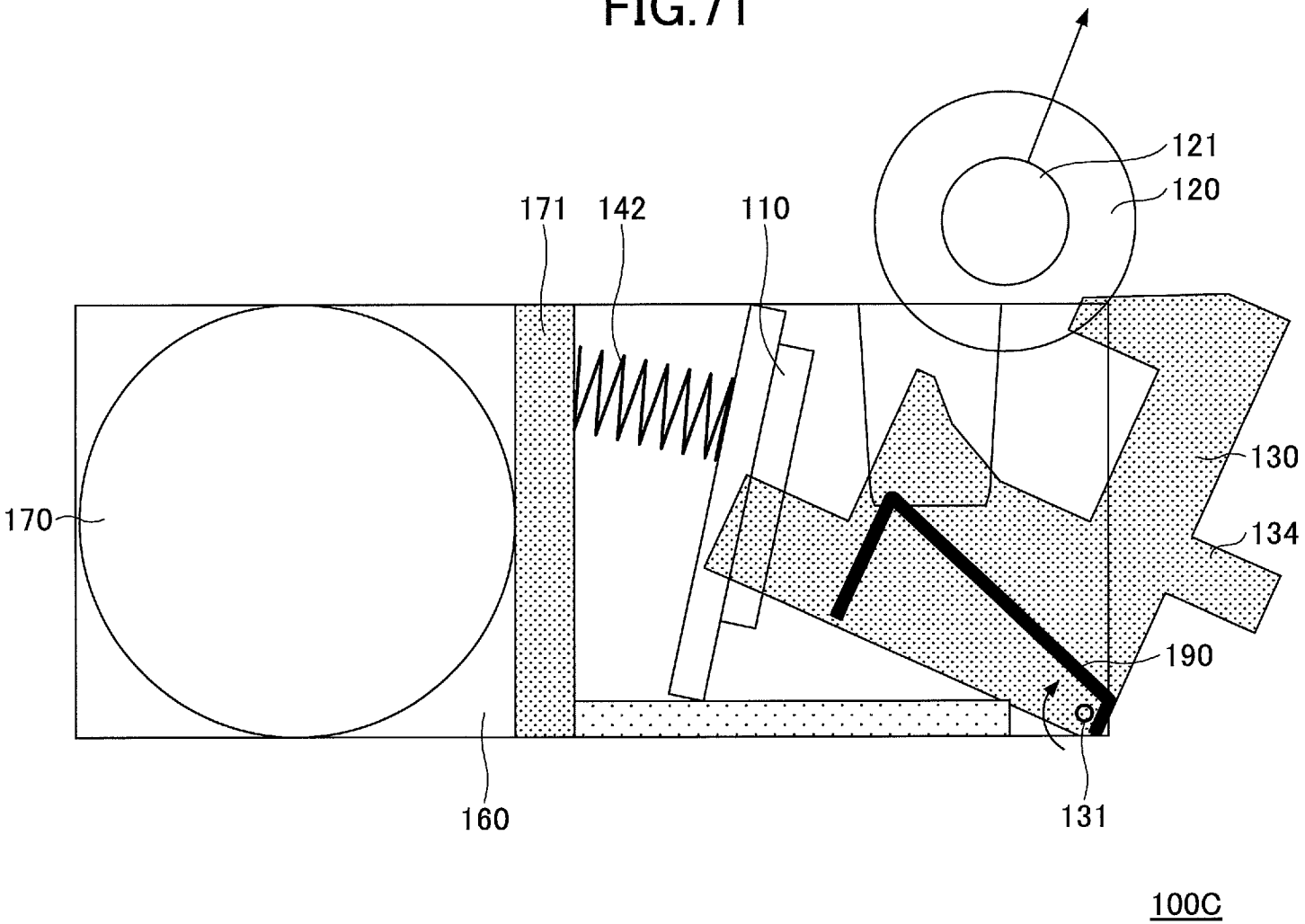
FIG. 71 is a drawing illustrating a printer of an embodiment.

The open-close arm 130 is attached to the frame (housing frame) 160 and rotatable around an arm rotation shaft 131. The open-close arm 130 can be rotated around the arm rotation shaft 131 and changed to a state illustrated by FIG. 71 by pressing the open-close arm operation part 134 of the open-close arm 130 in a direction indicated by an arrow. Thus, the platen roller 120 can by detached by rotating the open-close arm 130 supporting the platen bearing 121 of the platen roller 120 around the arm rotation shaft 131. In the printer 100C of the present embodiment, the coil spring 142 may be replaced by a different type of spring such as a plate spring. Also, the frame 160 includes a structure (not shown) that holds the thermal head 110 in a predetermined position when the platen roller 120 is detached.

Because the frame back support part 171 is a part of the frame 160, the frame back support plate 171 does not move even when the open-close arm 130 is rotated around the arm rotation shaft 131 to detach the platen roller 120. Therefore, the coil spring 142 barely contracts or expands even when the platen roller 120 is detached, and the force applied to the thermal head 110 is almost constant. That is, according to the present embodiment, the position of the thermal head 110 is caused to move only slightly by the restoring force of the coil spring 142, and the force applied by the coil spring 142 to the thermal head 110 barely changes. This configuration prevents strong stress from being applied to the thermal head 110 and the platen roller 120, and prevents deformation of the thermal head 110 and the platen roller 120. This in turn makes it possible to prevent damage to the thermal head 110 and the platen roller 120, and lengthen their life.

Also in the present embodiment, the open-close arm 130 and the recording paper guide 190 are combined as a single component. Therefore, when the open-close arm 130 is rotated around the arm rotation shaft 131, the recording paper guide 190 also moves together with the arm rotation shaft 131. The open-close arm 130 and the recording paper guide 190 of the present embodiment may be formed as a monolithic part by pressing, or may be joined after forming them as separate parts. For example, the open-close arm 130 and the recording paper guide 190 may be joined after forming the open-close arm 130 by pressing and forming the recording paper guide 190 by molding. Also, the open-close arm 130 may be formed by pressing and then combined with the recording paper guide 190 by insert molding.

When attaching the detached platen roller 120 to the printer 100C again, a force is applied to the open-close arm operation part 134 in a direction opposite to the direction of the arrow in FIG. 70 to bring the open-close arm 130 to the position illustrated in FIG. 70. Through this process, the platen roller 120 can be attached again to the printer 100C.

Seventh Embodiment

Next, a seventh embodiment is described. In the seventh embodiment, a sensor is provided to detect whether the open-close arm 130 is open or closed. The seventh embodiment is described with reference to FIGS. 72 and 73.

A printer 100D of the present embodiment includes a first optical sensor 281 and a second optical sensor 282.

The first optical sensor 281 and the second optical sensor 282 are reflective optical sensors. The first optical sensor 281 is disposed inside of the recording paper guide 190. The first optical sensor 281 emits light through an opening (not shown) of the recording paper guide 190 toward a position where recording paper 210 is placed, and detects the presence or absence of the recording paper 210.

Figure 72:
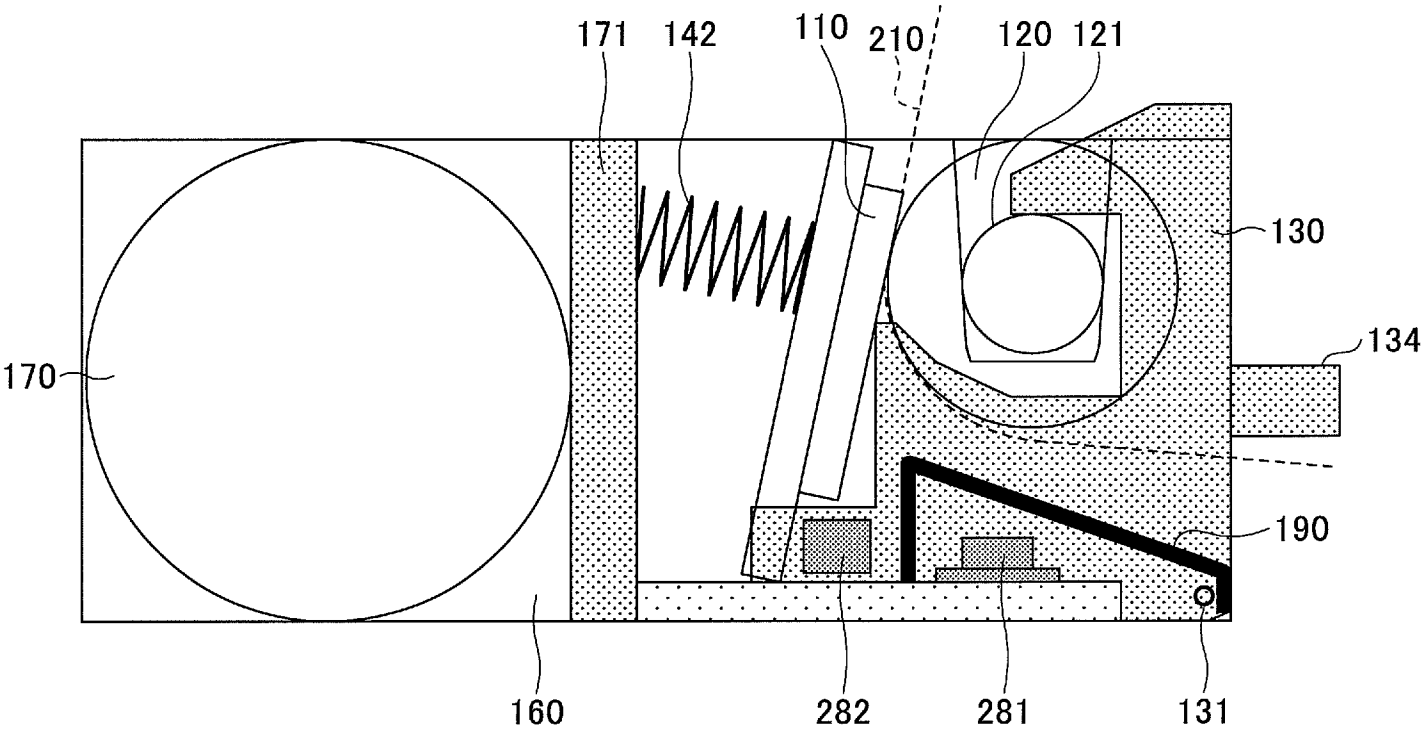
FIG. 72 is a drawing illustrating a printer of an embodiment.
Figure 73:
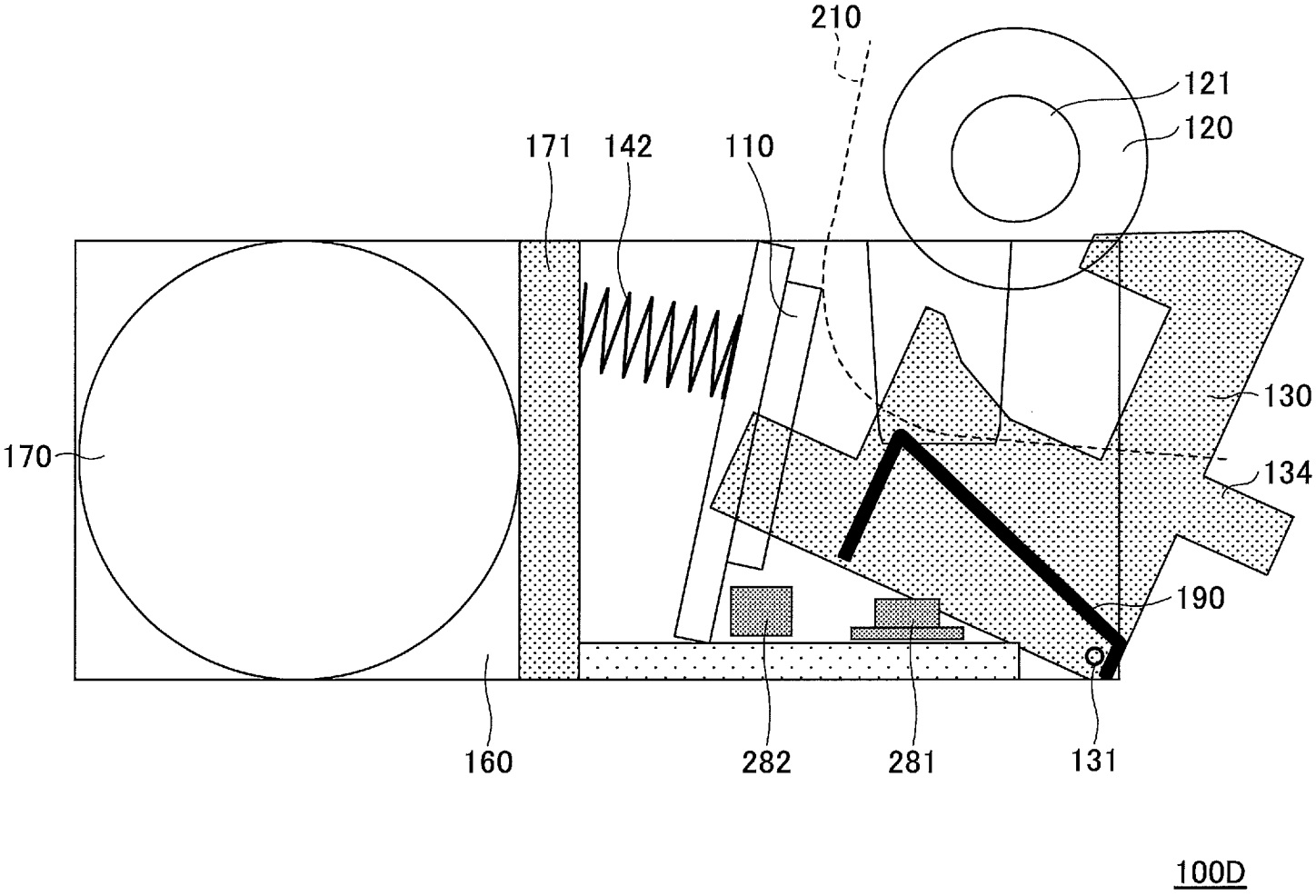
FIG. 73 is a drawing illustrating a printer of an embodiment.

The second optical sensor 282 is disposed outside of the recording paper guide 190. The second optical sensor 282 emits light in a direction that is substantially perpendicular to the plane of FIGS. 72 and 73, i.e., toward a side where the open-close arm 130 is provided, and detects whether the open-close arm 130 is open or closed. For example, when the open-close arm 130 is closed as illustrated in FIG. 72, the light emitted from the second optical sensor 282 is reflected by the open-close arm 130, and the reflected light is detected by the second optical sensor 282. When the reflected light is detected, it is determined that the open-close arm 130 is closed. On the other hand, when the open-close arm 130 is open as illustrated in FIG. 73, the light emitted from the second optical sensor 282 is not reflected by the open-close arm 130 and goes straight. In this case, reflected light is not detected by the second optical sensor 282. When reflected light is not detected, it is determined that the open-close arm 130 is open.

In the printer 100D of the present embodiment, the open-close arm 130 and the recording guide 190 are combined as a single component. Therefore, the second optical sensor 282 may be configured to emit light to the right in FIGS. 72 and 73, i.e., toward a position where the recording paper guide 190 is provided. In this case, whether the open-close arm 130 is open or closed is determined based on whether the recording paper guide 190 is detected. For example, when the open-close arm 130 is closed, the light emitted from the second optical sensor 282 is reflected by the recording paper guide 190, and the reflected light is detected by the second optical sensor 282. When the reflected light is detected, i.e., the recording paper guide 190 is detected, it is determined that the open-close arm 130 is closed. On the other hand, when the open-close arm 130 is open, the light emitted from the second optical sensor 282 is not reflected by the recording paper guide 190 and goes straight. In this case, reflected light is not detected by the second optical sensor 282. When reflected light is not detected, i.e., the recording paper guide 190 is not detected, it is determined that the open-close arm 130 is open.

Configurations of the printer 100D of the seventh embodiment other than those described above are substantially the same as the sixth embodiment.

Eighth Embodiment

Figure 74:
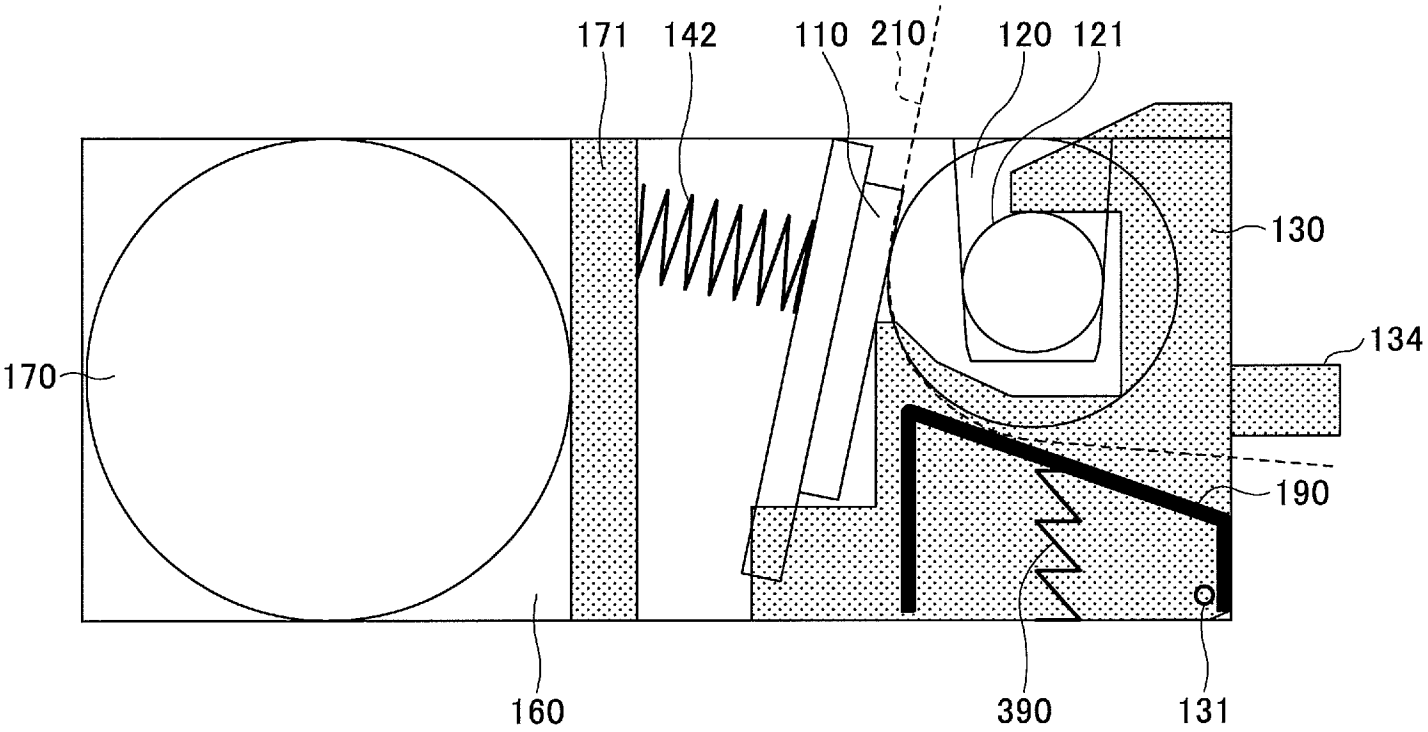
FIG. 74 is a drawing illustrating a configuration of a printer of an embodiment.

Next, an eighth embodiment is described. As illustrated by FIG. 74, a printer 100E of the eighth embodiment includes a spring 390 (an example of a third biasing part) that is disposed below the recording paper guide 190 and applies a force to the recording paper guide 190 in a direction toward the platen roller 120. Applying a force to the recording paper guide 190 in a direction toward the platen roller 120 makes it possible to sandwich the recording paper 210 between the recording paper guide 190 and the platen roller 120, and makes it possible to increase the conveying force for conveying the recording paper 210. Although the spring 390 is used in the present embodiment, any other biasing part may be used to bias the recording paper guide 190 toward the platen roller 120.

Figure 75:
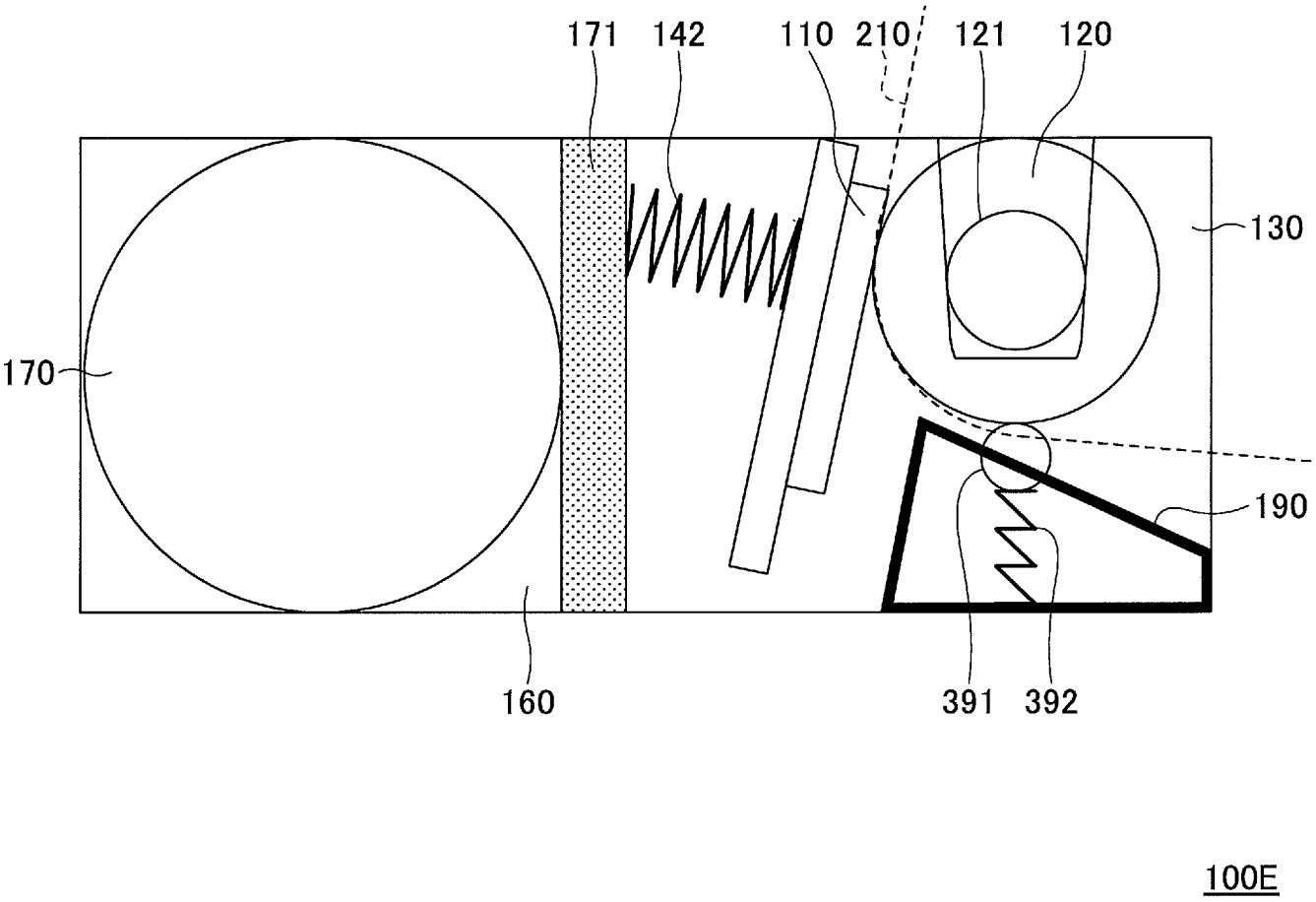
FIG. 75 is a drawing illustrating a configuration of a printer of an embodiment.

Also in the present embodiment, as illustrated by FIG. 75, the printer 100E may include a pinch roller 391 that is in contact with the platen roller 120 and disposed near the recording paper guide 190, and a spring 392 that biases the pinch roller 391 toward the platen roller 120. This configuration makes it possible to prevent friction between the recording paper 210 and the recording paper guide 190, and makes it possible to smoothly convey the recording paper 210 with an increased conveying force.

Configurations of the printer 100E of the eighth embodiment other than those described above are substantially the same as the sixth or seventh embodiment.

In the printer 100 of the present embodiment, the first bias spring(s) 140 is disposed between the frame back part 162 of the frame 160 and the thermal head 110, and the thermal head 110 is biased by the first bias spring 140 toward the platen roller 120 relative to the frame back part 162. With this configuration, even when the open-close arm 130 is rotated to attach or detach the platen roller 120, the first spring 140 is not influenced by the open-close arm 130 and is barely expanded or contracted.

Thus, the present embodiment makes it possible to improve the life of a thermal head and a platen roller of a printer for printing information on recording paper with the thermal head, and makes it possible to improve the reliability of the printer. Also, the present embodiment makes it possible to provide a printer than can stably and accurately detect whether an open-close arm is open or closed.

Ninth embodiment

<Printer>

Next, a printer according to a ninth embodiment is described.

FIGS. 76 through 79 illustrate a configuration of a printer 100F of the present embodiment.

Figure 76:
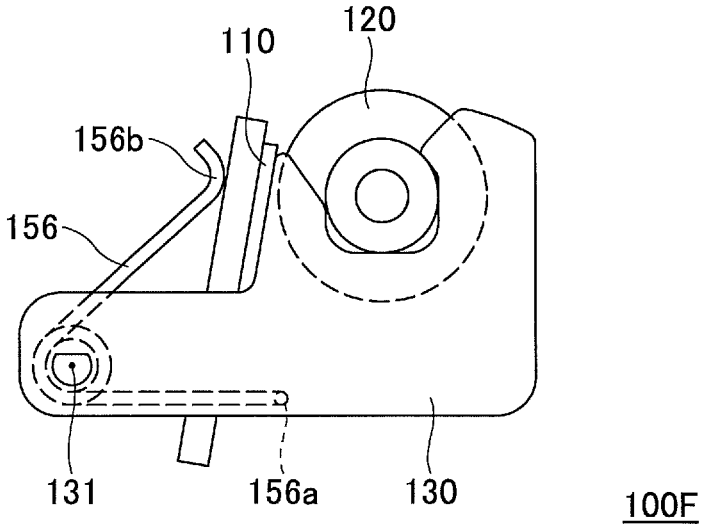
FIG. 76 is a drawing illustrating a configuration of a printer of an embodiment.
Figure 77:
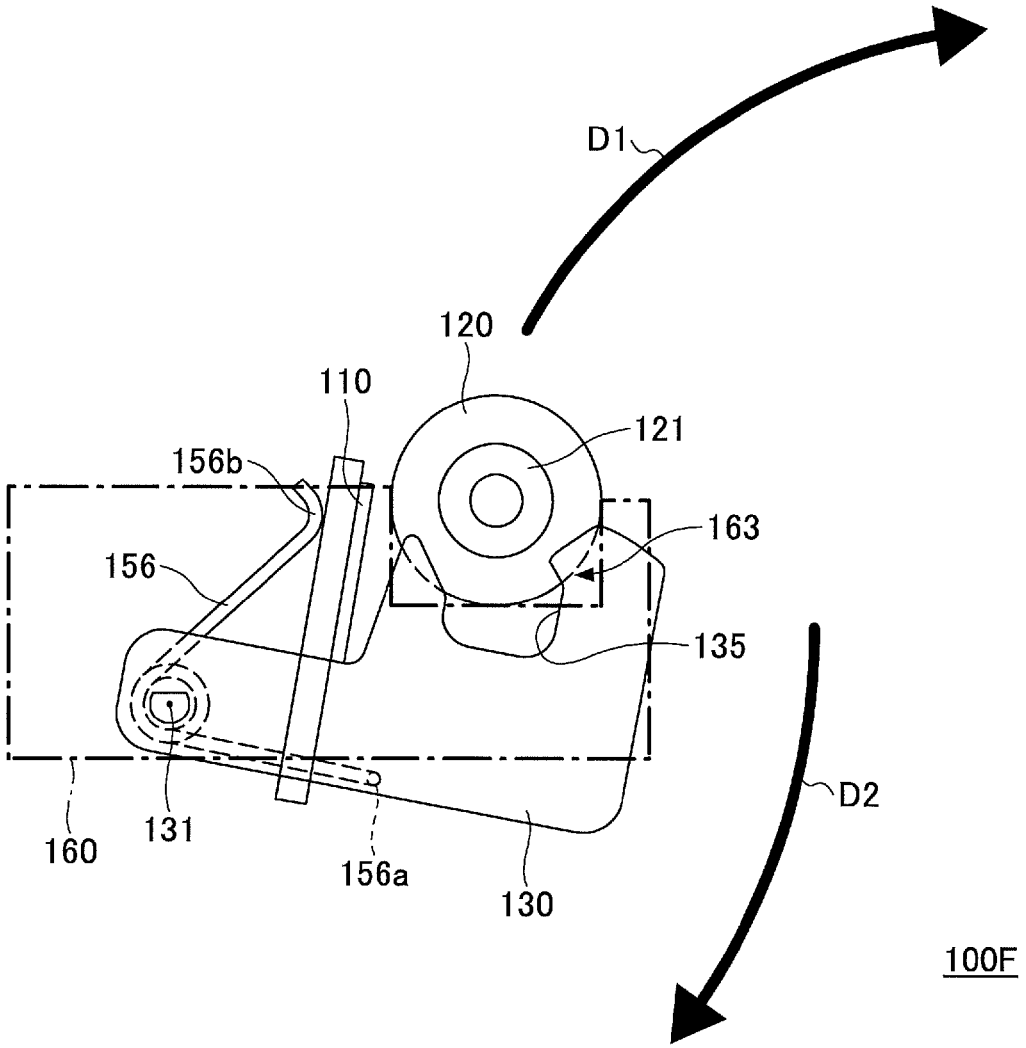
FIG. 77 is a drawing illustrating a configuration of a printer of an embodiment.

As illustrated by FIG. 76, the printer 100F of the present embodiment includes a thermal head 110 used as a print head, a platen roller 120, an open-close arm 130, and torsion coil springs (torsion springs) 156. As illustrated by FIG. 77, the open-close arm 130 rotates around an arm rotation shaft 131 relative to a frame 160.

The torsion coil spring 156 is wound around the arm rotation shaft 131. A first end 156*a* of the torsion coil spring 156 is connected and fixed to a side surface (open-close arm side part) of the open-close arm 130, and a second, end 156*b* of the torsion coil spring 156 is in contact with a back surface of the thermal head 110 and presses the thermal head 110 toward the platen roller 120.

In the present embodiment, the platen roller 120 can be detached by rotating the open-close arm 130 around the arm rotation shaft 131 in a direction indicated by an arrow D2.

The frame 160 includes a frame opening 163 for supporting the platen roller 120. Therefore, even when the open-close arm 130 is rotated, the platen roller 120 is held in the frame opening 163 of the frame 160. After the open-close arm 130 is rotated, the platen roller 120 can be detached in a direction indicated by an arrow D1.

In the present embodiment, a heat sink is attached to the thermal head 110. The thermal head 110 may also indicate a combination of a thermal head and a heat sink.

Figure 78:
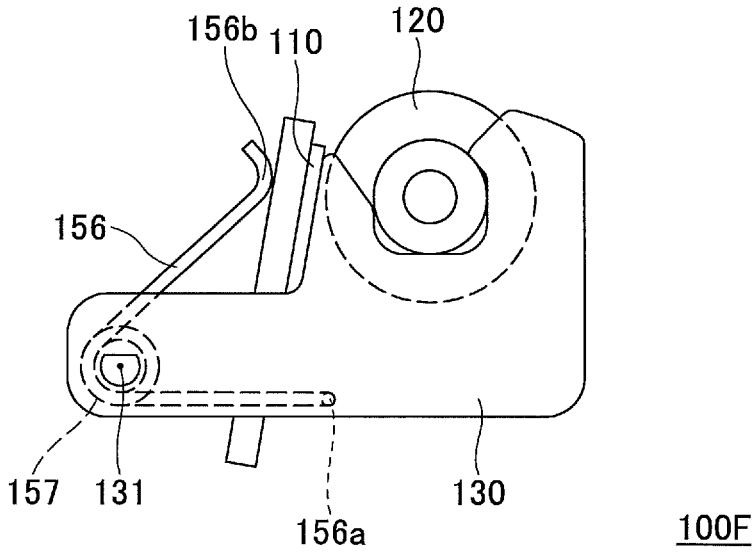
FIG. 78 is a drawing illustrating a printer of an embodiment.
Figure 79:
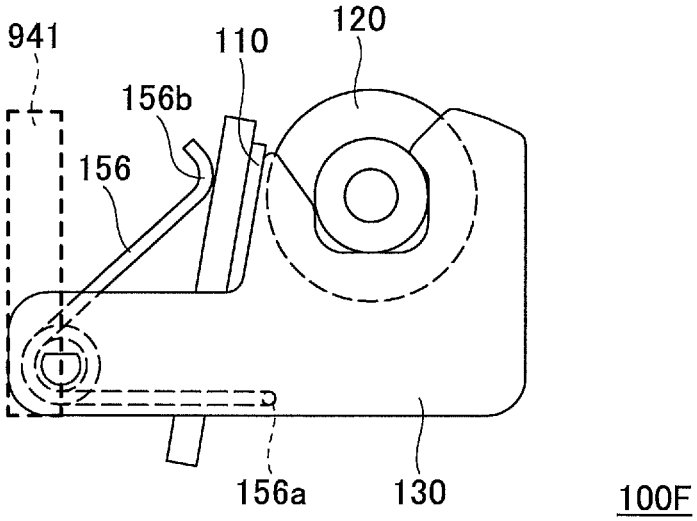
FIG. 79 is a drawing illustrating a printer of an embodiment.

As illustrated by FIG. 78, the torsion coil spring 156 is wound around the arm rotation shaft 131, and a fulcrum 157 of the torsion coil spring 156 is located in a lower part of the open-close arm 130. As described above, in the printer 100F of the present embodiment, the first end 156*a* of the torsion coil spring 156 is fixed to the open-close arm 130, and the second end 156*b* of the torsion coil spring 156 presses the back surface of the thermal head 110 toward the platen roller 120. This configuration eliminates the need to provide a back support plate 941 illustrated by a dotted line in FIG. 79. Accordingly, this configuration makes it possible to reduce the number of components and the number of production steps, reduce the cost of a printer, and reduce the size of a printer.

Figure 80A:
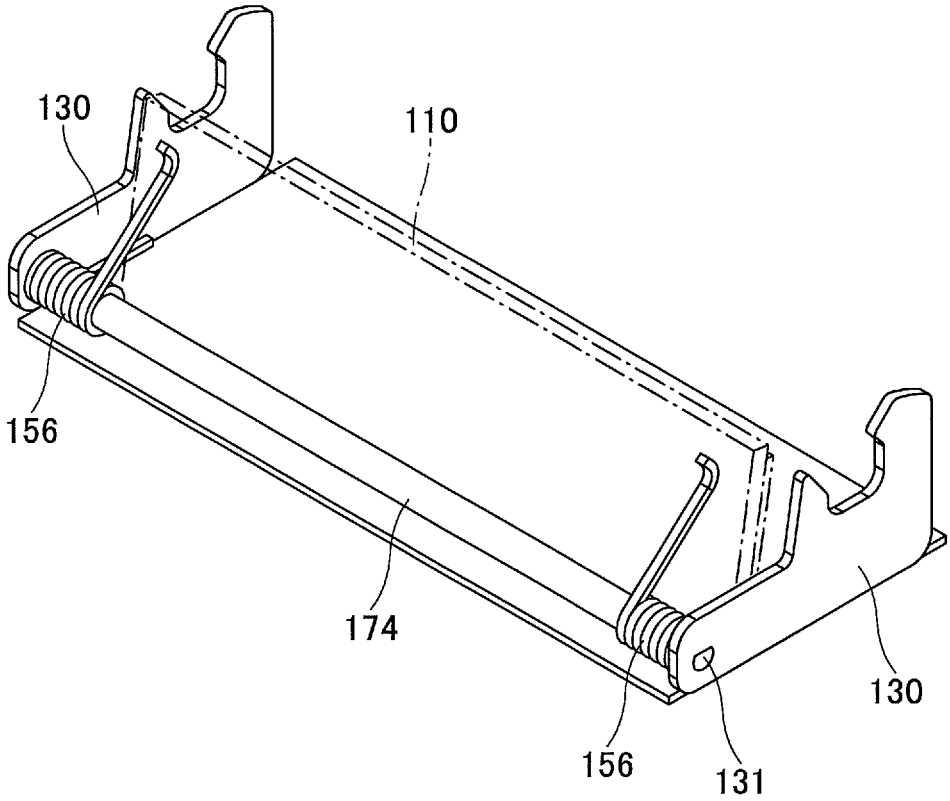
FIGS. 80A and 80B are drawings illustrating a configuration of a printer of an embodiment.
Figure 80B:
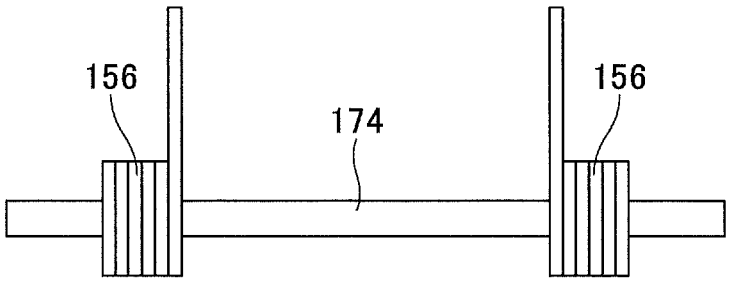

FIGS. 80A and 80B illustrate the thermal head 110 and the torsion coil springs 156 of the printer 100F of the present embodiment. FIG. 80A is a perspective view of the thermal head 110 and the torsion coil springs 156, and FIG. 80B is a drawing illustrating an arrangement of the torsion coil springs 156.

In the present embodiment, the torsion coil springs 156 are disposed near the ends of a shaft 174 that is disposed substantially parallel to the platen roller 120. The shaft 174 is attached to the open-close arm 130 and rotates around the arm rotation shaft 131. Each of the torsion coil springs 156 is wound around the outer surface of the shaft 174.

With the above configuration, the torsion coil springs 156 also cause the open-close arm 130 to return to the home position after the open-close arm 130 is rotated to detach the platen roller 120.

Figure 81A:
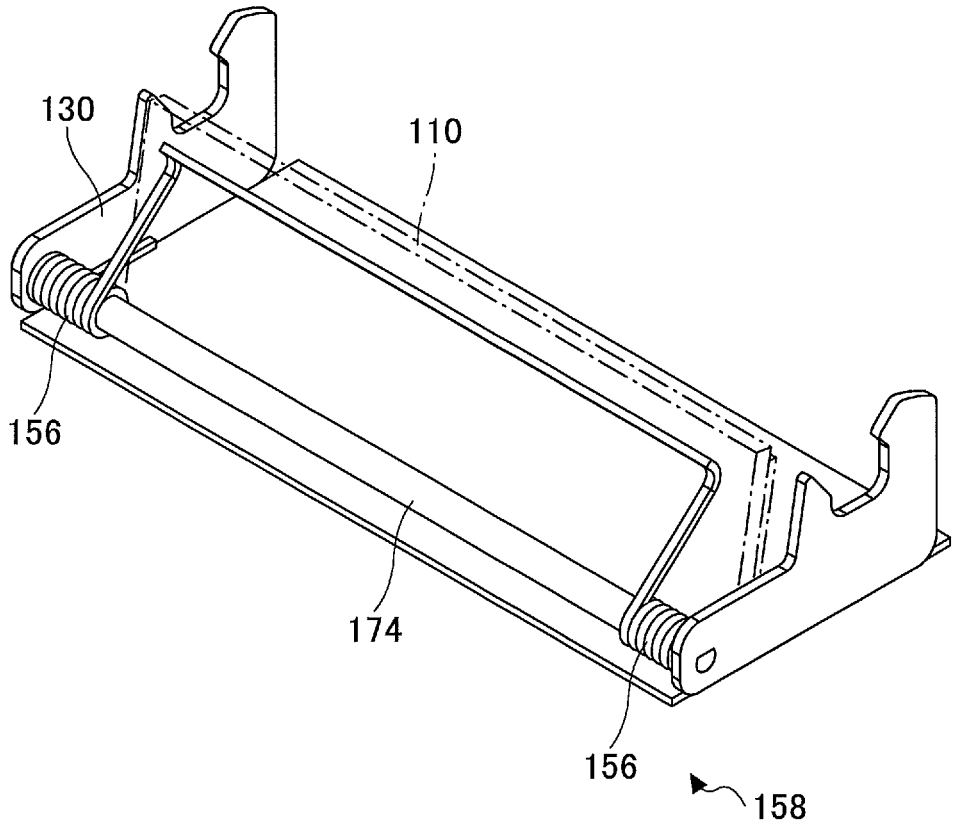
FIGS. 81A and 81B are drawings illustrating a configuration of a printer of an embodiment.
Figure 81B:
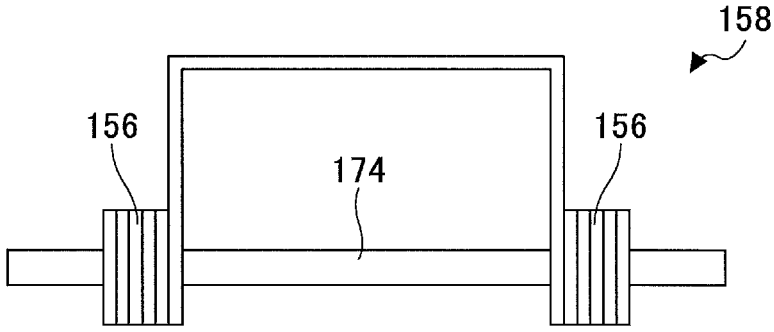

As illustrated by FIGS. 81A and 81B, the printer 100F of the present embodiment may include a torsion coil spring unit 158 formed by combining two torsion coil springs. FIG. 81A is a perspective view of the thermal head 110 and the torsion coil spring unit 158, and FIG. 81B is a drawing illustrating an arrangement of the torsion coil spring unit 158.

Figure 82:
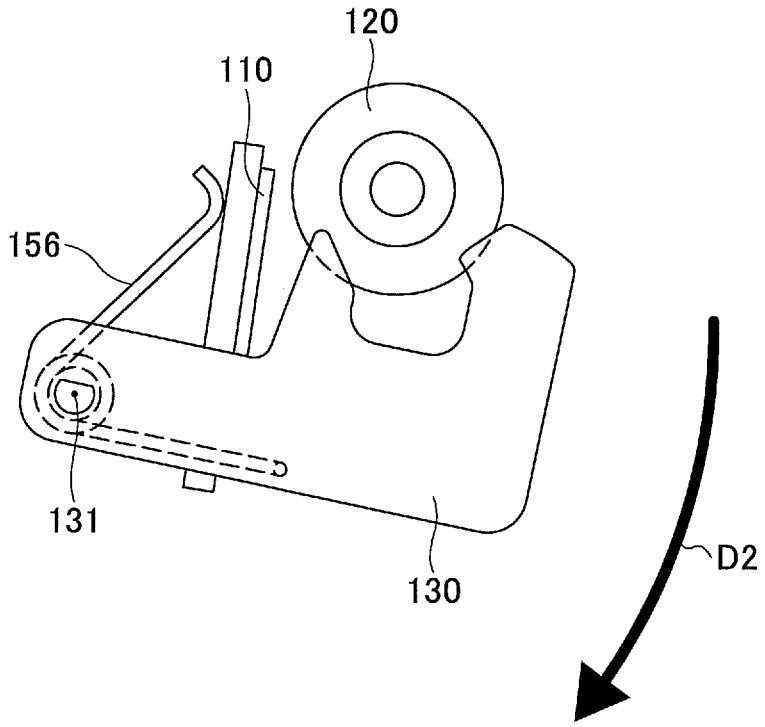
FIG. 82 is a drawing illustrating a printer of an embodiment.
Figure 83:
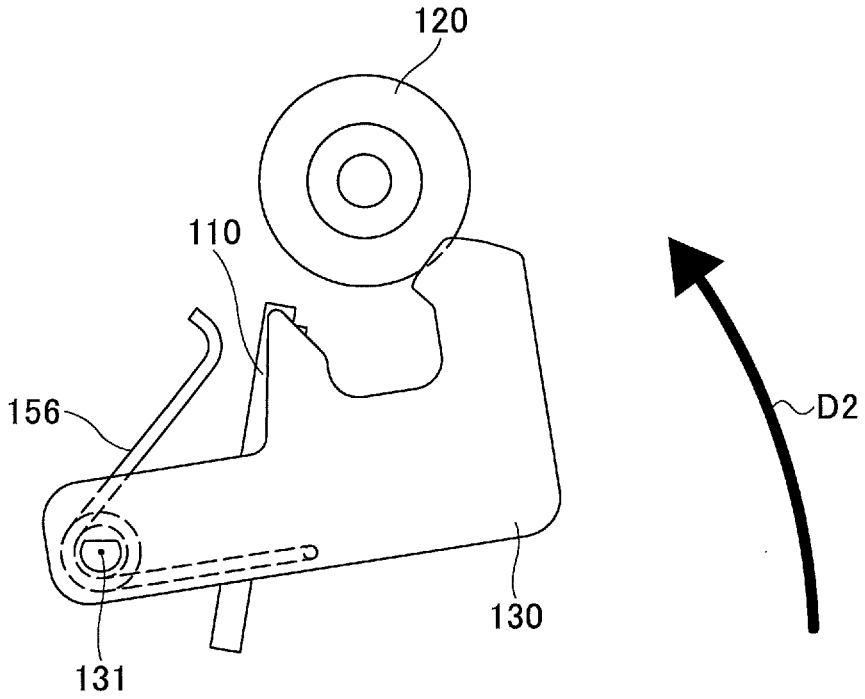
FIG. 83 is a drawing illustrating a printer of an embodiment.

In the present embodiment, the platen roller 120 can be detached from the open-close arm 130 by rotating the open-close arm 130 around the arm rotation shaft 131 in the direction indicated by the arrow D2. As illustrated by FIG. 82, the open-close arm 130 may be configured to be rotated in a direction to increase the pressure applied to the thermal head 110. Alternatively, as illustrated by FIG. 83, the open-close arm 130 may be configured to be rotated in a direction to release the pressure applied to the thermal head 110.

Figure 84A:
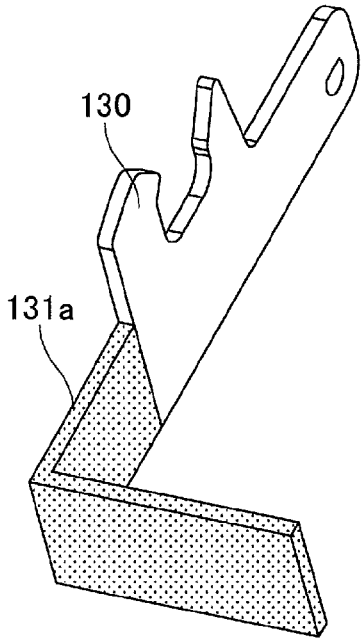
FIGS. 84A through 84C are drawings illustrating a side of an open-close arm of an embodiment.
Figure 84B:
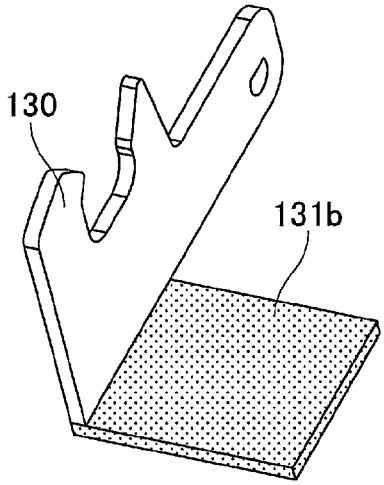
Figure 84C:
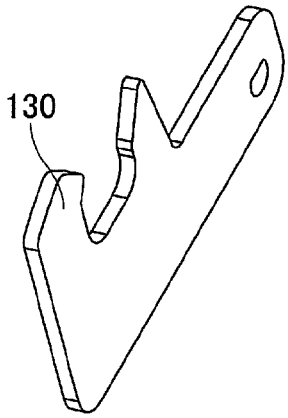

Also, as illustrated by FIG. 84A, a bent part 131*a* used as an operation part to move the open-close arm 130 may be provided on a side of the open-close arm 130. Also, as illustrated by FIG. 84B, a bent part 131*b* used as an operation part to move the open-close arm 130 may be provided below the open-close arm 130. FIG. 84C illustrates the open-close arm 130 without a bent part.

Tenth Embodiment

Next, a tenth embodiment is described. In the tenth embodiment, the torsion coil springs 156 of the ninth embodiment are replaced with a plate spring.

Figure 85:
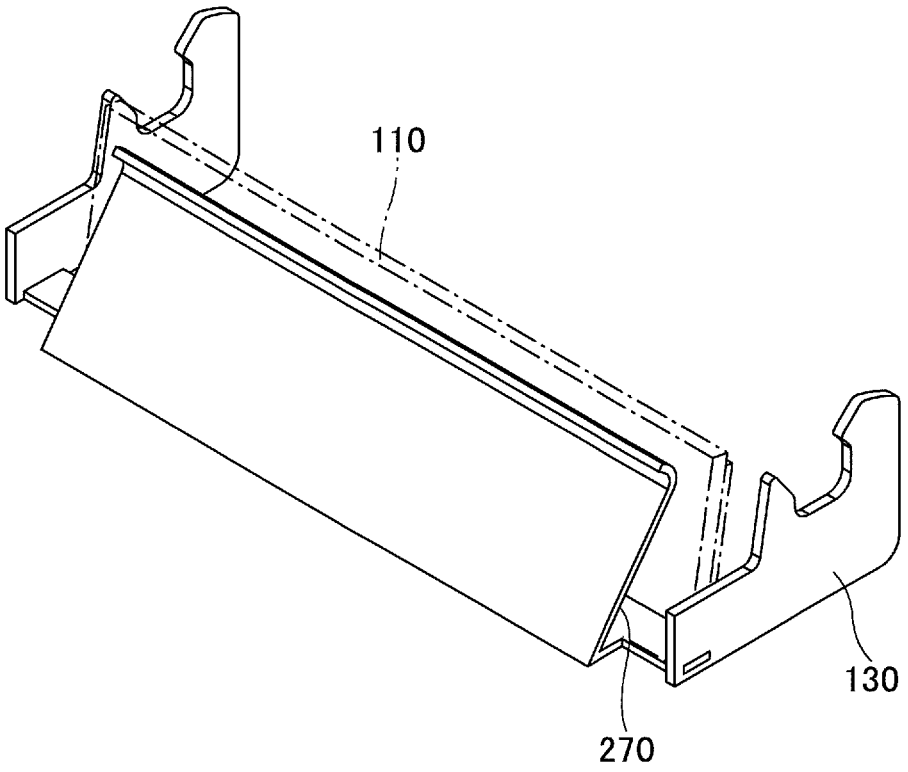
FIG. 85 is a drawing illustrating a configuration of a printer of an embodiment.

FIG. 85 is a drawing illustrating an open-close arm 130 and a plate spring 270 of a printer of the present embodiment.

The tenth embodiment is described with reference to FIG. 85. The printer of the tenth embodiment includes the plate spring 270 instead of the torsion coil springs 156 of the ninth embodiment. The plate spring 270 is in contact with a back surface of the thermal head 110 and presses the thermal head 110 toward the platen roller 120. Using the plate spring 270 makes it possible to further reduce the number of components, and makes it possible to more evenly press the back surface of the thermal head 110 toward the platen roller 120.

Figure 86:
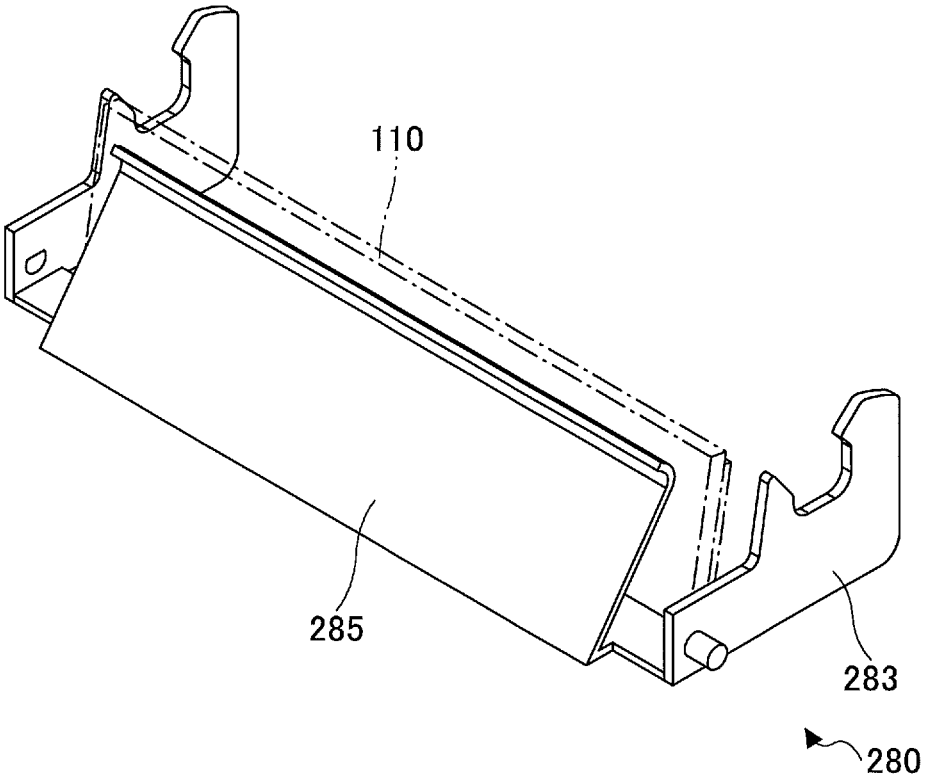
FIG. 86 is a drawing illustrating a configuration of a printer of an embodiment.

FIG. 86 is a drawing illustrating an open-close arm and a plate spring that are formed as a single component, with the same material.

As illustrated by FIG. 86, an open-close arm and a plate spring may be formed as a single component with the same metallic material having elasticity. This configuration makes it possible to further reduce the number of components. A spring-attached open-close arm 280 illustrated by FIG. 86 includes an open-close arm part 283 and a spring part 285 used as a plate spring, and may be formed, for example, by processing a metal plate. For example, the spring part 285 may be formed by bending a metal plate along a direction that is substantially parallel to a direction in which the platen roller 120 extends, and the open-close arm part 283 may be formed by bending the metal plate along a direction that is substantially perpendicular to the direction in which the platen roller 120 extends.

Figure 87:
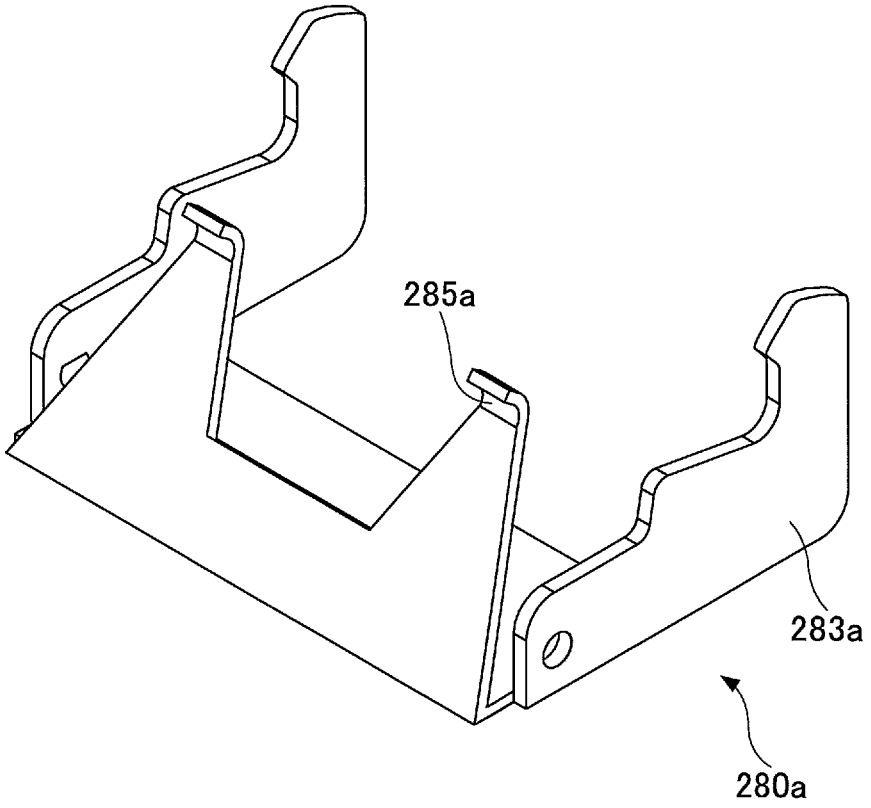
FIG. 87 is a drawing illustrating a configuration of a printer of an embodiment.

FIG. 87 illustrates a spring-attached open-close arm 280*a* according to a variation of the present embodiment. The spring-attached open-close arm 280*a* includes an open-close arm part 283*a* and a spring part 285*a* that are formed as a single component. Also in this case, the open-close arm part 283*a* and the spring part 285*a* may be formed as a single component with the same metallic material having elasticity.

Configurations of the printer of the tenth embodiment other than those described above are substantially the same as the ninth embodiment.

Eleventh Embodiment

Next, an eleventh embodiment is described.

In a printer of the eleventh embodiment, separate springs are used to press the thermal head 110 and to cause the open-close arm 130 to return to the home position.

Figure 88:
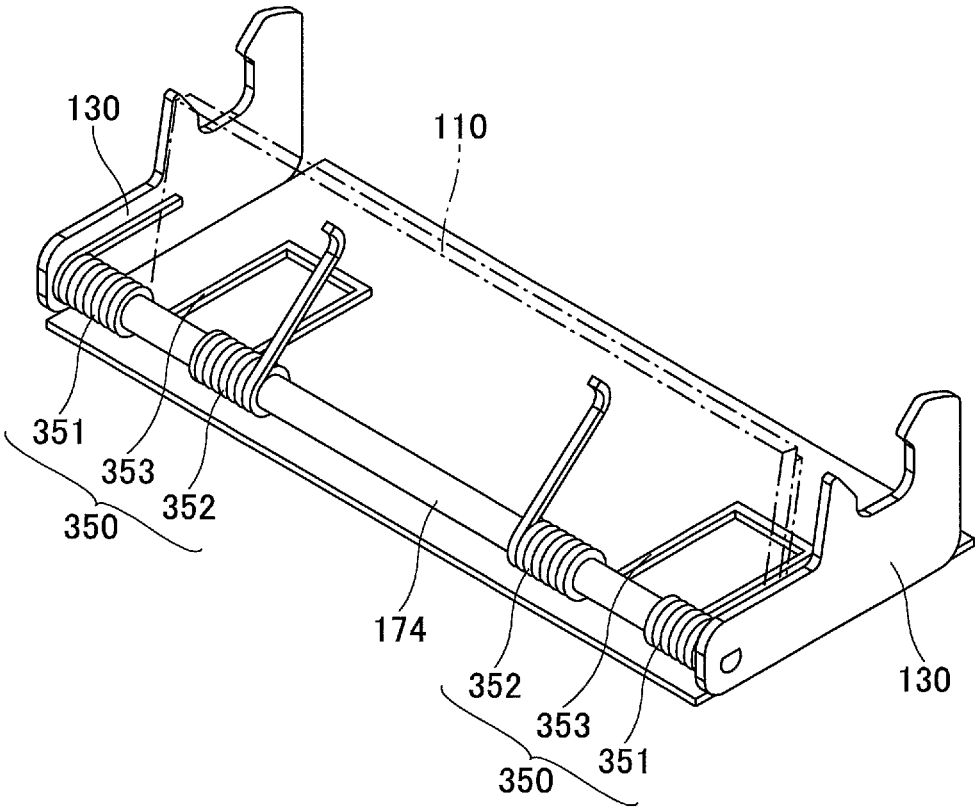
FIG. 88 is a drawing illustrating a configuration of a printer of an embodiment.
Figure 89:
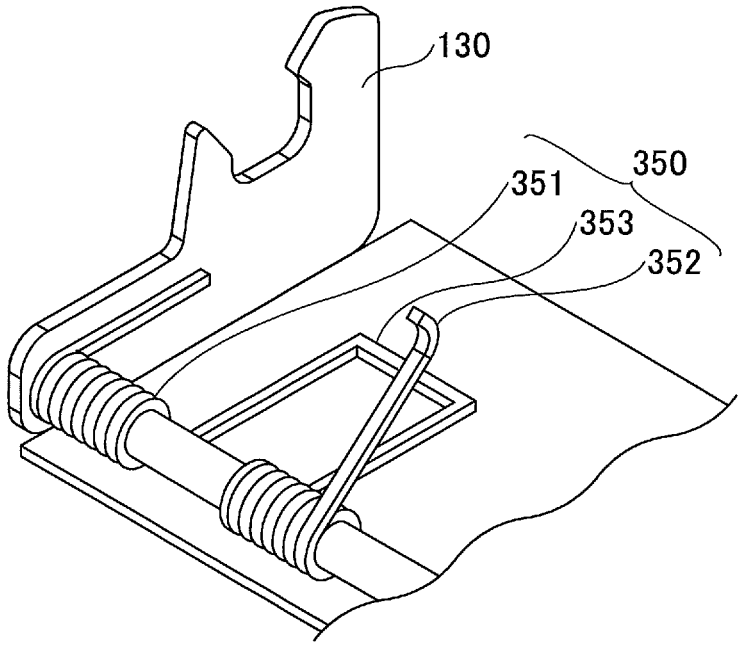
FIG. 89 is a drawing illustrating a printer of an embodiment.

As illustrated by FIGS. 88 and 89, the printer of the present embodiment includes two torsion coil springs 350 disposed at the ends of a shaft 174. Each of the torsion coil spring 350 includes an open-close arm return spring 351 and a head pressing spring 352 for pressing the thermal head 110. The open-close arm return spring 351 and the head pressing spring 352 are connected to each other by a connecting part 353 that is connected to a bottom surface of the open-close arm 130. An end of the open-close arm return spring 351 is connected to a side surface of the open-close arm 130. This configuration makes it possible to separate a function for causing the open-close arm 130 to return to the home position and a function for pressing the thermal head 110.

That is, these functions can be assigned separately to the open-close arm return spring 352 and the head pressing spring 352. The connecting part 353 may instead be connected to a bottom surface of the frame 160.

Figure 90:
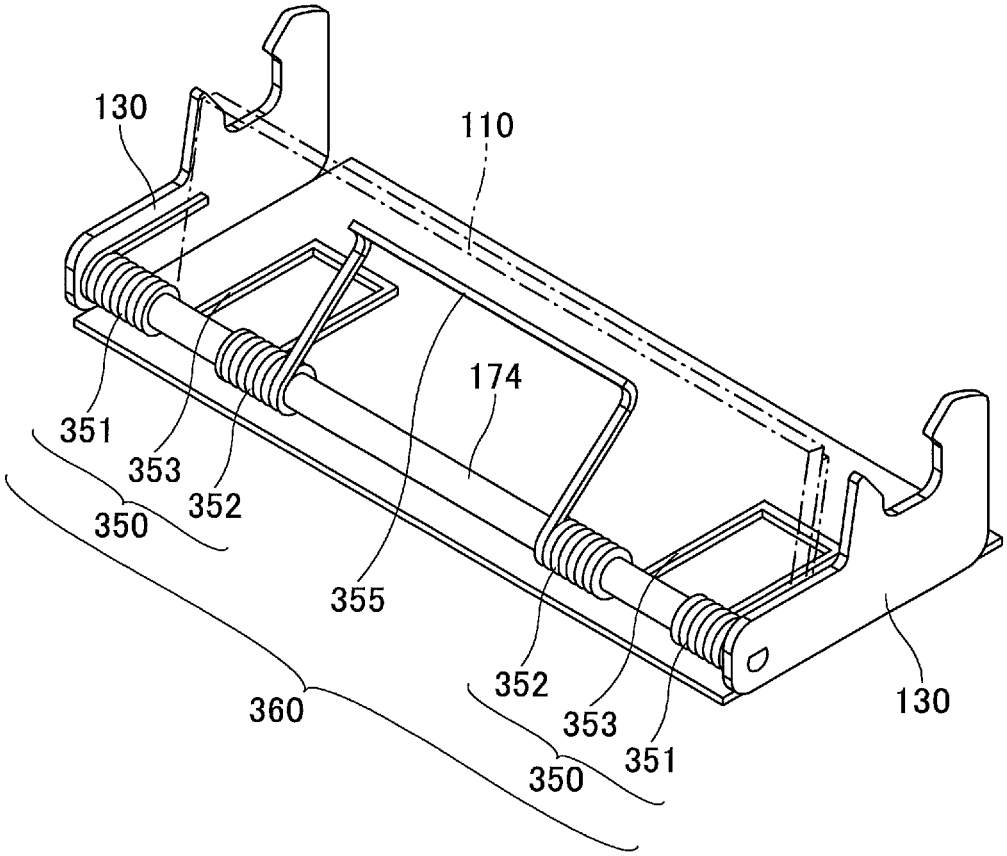
FIG. 90 is a drawing illustrating a configuration of a printer of an embodiment.
Figure 91:
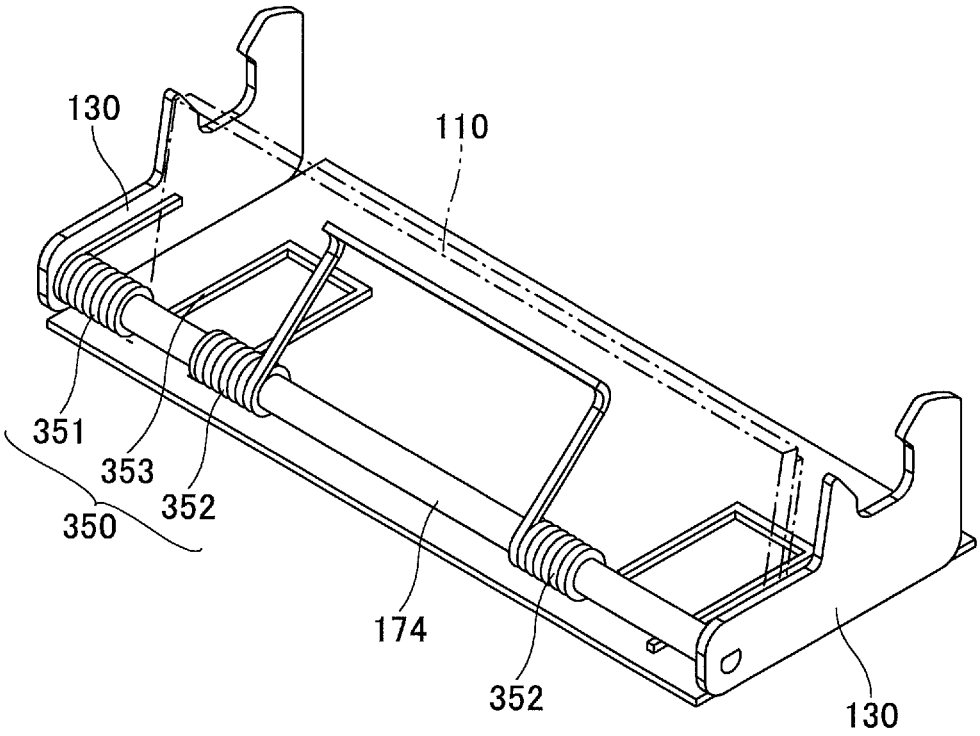
FIG. 91 is a drawing illustrating a configuration of a printer of an embodiment.

FIG. 90 illustrates a spring unit 360 according to a variation of the present embodiment. The spring unit 360 includes two torsion coil springs 350 that are connected to each other by a connecting part 355. FIG. 91 illustrates a variation of the present embodiment where the open-close arm return spring 351 is provided only at one end of the shaft 174.

Figure 92:
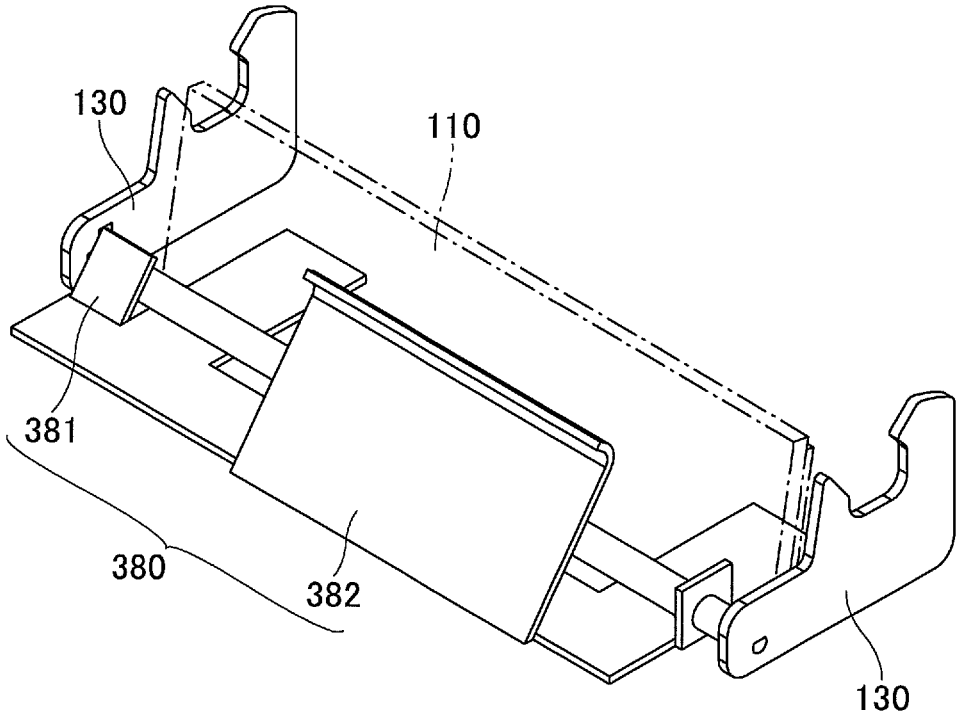
FIG. 92 is a drawing illustrating a configuration of a printer of an embodiment.

FIG. 92 illustrates still another variation of the present embodiment where a plate spring is used instead of a torsion coil spring. In FIG. 92, a plate spring unit 380 includes an open-close arm return spring 381 implemented by a plate spring and a head pressing spring 382 implemented by a plate spring.

Configurations of the printer of the eleventh embodiment other than those described above are substantially the same as the ninth or tenth embodiment.

The present embodiment makes it possible to reduce the cost and size of a printer for printing information on recording paper using, for example, a thermal head.

The present invention also includes embodiments described below.

An embodiment of the present invention provides a printer including a print head that performs printing on recording paper, an open-close arm that is supported to be rotatable around an arm rotation shaft relative to a frame, a platen roller that is in contact with and held by the frame and the open-close arm, a first bias spring that is disposed between the frame and the print head and presses the print head toward the platen roller, and a second bias spring that is in contact with the frame and the open-close arm and moves the platen roller toward the print head.

In the printer, the first bias spring may be implemented by a coil spring, and the second bias spring may be implemented by a torsion coil spring.

The printer may be configured such that a first end of the second bias spring is connected to the frame, a second end of the second bias spring is in contact with the open-close arm, and a distance between the arm rotation shaft and a position at which the second end of the second bias spring contacts the open-close arm is greater than a distance between the arm rotation shaft and the first bias spring.

The printer may be configured such that the open-close arm includes an open-close arm opening in which a platen bearing of the platen roller is placed, the frame includes a frame opening in which the platen bearing is placed, the platen bearing is in contact with the open-close arm at a contact part forming an edge of the open-close arm opening, and the contact part is perpendicular to a direction in which a force of the first bias spring acts and is located across a line, which passes through the center of the platen bearing, from a side where the first bias spring is provided.

The printer may be configured such that the open-close arm includes an open-close arm opening in which a platen bearing of the platen roller is placed, the frame includes a frame opening in which the platen bearing is placed, the platen bearing is in contact with the open-close arm at a contact part forming an edge of the open-close arm opening, and the contact part is located on an extension line that connects the center of the arm rotation shaft and the center of the platen bearing.

The printer may be configured such that the contact part forms a part of an arc around the center of the arm rotation shaft.

The printer may be configured such that the contact part is a part of a lock part of the open-close arm, and the lock part extends across the extension line connecting the center of the arm rotation shaft and the center of the platen bearing into a side where the first bias spring is provided.

The printer may be configured such that the contact part is a part of a lock part of the open-close arm, and the lock part does not extend across the extension line connecting the center of the arm rotation shaft and the center of the platen bearing into a side where the first bias spring is provided.

The printer may be configured such that the open-close arm includes a pushing part that pushes the platen bearing out of the open-close arm opening when the open-close arm is rotated around the arm rotation shaft.

The printer may be configured such that the open-close arm includes two open-close arm side parts each including the open-close arm opening, an open-close arm back part that connects the open-close arm side parts, and the open-close arm side parts and the open-close arm back part are formed as a single component.

The printer may be configured such that each of the open-close arm side parts includes an opening in which the print head or a support part for supporting the print head is placed.

The printer may further include a sensor that is disposed near the open-close arm back part and detects a rotational state of the open-close arm.

The printer may be configured such that the frame opening includes an edge whose shape is substantially the same as a part of the outer shape of the platen bearing.

The printer may be configured such that when a line that is perpendicular to a direction in which a force of the first bias spring acts and that passes through the center of the platen bearing is defined, the platen bearing is in contact with an edge of the frame opening on a side of the line where the first bias spring is provided.

The printer may be configured such that when a line that is perpendicular to a direction in which a force of the first bias spring acts and that passes through the center of the platen bearing is defined, on a side of the line where the first bias spring is provided, an edge of the frame opening is closer to the platen bearing than an edge of the open-close arm opening other than the contact part.

The printer may be configured such that the frame opening includes an upper opening edge and a lower opening edge near the ends of the frame opening, and the upper opening edge is located between a line that is perpendicular to a direction in which a force of the first bias spring acts and that passes through the center of the platen bearing and a line that is perpendicular to the direction in which the force of the first bias spring acts and that touches the platen bearing on a side where the first bias spring is provided.

The printer may be configured such that the frame opening includes an upper opening edge and a lower opening edge near the ends of the frame opening, and the lower opening edge is located between a line that is parallel to a direction in which a force of the first bias spring acts and that touches the platen bearing on a side where the arm rotation shaft is provided and an extension line connecting the center of the arm rotation shaft and the center of the platen bearing.

The printer may be configured such that the open-close arm includes a protrusion that touches a frame bottom part of the frame when the open-close arm is rotated around the arm rotation shaft and stops the rotation of the open-close arm at a predetermined position.

The printer may further include a recording paper guide that guides recording paper toward the print head. The recording paper guide includes guide parts that are provided at the ends of the recording paper guide along the print head and extend toward the print head.

The printer may further include a recording paper guide that guides recording paper toward the print head. The recording paper guide includes a support part that supports the print head or a head support plate connected to the print head, and is disposed on a surface of the recording paper guide that is opposite to a surface of the recording paper guide for guiding the recording paper.

Another embodiment of the present invention provides a printer including a print head that performs printing on recording paper, an open-close arm that is supported to be rotatable around an arm rotation shaft relative to a frame, a platen roller that is in contact with and held by the frame and the open-close arm, a first bias spring that is disposed between the frame and the print head and presses the print head toward the platen roller, and a second bias spring that is in contact with the frame and the open-close arm and moves the platen roller toward the print head. When the platen roller is not held by the frame and the open-close arm, the open-close arm is in a third state that occurs during the transition of the open-close arm from a first state where the platen roller is held to a second state where the open-close arm is rotated to detach the platen roller. The printer may be configured such that the third state is the same as the second state.

The printer may further include a detection unit that detects the position of the open-close arm.

The printer may be configured such that when the detection unit detects that the open-close arm is in one of the second state and the third state, printing on the recording paper by the print head is not performed.

In the printer, the first bias spring may be implemented by a coil spring, and the second bias spring may be implemented by a torsion coil spring.

Another embodiment of the present invention provides a printer including a print head that performs printing on recording paper, a platen roller supported by a frame, and a bias spring that is disposed between the frame and the print head and presses the print head toward the platen roller. The platen roller is held onto the frame by a restoring force of the bias spring that is applied to the platen roller via the print head.

The printer may further include an open-close arm that is supported to be rotatable around an arm rotation shaft relative to the frame. When the open-close arm is rotated around the arm rotation shaft, the open-close arm presses the platen roller to detach the platen roller from the frame.

The printer may be configured such that the frame includes a frame opening in which a platen bearing of the platen roller is placed, and a direction of a tangent of a contact point between an edge of the frame opening and the platen bearing is substantially perpendicular to a direction in which the restoring force of the bias spring acts.

The printer may be configured such that the platen roller rotates in a direction from the contact point between the edge of the frame opening and the platen bearing toward an entry of the frame opening.

Another embodiment of the present invention provides a printer including a print head that performs printing on recording paper, a spring that presses the print head toward a platen roller, and an open-close arm that rotatably supports the platen roller. The open-close arm is attached to a housing frame and rotatable around an arm rotation shaft. The housing frame includes a frame back support plate, one end of the spring is in contact with the frame back support plate and another end of the spring is in contact with the print head.

The printer may also include a paper guide that is disposed near the platen roller and guides the recording paper. The paper guide and the open-close arm are formed as a single component.

The printer may also include a sensor that detects whether the open-close arm is open or closed. The sensor is an optical sensor and detects the paper guide to determine whether the open-close arm is open or closed.

The printer may also include a sensor that detects whether the open-close arm is open or closed. The sensor is an optical sensor and detects the open-close arm to determine whether the open-close arm is open or closed.

The printer may be configured such that the paper guide is biased by a biasing part toward the platen roller.

In the printer, the biasing part may be a spring.

Another embodiment of the present invention provides a printer including a print head that performs printing on recording paper, a torsion coil spring that presses the print head toward a platen roller, and an open-close arm that rotatably supports the platen roller. The torsion coil spring is wound in a direction that is substantially parallel to a direction in which the platen roller extends. One end of the torsion coil spring is connected to the open-close arm, and another end of the torsion coil spring is in contact with the print head.

The printer may also include a shaft that extends substantially parallel to the platen roller. The torsion coil spring is wound around the outer surface of the shaft.

The printer may include two torsion coil springs that are disposed near the ends of the shaft.

In the printer, the two torsion coil springs may be connected to each other and formed as a single component.

In the printer, the torsion coil spring includes an open-close arm return spring that causes the open-close arm to return to the home position and a head pressing spring that presses the print head.

Another embodiment of the present invention provides a printer including a print head that performs printing on recording paper, a plate spring that presses the print head toward a platen roller, and an open-close arm that rotatably supports the platen roller. The plate spring is connected to the open-close arm.

In the printer, the open-close arm and the plate spring are formed with the same material having elasticity.

In the printer, the plate spring is formed by bending a material forming the open-close arm along a direction that is substantially parallel to a direction in which the platen roller extends.

In the printer, the plate spring includes an open-close arm return spring that causes the open-close arm to return to the home position and a head pressing spring that presses the print head.

In the printer, the platen roller includes a platen bearing, the open-close arm includes an open-close arm opening whose edge is in contact with the platen bearing of the platen roller and presses the platen roller with the restoring force of the second bias spring toward the print head, and a contact part of the edge of the open-close arm opening which contacts the platen bearing is located on an extension line that connects the center of the arm rotation shaft and the center of the platen bearing.

In the printer, the contact part forms a part of an arc around the center of the arm rotation shaft.

In the printer, the open-close arm also includes a lock part that extends across the extension line connecting the center of the arm rotation shaft and the center of the platen bearing into a side where the first bias spring is provided. The contact part of the edge of the open-close arm opening that contacts the platen bearing is a part of the lock part of the open-close arm.

In the printer, the open-close arm also includes a lock part that does not extend across the extension line connecting the center of the arm rotation shaft and the center of the platen bearing into a side where the first bias spring is provided. The contact part of the edge of the open-close arm opening that contacts the platen bearing is a part of the lock part of the open-close arm.

In the printer, the platen roller includes a platen bearing, and the open-close arm includes a platen detaching part disposed between the print head and the platen bearing of the platen roller. When the open-close arm is rotated around the arm rotation shaft relative to the frame, the platen detaching part moves the platen bearing away from the print head and pushes the platen bearing out of the open-close arm opening.

In the printer, the frame opening includes an edge whose shape is substantially the same as a part of the outer shape of the platen bearing.

In the printer, when a line that is perpendicular to a direction in which a force of the first bias spring acts and that passes through the center of the platen bearing is defined, on a side of the line where the first bias spring is provided, an edge of the frame opening is closer to the platen bearing than an edge of the open-close arm opening other than the contact part.

In the printer, the frame opening includes a first opening edge on a side where the first bias spring is provided. The first opening edge is disposed between a first line that passes through the center of the platen bearing in a direction perpendicular to a direction in which the force of the first bias spring acts and a second line that is substantially parallel to the first line and touches the platen bearing held in the frame opening on the side where the first bias spring is provided.

In the printer, the frame opening includes a second opening edge on a side that is opposite to the side where the first bias spring is provided. The second opening edge is disposed between a line that is substantially parallel to a direction in which the force of the first bias spring acts and touches the platen bearing held in the frame opening on a side where the arm rotation shaft is provided, and an extension line that connects the center of the arm rotation shaft and the center of the platen bearing.

In the printer, the second bias spring is a torsion coil spring.

In the printer, the second bias spring is a torsion coil spring wound around the arm rotation shaft.

In the printer, the first bias spring is a coil spring.

In the printer, the platen roller includes a platen bearing, the open-close arm includes two open-close arm side parts each including an open-close arm opening for supporting the platen bearing of the platen roller, and an open-close arm back part that connects the open-close arm side parts and is disposed between the frame back part and the print head. The open-close arm side parts and the open-close arm back part are formed as a single component.

In the printer, each of the open-close arm side parts includes an opening in which the print head or a support part for supporting the print head is placed.

The printer further includes a recording paper guide that guides recording paper toward the print head. The recording paper guide includes guide parts that are disposed at the sides of the recording paper placed along the print head and extend toward the print head.

The printer further includes a recording paper guide that guides recording paper toward the print head. The recording paper guide includes a support part that supports the print head or a head support plate connected to the print head, and is disposed on a surface of the recording paper guide that is opposite to a surface of the recording paper guide for guiding the recording paper.

The printer is configured such that the open-close arm pushes the platen roller in a direction to detach the platen roller when the open-close arm is rotated around the arm rotation shaft.

In the printer, the platen roller includes a platen bearing, the frame includes a frame opening in which the platen bearing of the platen roller is placed, and a direction of a tangent of a contact point between an edge of the frame opening and the platen bearing is substantially perpendicular to a direction in which the restoring force of the first bias spring acts.

The printer further includes an optical sensor that detects the open-close arm to determine whether the open-close arm is open or closed.

In the printer, the third biasing part is a spring.

In the printer, the open-close arm includes a shaft that extends substantially parallel to the platen roller, and the torsion coil spring is wound around the outer surface of the shaft.

The printer includes two torsion coil springs that are disposed near the ends of the shaft.

In the printer, the two torsion coil springs are connected to each other and formed as a single component.

In the printer, the torsion coil spring includes an open-close arm return spring that causes the open-close arm to return to the home position and a head pressing spring that presses the print head.

In the printer, the plate spring is formed by bending a material forming the open-close arm along a direction that is substantially parallel to a direction in which the platen roller extends.

In the printer, the plate spring includes an open-close arm return spring that causes the open-close arm to return to the home position and a head pressing spring that presses the print head.

The disclosed embodiments are examples and are not intended to limit the present invention. The scope of the invention is defined by the claims and includes equivalents and variations of the claims.

What is claimed is:

1. A printer, comprising:

a frame that includes a frame back part;

an arm that includes a rotation shaft and is supported by the frame to rotate around the rotation shaft relative to the frame;

a platen roller that includes a bearing rotatably supported by the frame or the arm;

a print head that is disposed between the frame back part and the platen roller and performs printing on a recording sheet placed between the platen roller and the print head; and a first bias spring that is disposed between the frame back part and the print head and biases the print head toward the platen roller relative to the frame back part, wherein the frame includes a frame opening whose first edge is in contact with the bearing on a first side that is across the bearing from a second side where the print head is provided; and the first edge of the frame opening extends parallel to a first line connecting the rotation shaft of the arm and a center of the bearing of the platen roller.

2. The printer as claimed in claim 1, further comprising:

a second bias spring that is fixed to the frame and biases the arm to rotate toward the frame back part.

3. The printer as claimed in claim 2, wherein the second bias spring biases the arm to rotate toward the frame back part so that the platen roller is pressed toward the print head.

4. The printer as claimed in claim 2, wherein the arm includes an arm opening whose edge comes in contact with the bearing on the first side, the edge of the arm opening presses the platen roller with a force of the second bias spring toward the print head; and a second edge of the frame opening is in contact with the bearing on the second side.

5. The printer as claimed in claim 2, wherein the arm includes an arm opening whose edge comes in contact with the bearing and presses the platen roller with a force of the second bias spring toward the print head; and a contact part of the edge of the arm opening is located on a side opposite to a side where the first bias spring is provided across a second line that passes through the center of the bearing in a direction perpendicular to a direction in which a force of the first bias spring acts.

6. The printer as claimed in claim 5, wherein a second edge of the frame opening comes in contact with the bearing on the second side.

7. The printer as claimed in claim 6, wherein the bearing comes in contact with the second edge of the frame opening on the side of the second line where the first bias spring is provided.

8. The printer as claimed in claim 2, wherein a first end of the second bias spring is connected to the frame, and a second end of the second bias spring is in contact with the arm; and a distance between the rotation shaft and a position at which the second end of the second bias spring contacts the arm is greater than a distance between the rotation shaft and a position at which the first bias spring contacts the frame back part.

9. The printer as claimed in claim 1, wherein the frame includes a frame bottom part; and the arm includes a protrusion that contacts the frame bottom part when the arm is rotated around the rotation shaft.

10. The printer as claimed in claim 2, wherein the arm enters a first state where the arm holds the platen roller, a second state where the arm is rotated to a maximum extent relative to the frame, and a third state that occurs while the arm transitions from the second state to the first state.

11. The printer as claimed in claim 10, wherein the arm includes a first engaging part; and the print head includes a second engaging part that engages the first engaging part; and in the third state, the first engaging part engages the second engaging part and a restoring force of the first bias spring and a restoring force of the second bias spring are balanced such that a state of the arm is maintained.

12. The printer as claimed in claim 10, further comprising:

a detection unit that detects the state of the arm, and when the detection unit detects that the arm is in one of the second state and the third state, the printer is controlled to not perform printing on the recording sheet with the print head.

13. The printer as claimed in claim 1, wherein the arm includes a lock part that is in contact with the bearing on a side that is opposite to a side where the print head is provided;

the bearing is placed in the frame opening; and the platen roller is configured to rotate in a direction that faces a tip of the lock part.

14. The printer as claimed in claim 1, further comprising:

a sheet guide that is disposed near the platen roller and guides the recording sheet, the sheet guide and the arm being integrally formed; and a sensor that detects the sheet guide to determine whether the arm is open or closed.

15. The printer as claimed in claim 14, wherein the sheet guide is biased toward the platen roller by a third biasing part.

16. A printer, comprising:

a frame;

an arm that includes a rotation shaft and is supported by the frame to rotate around the rotation shaft relative to the frame;

a platen roller that is rotatably supported by the arm and the frame;

a print head that performs printing on a recording sheet placed between the platen roller and the print head; and a torsion coil spring that is wound around the rotation shaft, wherein a first end of the torsion coil spring is connected to the arm, and a second end of the torsion coil spring is in contact with the print head and presses the print head toward the platen roller.

17. A printer, comprising:

a frame;

an arm that is rotatably supported by the frame;

a platen roller that includes a bearing rotatably supported by the arm or the frame;

a print head that performs printing on a recording sheet placed between the platen roller and the print head; and a plate spring that is connected to the arm, wherein when the platen roller is supported by the arm or the frame, the plate spring presses the print head positioned between the platen roller and the plate spring toward the platen roller;

the frame includes a frame opening whose edge is in contact with the bearing on a first side that is across the bearing from a second side where the print head is provided; and the first edge of the frame opening extends parallel to a first line connecting the rotation shaft of the arm and a center of the bearing of the platen roller.

* * * * *